US007185883B2

(12) United States Patent
Kato et al.

(10) Patent No.: US 7,185,883 B2
(45) Date of Patent: Mar. 6, 2007

(54) SHEET TREATING APPARATUS AND IMAGE FORMING APPARATUS

(75) Inventors: Hitoshi Kato, Ibaraki (JP); Tetsuya Terada, Ibaraki (JP); Yasutaka Iwasa, Kanagawa (JP); Masahiro Yonenuma, Chiba (JP)

(73) Assignees: Canon Kabushiki Kaisha, Tokyo (JP); Canon Finetech Inc., Mitsukaido (JP)

( * ) Notice: Subject to any disclaimer, the term of this patent is extended or adjusted under 35 U.S.C. 154(b) by 31 days.

(21) Appl. No.: 10/928,194

(22) Filed: Aug. 30, 2004

(65) Prior Publication Data

US 2005/0062210 A1 Mar. 24, 2005

(30) Foreign Application Priority Data

Sep. 1, 2003 (JP) ..... 2003-308882

(51) Int. Cl.
*B65H 39/00* (2006.01)

(52) U.S. Cl. ..... 270/58.11; 270/58.08; 270/58.09; 270/58.14; 270/58.18; 270/58.01

(58) Field of Classification Search ..... 270/58.01, 270/58.11, 58.14, 58.18, 58.08, 58.09
See application file for complete search history.

(56) References Cited

U.S. PATENT DOCUMENTS

| | | | | |
|---|---|---|---|---|
| 3,878,540 | A * | 4/1975 | Kawai | 340/530 |
| 6,375,180 | B1 * | 4/2002 | Kawano et al. | 270/58.09 |
| 6,398,212 | B1 * | 6/2002 | Miyake | 271/186 |
| 6,568,668 | B1 * | 5/2003 | Wakabayashi et al. | 270/58.11 |
| 6,634,641 | B2 * | 10/2003 | Yamakawa et al. | 271/220 |
| 6,654,570 | B2 | 11/2003 | Kato | 399/66 |
| 6,666,444 | B1 * | 12/2003 | Paoli | 270/58.11 |
| 6,712,349 | B2 * | 3/2004 | Watanabe | 270/37 |
| 6,819,906 | B1 * | 11/2004 | Herrmann et al. | 399/368 |
| 6,942,206 | B2 * | 9/2005 | Kuwata et al. | 270/58.08 |
| 6,962,331 | B2 * | 11/2005 | Matsumoto et al. | 270/58.09 |
| 6,981,697 | B2 * | 1/2006 | Sasa et al. | 270/58.11 |
| 2003/0044186 | A1 | 3/2003 | Kato et al. | 399/16 |
| 2003/0184010 | A1 | 10/2003 | Kato et al. | 271/207 |
| 2003/0235328 | A1 | 12/2003 | Nakamura et al. | 382/112 |
| 2004/0081478 | A1 | 4/2004 | Kobayashi et al. | 399/69 |

FOREIGN PATENT DOCUMENTS

| | | |
|---|---|---|
| JP | 9-48545 | 2/1997 |
| JP | 2003-81517 | 3/2003 |

* cited by examiner

*Primary Examiner*—Gene O. Crawford
*Assistant Examiner*—Leslie A. Nicholson, III
(74) *Attorney, Agent, or Firm*—Fitzpatrick, Cella, Harper & Scinto

(57) ABSTRACT

A sheet treating apparatus including, a conveying device for conveying sheets, a sheet stack tray for stacking the sheets conveyed by the conveying device, a sensor detecting the sheets conveyed to the sheet stack tray, a pressure-contact conveying device for conveying the sheets on the sheet stack tray in pressure contact with the sheets, a pressure-contact device for bringing the pressure-contact conveying device into pressure-contact with the sheets, and a controlling device for varying a time from when the sensor detects the sheets to when the pressure-contact device starts operating according to a sheet conveyance speed of the conveying device.

4 Claims, 46 Drawing Sheets

SHEET TREATING APPARATUS AND IMAGE FORMING APPARATUS

BACKGROUND OF THE INVENTION

1. Field of the Invention

The present invention relates to a sheet treating apparatus detachably or integrally mounted to a main body of an image forming apparatus such as a copying machine or a printer and adapted to treat sheets conveyed from the image forming apparatus main body. In particular, the invention relates to a sheet treating apparatus capable of storing (buffering) sheets conveyed during the treatment of the sheets and an image forming apparatus provided with the sheet treating apparatus, and to a technique of preventing any roller trace and runner trace left on the sheet.

2. Related Background Art

In recent years, a sheet treating apparatus such as a sorter for sorting sheets after image formation is being under development as options on an image forming apparatus such as a copying machine or a laser beam printer, which employs an electrophotographic process. This type of sheet treating apparatus carries out at least one of sort treatment, staple treatment, and alignment treatment on sheets.

In a sheet treating apparatus equipped with a stapler for stapling sheets, the sheets conveyed into a sheet treating apparatus main body are stacked on a treatment tray after passing through a conveyance path inside the main body and then stapled.

The sheet treating apparatus for stapling a sheet bundle stacks the sheets into a bundle on the treatment tray and moves the stapler as stapling means to staple the bundle at one or more positions (generally, two positions). Any sheets for the next job cannot be stacked on the treatment tray during a stapling operation. As a result, a sheet interval must be widened between sheets for each stapling job.

However, widening a sheet interval lowers productivity, in other words, reduces the number of sheets treated per unit time. Proposed as a sheet treating apparatus that solves the drop in productivity is one provided with a sheet holding portion (buffer portion) that holds and keeps the sheets on standby at the midpoint of the conveyance path through which the sheets are conveyed to the treatment tray.

The sheet treating apparatus stores, while treating plural sheets stacked on the treatment tray, plural succeeding sheets in the sheet holding portion and stacks the sheets (buffer sheets) stored in the sheet holding portion on the treatment tray upon completion of the treatment, and then supplies to the treatment tray the remaining succeeding sheets up to the predetermined number.

There are two types of such sheet treating apparatuses provided with the sheet holding portion. First, one type is a rotary buffer type sheet treating apparatus where buffer sheets wind around a roller (see JP H09-048545 A (FIG. 38)). The other type is a horizontal buffering type sheet treating apparatus where buffer sheets are subjected to buffering while kept horizontal on a conveyance path (see JP 2003-081517 A, for example).

The horizontal buffering type sheet treating apparatus requires no roller around which the buffer sheets wind unlike the rotary buffer type one and thus has an advantage in that the apparatus can be reduced in size and cost.

In either the rotary buffer type sheet treating apparatus or the horizontal buffering type sheet treating apparatus, a roller for returning the sheets inside the treatment tray is provided, for example, which keeps rotating relative to the sheet at the same position in pressure contact with the sheet.

The treatment tray is not held horizontal, so that the sheet can turn back under its own weight. Accordingly, it is unnecessary to apply a pressure large enough to convey the sheet, thereby leaving no roller trace or runner trace.

However, in contrast to the rotary buffer type sheet treating apparatus, the horizontal buffering type one performs horizontal buffering (horizontally stacks plural sheets on top of one another) on the conveyance path. Hence, the roller capable of conveying the sheets keeps rotating relative to the sheet at rest, at the same position. As a result, a roller trace or runner trace may be left on the buffering sheet.

SUMMARY OF THE INVENTION

The present invention has been made in light of the above-mentioned circumstances and therefore has an object to provide a sheet treating apparatus that can prevent a roller trace or runner trace left on a sheet even with a roller capable of conveying a sheet or rotating roller and can realize high-level post-treatment, and an image forming apparatus provided with the sheet treating apparatus.

In order to attain the above-mentioned object, a sheet treating apparatus according to the present invention is achieved by any one of the following items (1) to (3).

(1) A sheet treating apparatus, including:

conveying means for conveying sheets;

sheet stacking means for stacking the sheets conveyed by the conveying means;

a sensor detecting the sheets conveyed to the sheet stacking means;

pressure-contact conveying means for conveying the sheets on the sheet stacking means in pressure contact with the sheets;

pressure-contact means for bringing the pressure-contact conveying means into pressure-contact with the sheets; and controlling means for varying a time from when the sensor detects the sheets to when the pressure-contact means starts operating according to a sheet conveyance speed of the conveying means.

(2) A sheet treating apparatus, including:

conveying means for conveying sheets;

sheet stacking means for stacking the sheets conveyed by the conveying means;

a sensor detecting the sheets conveyed to the sheet stacking means;

pressure-contact conveying means for conveying the sheets on the sheet stacking means in pressure contact with the sheets;

pressure-contact means for bringing the pressure-contact conveying means into pressure-contact with the sheets; and controlling means for varying a time from when the sensor detects the sheets to when the pressure-contact means starts operating according to a size of the sheet conveyed by the conveying means.

(3) A sheet treating apparatus, including:

conveying means for conveying sheets;

sheet stacking means for stacking the sheets conveyed by the conveying means;

a sensor detecting the sheets conveyed to the sheet stacking means;

pressure-contact conveying means for conveying the sheets on the sheet stacking means in pressure contact with the sheets;

pressure-contact means for bringing the pressure-contact conveying means into pressure contact with the sheets; and controlling means for controlling a time T from when the sensor detects the sheets to when the pressure-contact means starts operating, to meet a relationship represented by the following expression:

$$T=\{(B-x)\div A\}-C$$

where

A represents a conveyance speed of the conveying means,

B represents a length of the conveyed sheet in a feed direction,

C represents a time from when the pressure-contact means starts operating to when the pressure-contact conveying means is brought into pressure contact with the sheets, and x represents a distance between a position of the sensor when the pressure-contact conveying means contacts the sheet to a sheet trailing edge.

Other objects and features of the present invention will be apparent from the following description of this specification taken in conjunction with the accompanying drawings.

DESCRIPTION OF THE PREFERRED EMBODIMENTS

Hereinafter, an embodiment of the present invention will be described with reference to the accompanying drawings.

Figure 1:
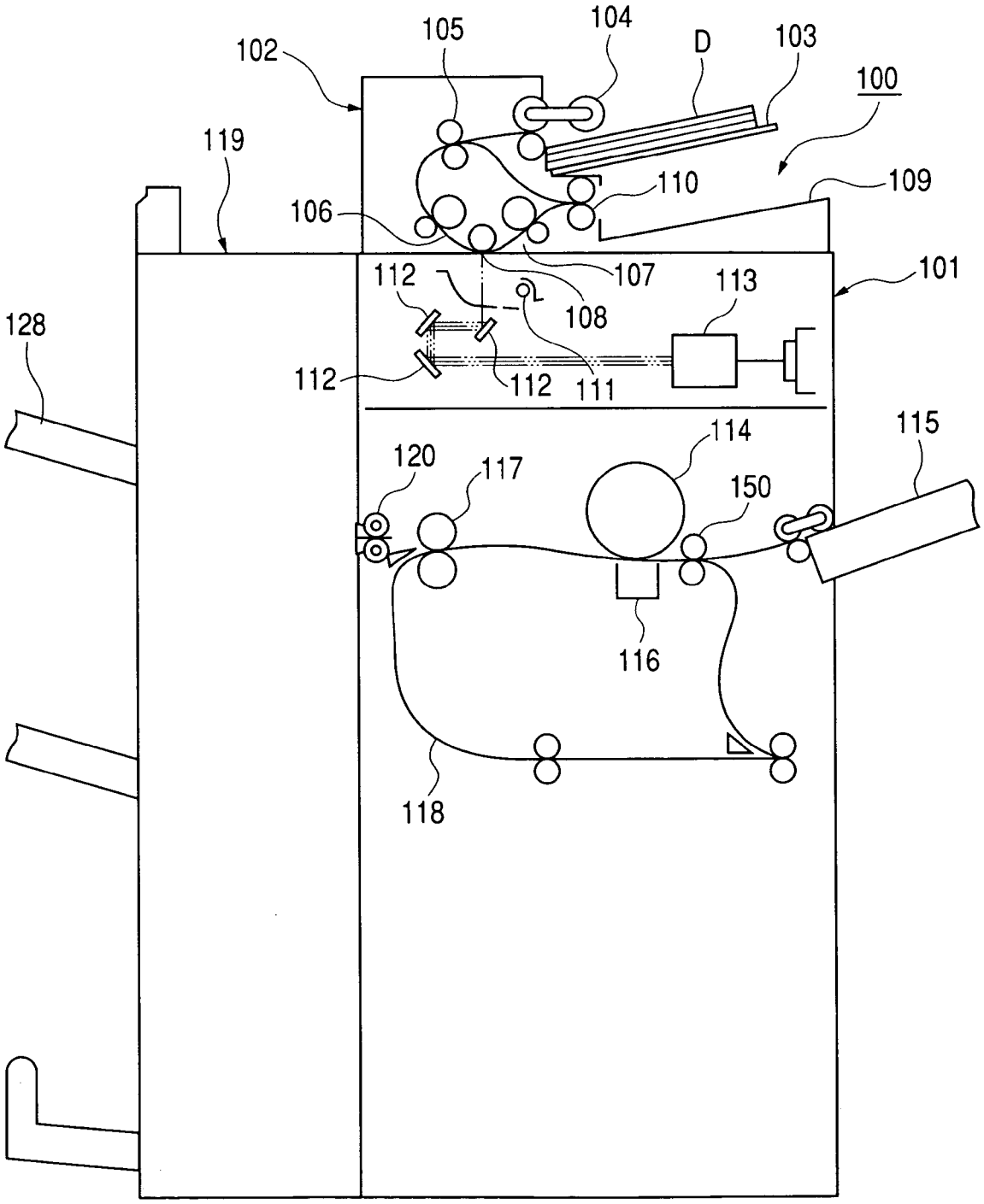
FIG. 1 is a sectional view showing an overall structure of Embodiment 1 of the present invention.

FIG. 1 is a sectional view showing a structure of a "copying machine equipped with a sheet treating apparatus" according to Embodiment 1 of the present invention. Note that the sheet treating apparatus is, more specifically, a finisher or the like.

(Image Forming Apparatus)

A copying machine 100 is composed of an apparatus main body 101 and a sheet treating apparatus 119. An original feeding apparatus 102 is provided above the apparatus main body 101. An original D is placed on an original placing portion 103 by a user and supplied to a registration roller pair 105 in succession after separated one from another by a feeding portion 104. Subsequently, the original D is temporarily stopped by the registration roller pair 105 to be looped, by which a skew is corrected. After that, the original D passes a reading position 108 through an introduction path 106 to thereby read an image formed on an original surface. The original D having passed the reading position 108 passes through a discharging path 107 to be discharged onto a discharging tray 109.

Also, in the case of reading both of front and rear surfaces of the original, first, the original D passes the reading position 108 to thereby read an image formed on one surface of the original in the aforementioned fashion. After that, the original D passes through the discharging path 107 and is conveyed in a switchback manner by a reversing roller pair 110. Then, the reversed original is refed to the registration roller pair 105.

Then, the original D is, as in the case of reading the image on the one surface, skew-corrected by the registration roller pair 105, and passes the reading position 108 through the introduction path 106 to thereby read an image on the other surface. Then, the original D is discharged to the discharging tray 109 through the discharging path 107.

On the other hand, the image of the original passing the reading position 108 is irradiated with light from an illumination system 111. Reflection light from the original is reflected by a mirror 112 and guided to an optical device 113 (CCD and other such devices) and then taken as image data. Laser light based on the image data is, applied to a photosensitive drum 114 as image forming means to form a latent image. Note that although not shown, the mirror 112 may directly reflect the reflection light to the photosensitive drum 114 to form a latent image.

Further, the latent image formed on the photosensitive drum 114 is visualized with a toner supplied from a toner supplying device (not shown) as a toner image. Recording media (e.g., paper and sheet such as plastic film) is stacked on a cassette 115. The sheets are fed out from the cassette 115 according to a recording signal to slip in between the photosensitive drum 114 and a transfer device 116 by a registration roller pair 150 with precise timing. Then, the toner image on the photosensitive drum 114 is transferred onto the sheet by the transfer device 116. The sheet having the toner image transferred thereonto passes through a fixing device 117 while heated and pressed by the fixing device 117, so that the toner image is fixed thereonto.

In forming images on both surfaces of the recording medium, the sheet onto the front surface of which the image is fixed by the fixing device 117 passes through a duplex path 118 provided downstream of the fixing device 117, and is refed in between the photosensitive drum 114 and the transfer device 116. Then, the toner image is transferred onto the rear surface as well. The toner image is fixed thereonto by the fixing device 117 and the sheet is discharged to the outside (toward the finisher 119 side).

Figure 2:
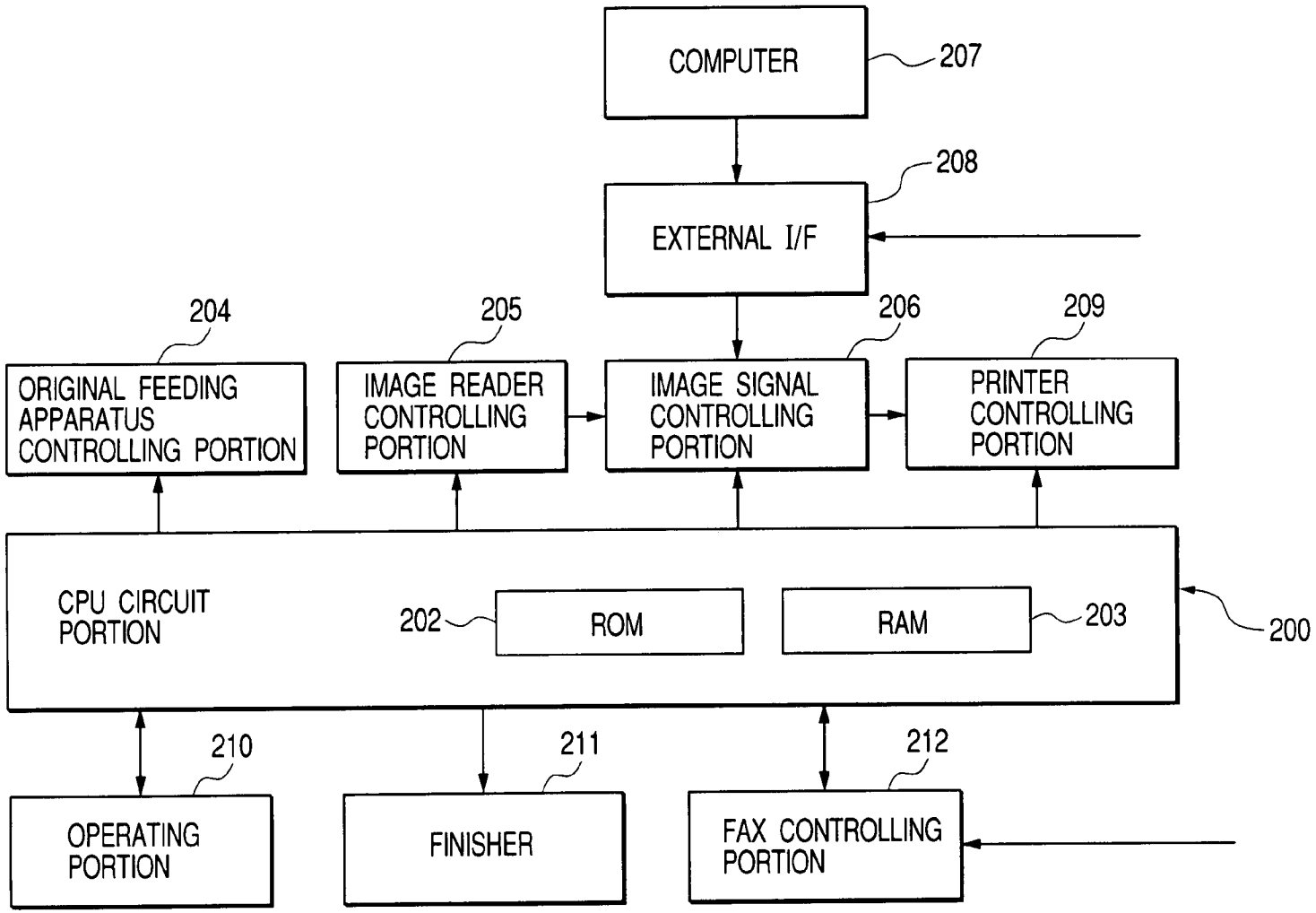
FIG. 2 is a block diagram showing an overall configuration of a control system.

FIG. 2 is a block diagram showing a configuration of a control system of the entire copying machine. The entire copying machine 100 is controlled by a CPU circuit portion 200. The CPU circuit portion 200 includes a ROM 202 storing a sequence, that is, control procedure for each portion, and a RAM 203 temporarily storing various kinds of information as needed. An original feeding apparatus controlling portion 204 controls an original feeding operation of the original feeding apparatus 102.

An image reader controlling portion 205 controls the illumination system 111 etc. to control the original reading operation. An image signal controlling portion 206 receives read information of the image reader controlling portion 205 or image information sent from an external computer 207 via an external I/F 208 and processes the received information to transmit a processing signal to a printer controlling portion 209. The printer controlling portion 209 controls the photosensitive drum 114 or the like based on an image processing signal transmitted from the image signal controlling portion 206 to enable image formation on the sheet.

An operating portion 210 can be used for inputting information on a sheet size when a user uses a copying machine or information as to which treatment is performed on the sheet, for example, information that staple treatment is performed on the sheet. In addition, the operating portion 210 can display information about an operation condition of the apparatus main body 101 of the copying machine or the finisher 119 as a sheet post-treatment apparatus. A finisher controlling portion 211 controls an internal operation of the finisher 119 as the sheet post-treatment apparatus. A FAX controlling portion 212 controls the copying machine so as to be usable as a facsimile machine and exchange signals with another facsimile machine.

(Sheet Treating Apparatus)

Figure 3:
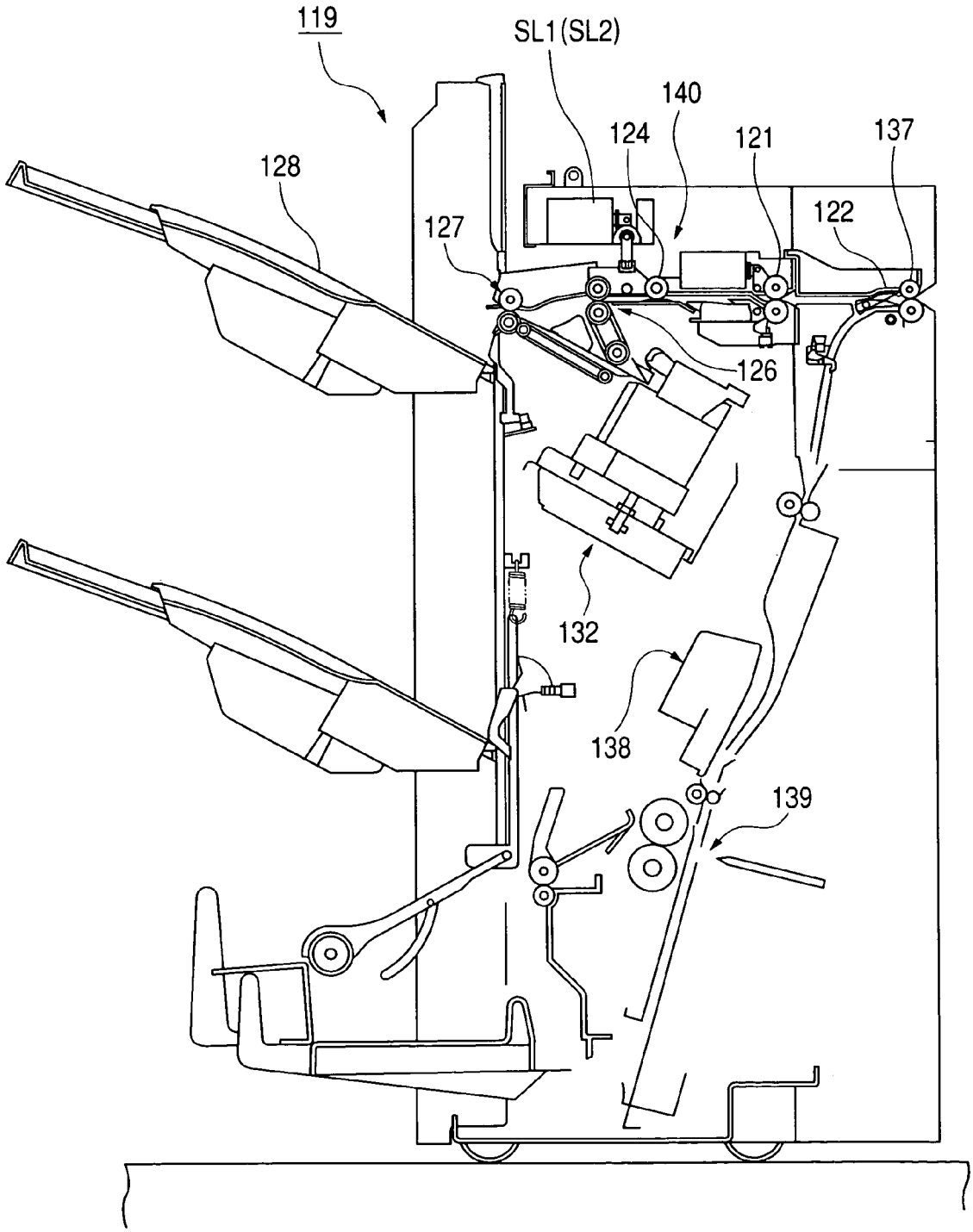
FIG. 3 is a sectional view showing an overall structure of a sheet treating apparatus.
Figure 4:
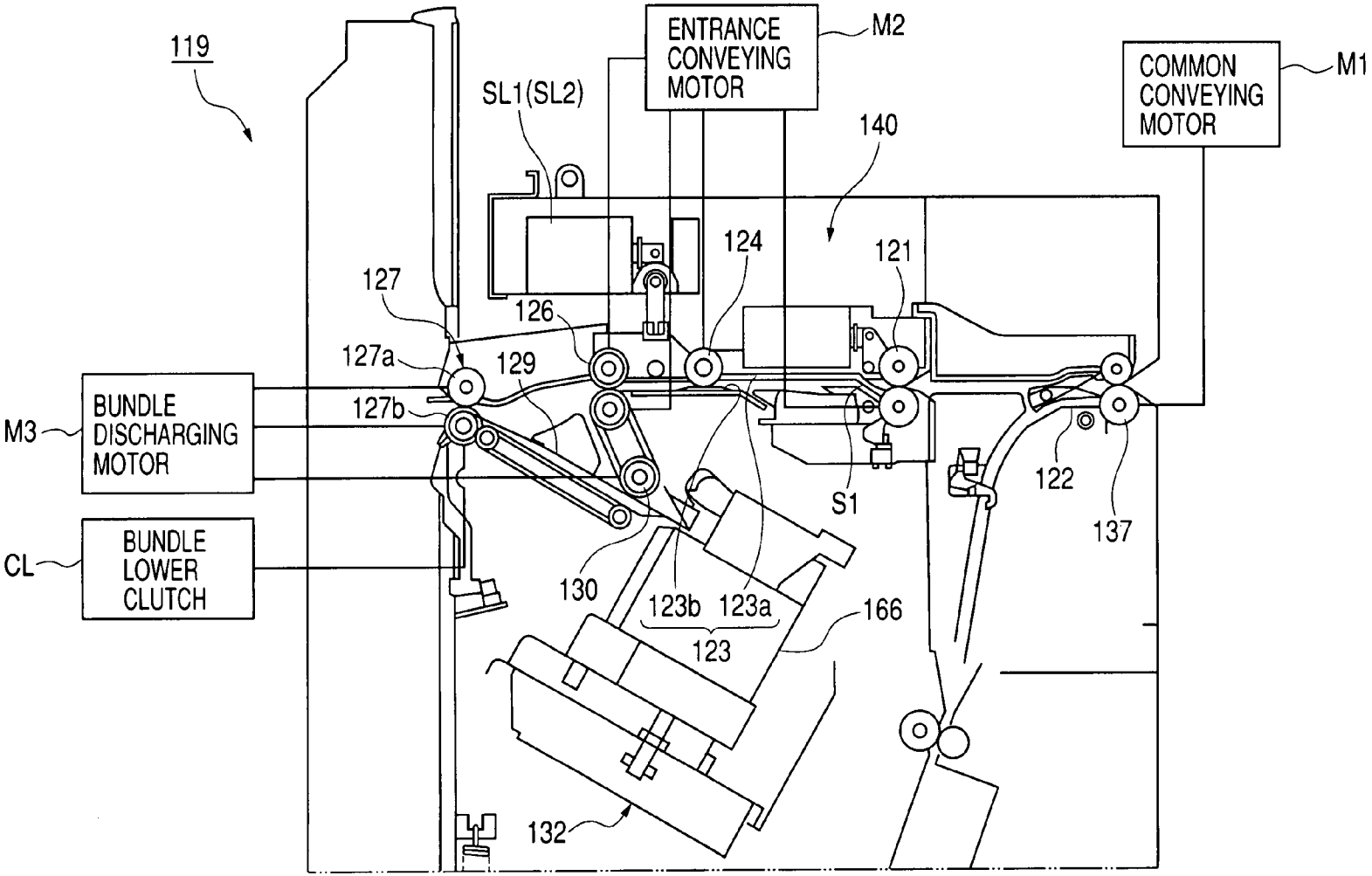
FIG. 4 is a sectional view showing each drive system.
Figure 8:
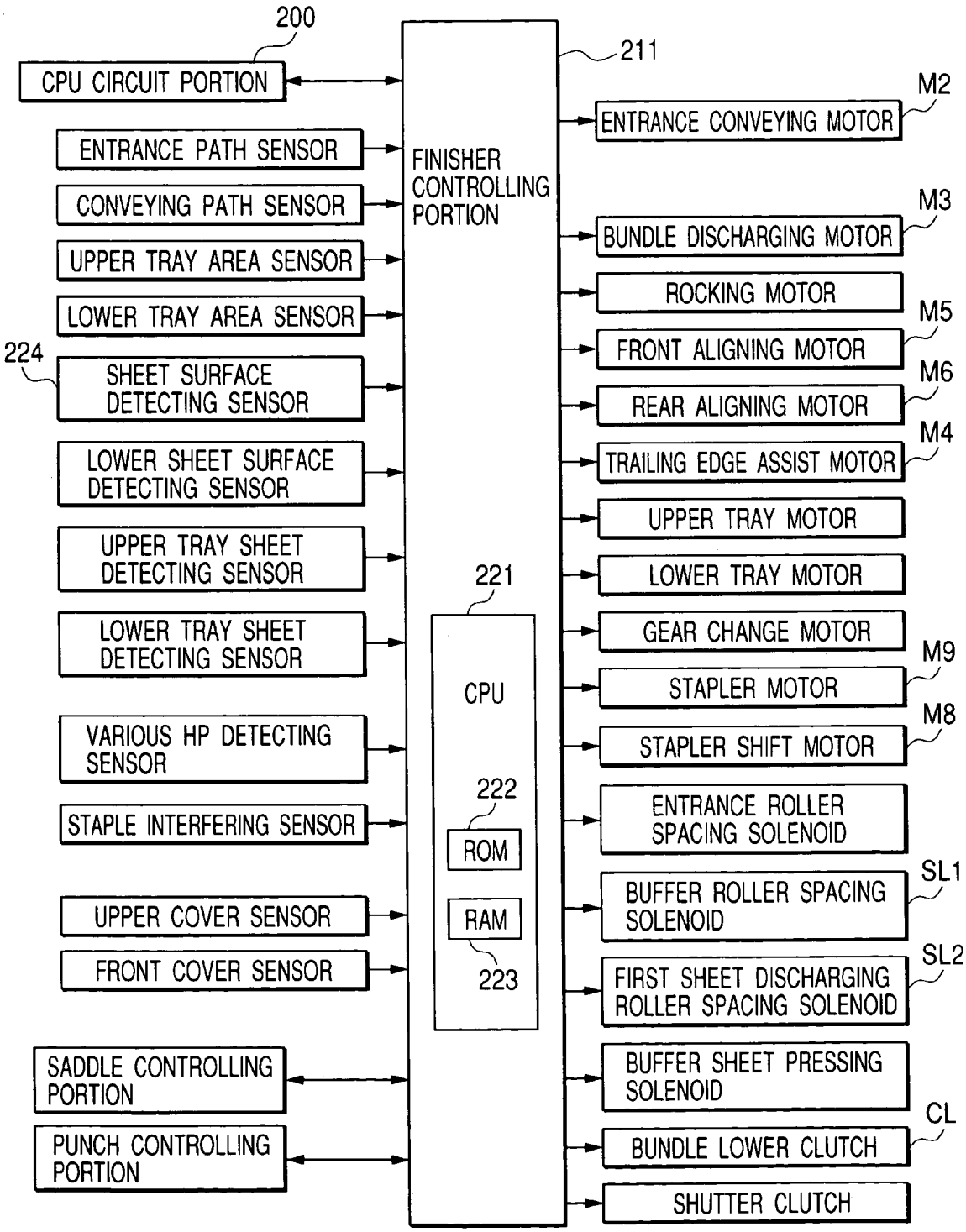
FIG. 8 is a block diagram showing a structure of a control system of the sheet treating apparatus.
Figure 9:
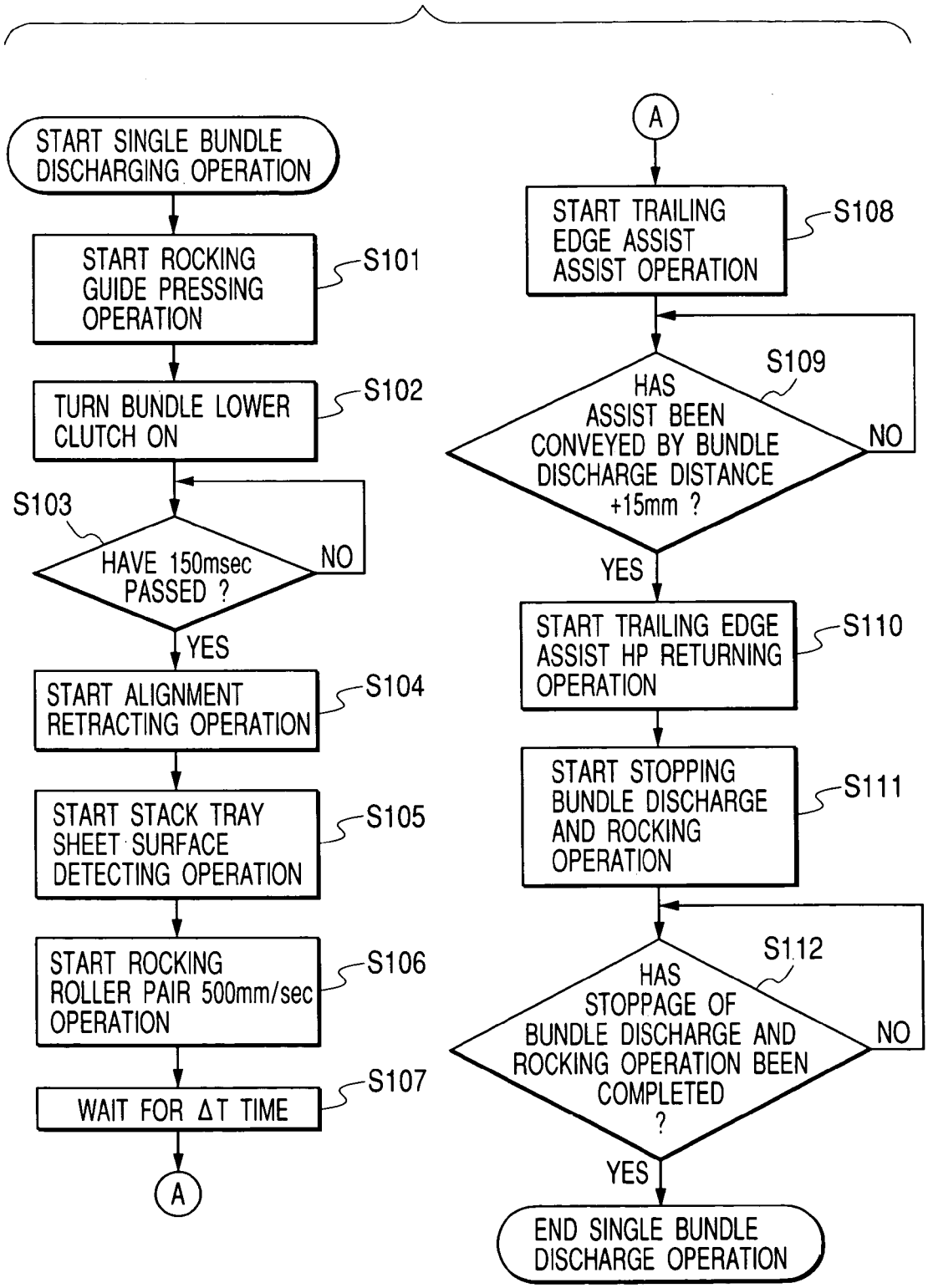
FIG. 9 is a flowchart showing an operation of discharging a sheet bundle.
Figure 10:
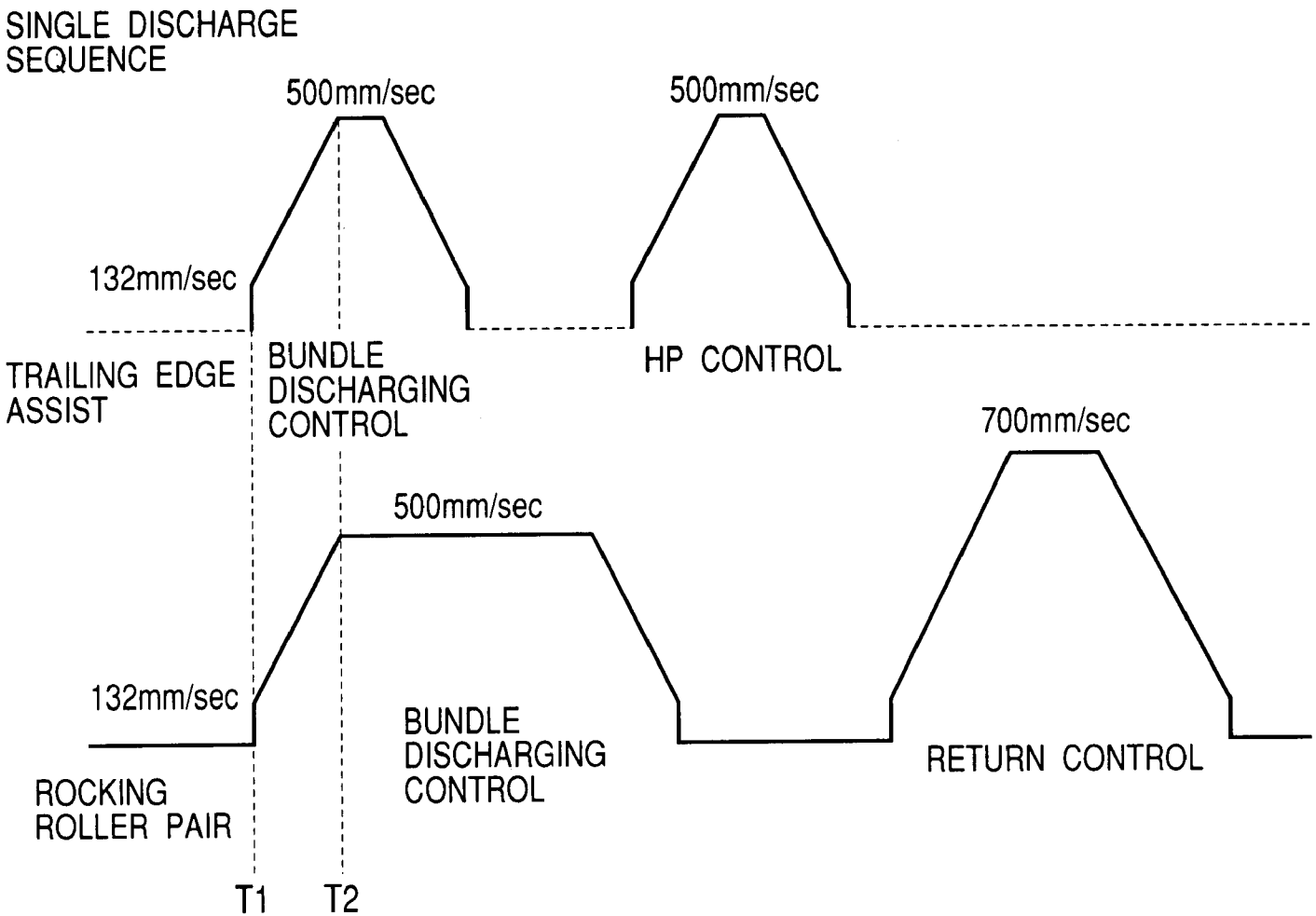
FIG. 10 shows a relationship between a moving speed of a trailing edge assist 134 and a sheet conveyance speed of a rocking roller pair 127 with respect to elapsed time.
Figure 11:
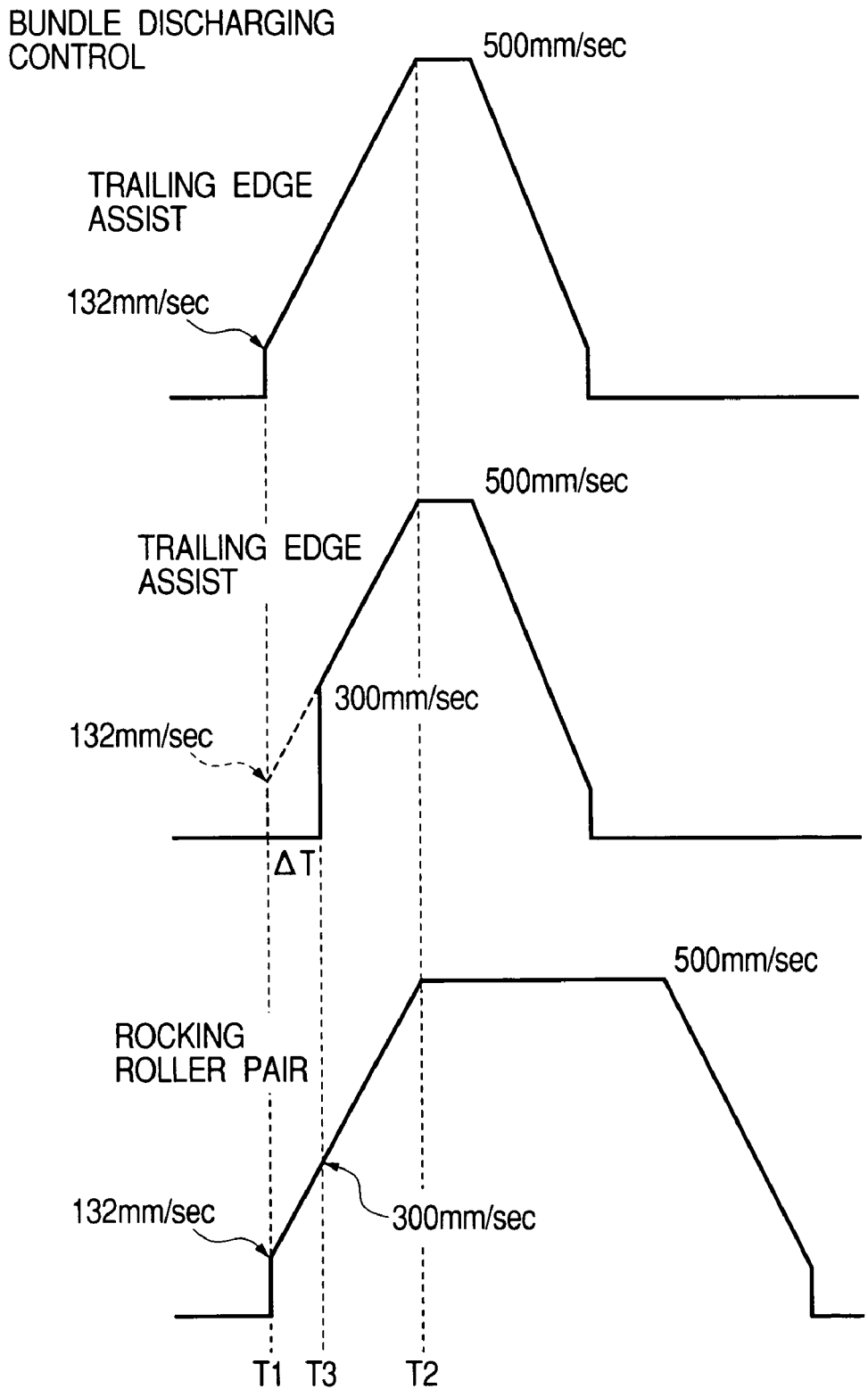
FIG. 11 shows a relationship between the moving speed of the trailing edge assist 134 and the sheet conveyance speed of the rocking roller pair 127 with respect to elapsed time.
Figure 12:
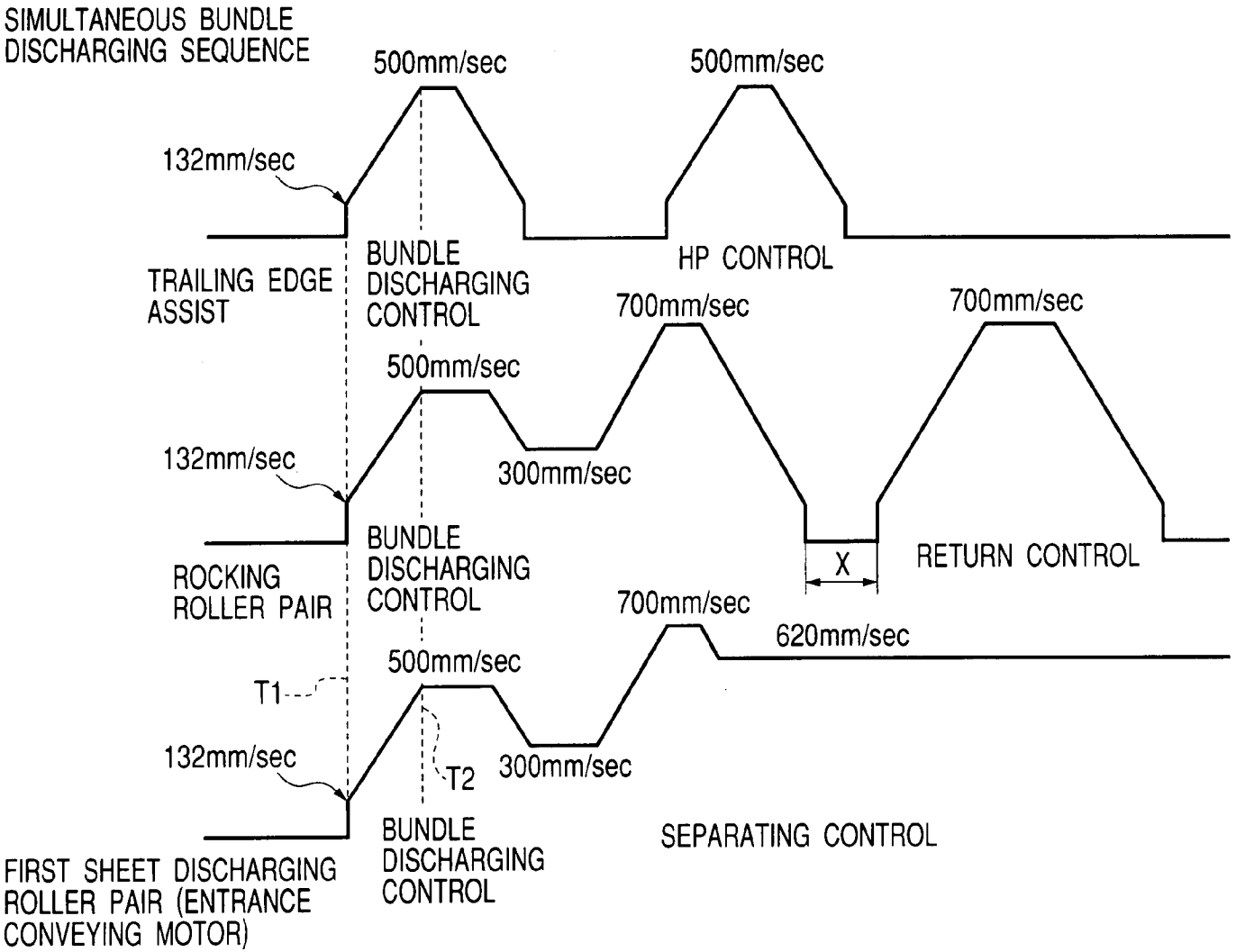
FIG. 12 shows a simultaneous bundle discharging sequence.

FIG. 3 is a longitudinal sectional view showing an overall structure of the sheet treating apparatus. FIG. 4 is a longitudinal sectional view showing each drive system. FIG. 8 is a block diagram showing a configuration of a control system of the sheet treating apparatus. FIG. 9 is a flowchart illustrative of an operation of the sheet treating apparatus. FIGS. 10 to 12 each show a relationship between a moving speed of a trailing edge assist 134 and a sheet conveyance speed of a rocking roller pair 127 with respect to elapsed time. FIG. 10 illustrates a single discharge sequence for discharging a sheet bundle by means of the trailing edge assist 134 and the rocking roller pair 127. FIG. 11 illustrates bundle discharging control in the case where the trailing edge assist 134 and the rocking roller pair 127 differ from each other in start speed. FIG. 12 shows a simultaneous bundle discharging sequence for simultaneously conveying a sheet bundle and buffer sheets stored in a buffer unit 140 by means of the trailing edge assist 134, the rocking roller pair 127, and a first sheet discharging roller pair 126.

The sheet treating apparatus 119 has a function of binding a sheet bundle and is provided with a stapler unit 132 for stapling portions closer to edges of the sheet bundle, a stapler 138 for stapling central portions of the sheet bundle, and a folding unit 139 for folding the sheet bundle stapled by the stapler 138 along the stapled portions into a booklet form.

The sheet treating apparatus 119 in this embodiment is provided with a buffer unit 140 for storing (buffering) plural sheets in a state of being stacked on top of one another with the edges evened up during the operation of the stapler unit 132.

The buffer unit 140 stores the plural sheets in a state of being stacked on top of one another with the edges evened up. Thus, unlike a conventional mechanism including a buffer roller, for example, it can be made flat, thereby making it possible to reduce a size and weight of the sheet treating apparatus. Further, the sheets can be stored with the edges evened up and hence are not rolled unlike the case of using the buffer roller. Therefore, the sheet is easy to handle. The sheet treatment time of the sheet treating apparatus can be accordingly shortened.

The sheet treating apparatus 119 is controlled by the finisher controlling portion 211 as shown in FIGS. 2 and 8. Provided inside a CPU 221 of the finisher controlling portion 211 are a ROM 222 storing a control procedure (sequence) etc. of the sheet treating apparatus 119 operated in response to an instruction from the CPU circuit potion 200 of the apparatus main body of the copying machine and a RAM 223 storing information necessary for controlling the sheet treating apparatus 119 as needed. The finisher controlling portion 211 is connected with a sheet surface detecting sensor 224 operated according to an operation of a sheet surface detecting lever 133 described later. The CPU 221 makes a control to raise or lower a stack tray 128 based on a sheet detection signal of the sheet surface detecting sensor 224.

The finisher controlling portion 211 controls operations of an entrance conveying motor M2 for rotating an entrance roller pair 121, a buffer roller 124, and the first sheet discharging roller pair 126, a bundle discharging motor M3 for rotating the rocking roller pair 127 and a return roller 130, and a bundle lower clutch CL for transmitting a torque of the bundle discharging motor M3 to a lower roller 127*b* or cutting the transmission as shown in FIG. 4 based on the sequence.

Note that the CPU circuit portion 200 and the finisher controlling portion 211 of FIG. 2 may be integrated.

The lower roller 127*b* and the return roller 130 described later are rotated by the same motor (the bundle discharging motor M3). As a result, when the lower roller 127*b* and the return roller 130 convey the sheet or sheet bundle, there is a possibility that the sheet or sheet bundle wrinkles or is torn in the case where the rollers slip or a sheet conveyance speed is different between the two rollers. The bundle lower clutch CL of FIG. 4 is therefore provided to absorb a speed difference.

(Explanation of Operation of Stapling and Discharging Sheet Bundle)

If the user selects a sheet staple treatment on a display screen of the operating portion 210 (refer to FIG. 2) of the copying machine 100, the CPU circuit portion 200 controls each portion of the apparatus main body to let the copying machine start a copying operation and send a sheet staple treatment signal to the finisher controlling portion 211.

An operation illustrated in FIGS. 13A to 19 is an operation in the case where the CPU circuit portion 200 judges that the sheet length is large according to information on a sheet size which is input by the user to the operating portion 210 (for example, in the case of using an A3-size sheet) or the sheet is a special sheet whose attribute is different from ordinal sheets, such as thick or thin paper, a tab sheet, or a color sheet, according to information on a sheet type. That is, the operation illustrated in FIGS. 13A to 19 is an operation in the case where the sheet bundle is discharged onto the stack tray 128 and then an operation of stacking onto a treatment tray 129 buffer sheets starts as described later. Of course, the following operations can be performed irrespective of the sheet length or whether or not the sheet is a special sheet.

The finisher controlling portion 211 activates, based on the sheet staple treatment signal, the entrance conveying motor M2 and the bundle discharging motor M3. Also, the finisher controlling portion 211 activates a buffer roller spacing solenoid SL1 (refer to FIG. 4), separates the buffer roller 124 from a lower conveyance guide plate 123*b*, further activates a plunger (not shown), and separates an upper roller 127*a* of the rocking roller pair 127 from the lower roller 127*b*. Note that, suspending the operation of the entrance conveying motor M2 and the bundle discharging motor M3 may be controlled according to each sheet movement.

A first sheet P1 fed from a discharging roller pair 120 (refer to FIG. 1) of the apparatus main body 101 of the copying machine 100 is conveyed to the entrance roller pair 121 while being conveyed by a receiving roller pair 137 and guided by a flapper 122 as shown in FIGS. 3 and 4. The receiving roller pair 137 is rotated by a common conveying motor M1 for rotating the discharging roller pair 120.

Figure 13A:
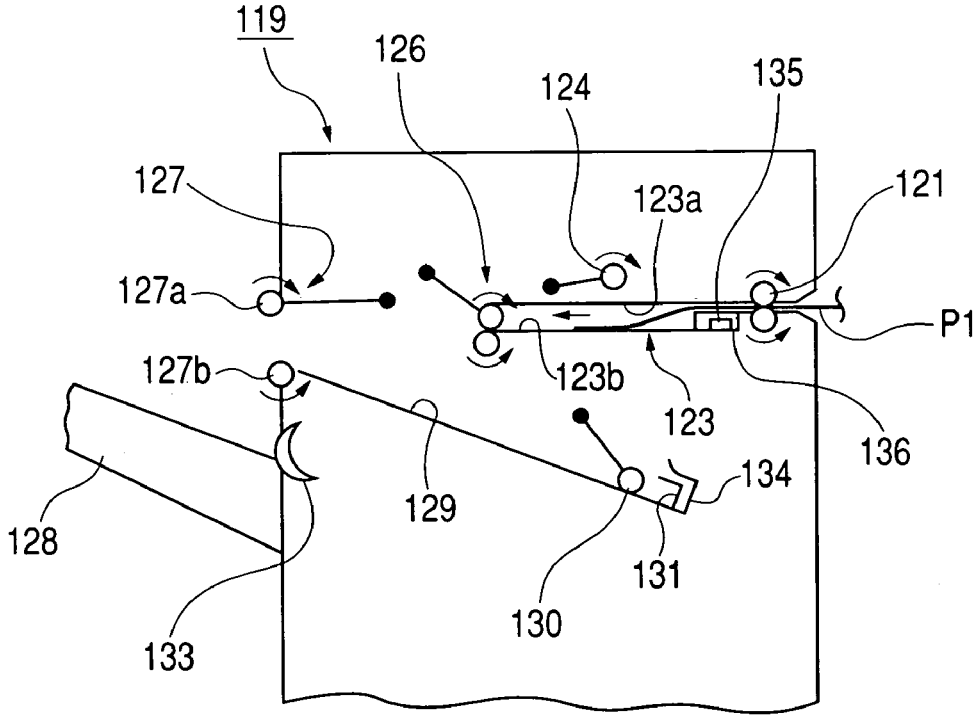
FIGS. 13A and 13B each show an operation of the sheet treating apparatus.

As shown in FIG. 13A, the entrance roller pair 121 is rotated by the entrance conveying motor M2 (refer to FIG. 4) to convey the first sheet P1. The first sheet P1 is guided by a guide 123 composed of an upper conveyance guide plate 123*a* and the lower conveyance guide plate 123*b* and conveyed to the first sheet discharging roller pair 126.

Figure 13B:
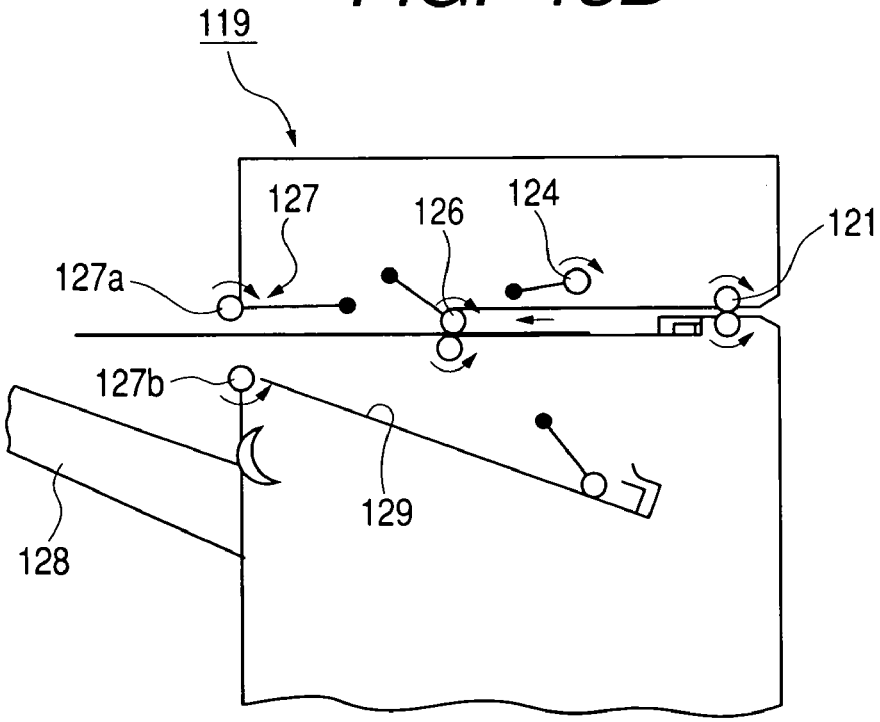
Figure 14A:
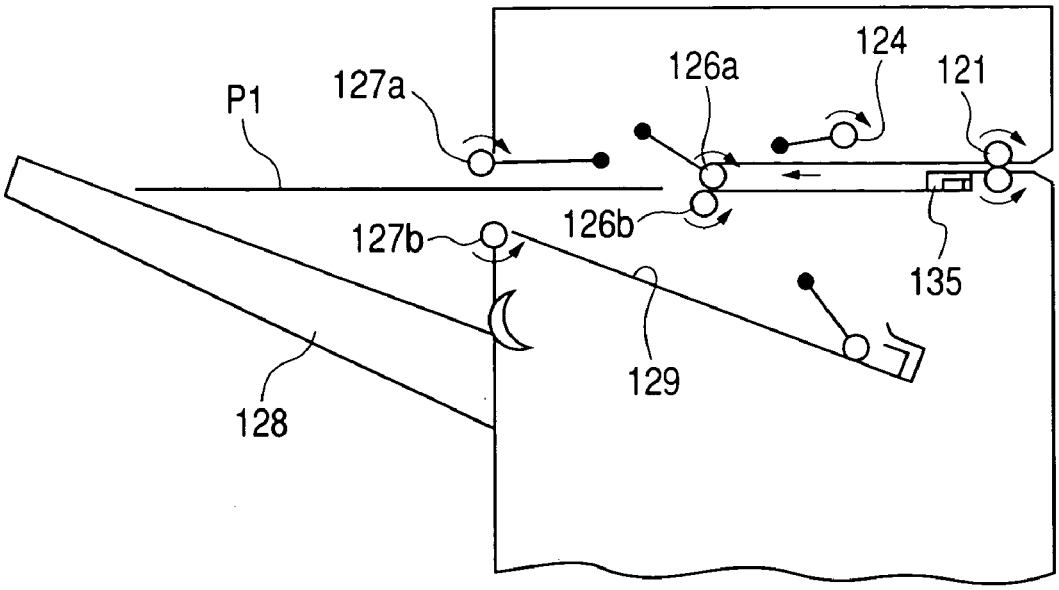
FIGS. 14A and 14B each show an operation of the sheet treating apparatus.
Figure 14B:
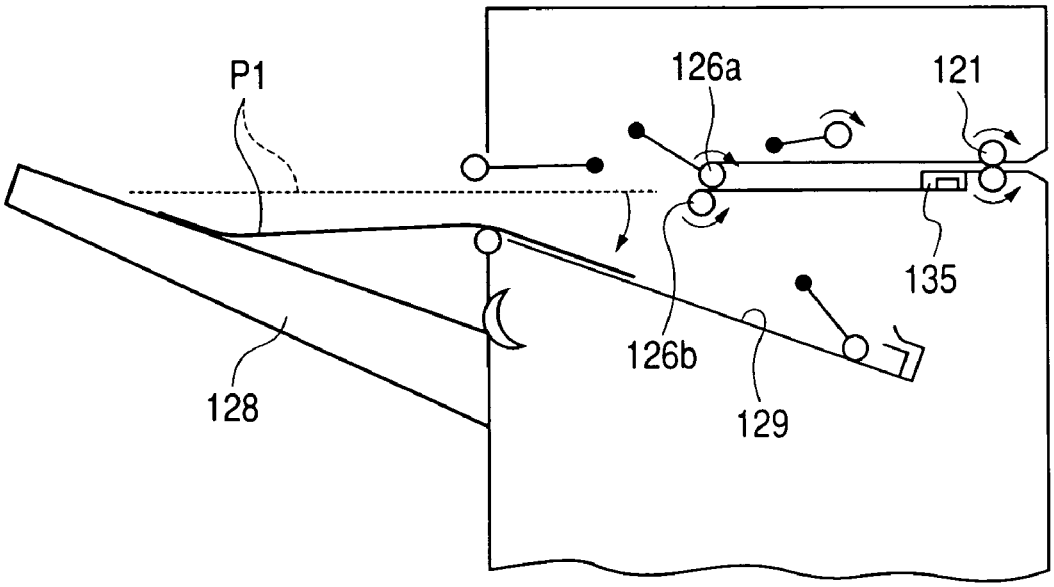
Figure 15A:
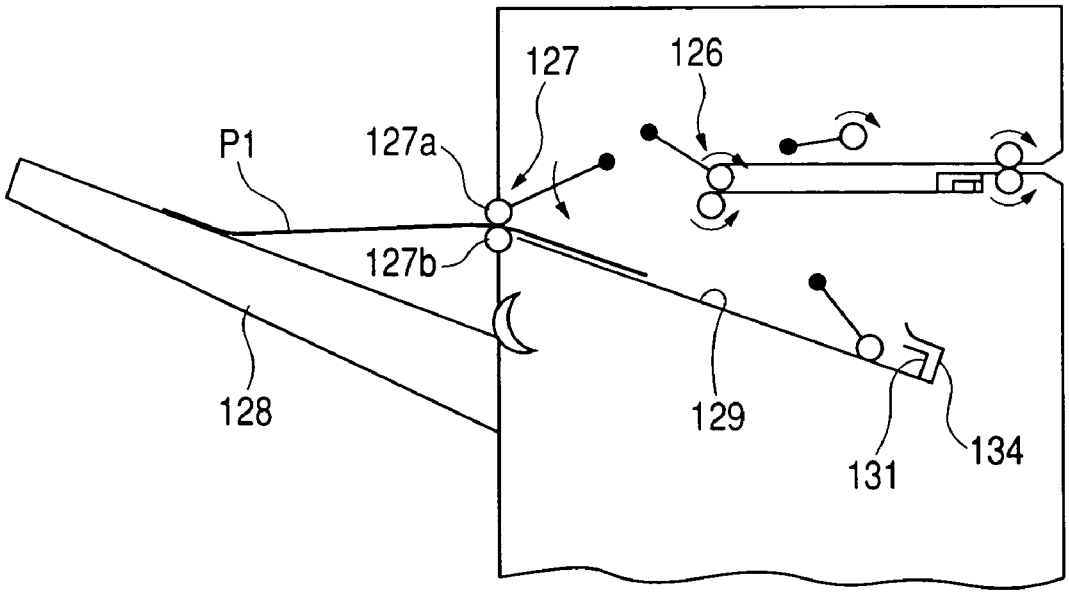
FIGS. 15A and 15B each show an operation of the sheet treating apparatus.
Figure 15B:
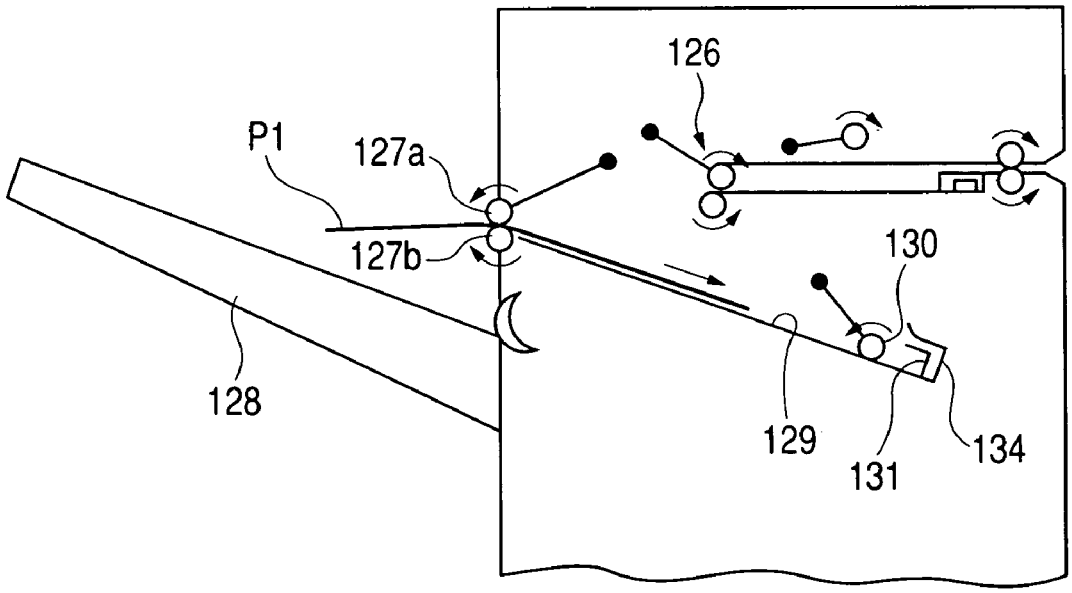

The first sheet P1 is further conveyed in accordance with the rotation of the first sheet discharging roller pair 126, as shown in FIG. 13B and discharged onto the stack tray 128 as shown in FIG. 14A. The first sheet P1 falls, as shown in FIG. 14B, over the stack tray 128 and the treatment tray 129. After that, as shown in FIGS. 15A and 15B, the upper roller 127*a* moves downwards by a plunger (not shown) and nips the sheet with the lower roller 127*b* (S101 of FIG. 9).

At this time, the upper roller 127*a* has already started rotating in the direction of the arrow by the bundle discharging motor M3 (refer to FIG. 4). Further, the return roller 130 separably contacting the treatment tray 129 is rotating in the direction of the arrow by the bundle discharging motor M3 (refer to FIG. 4). However, the lower roller 127*b* runs idle due to the operation (S102) of the bundle lower clutch CL (refer to FIG. 4). This is because in stacking the second and its subsequent sheets after the first sheet is stacked on the treatment tray 129, if the lower roller 127*b* is rotating, the lower roller 127*b* pushes the first sheet to a stopper 131 side and wrinkles may develop on the first sheet.

Figure 16A:
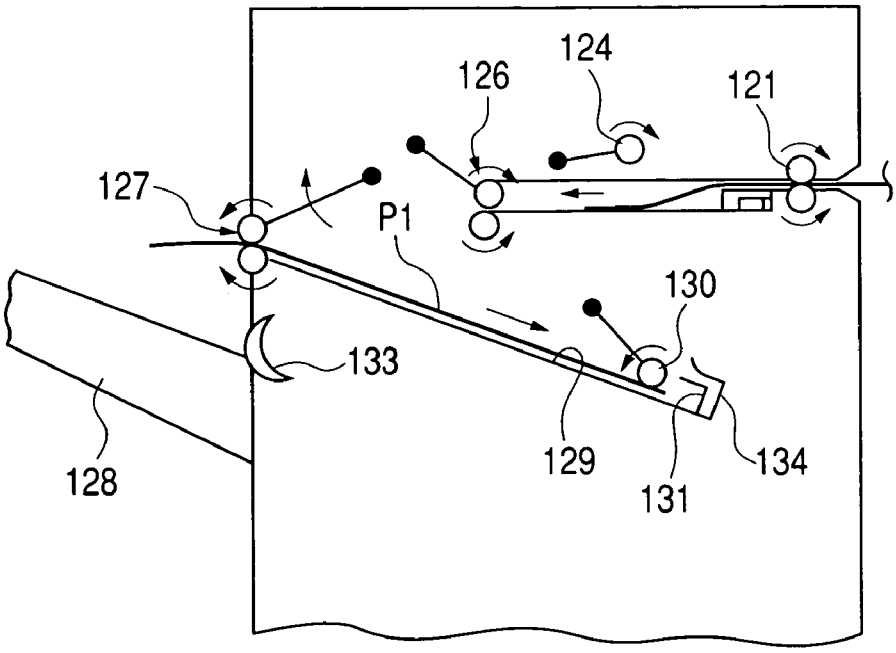
FIGS. 16A and 16B each show an operation of the sheet treating apparatus.
Figure 16B:
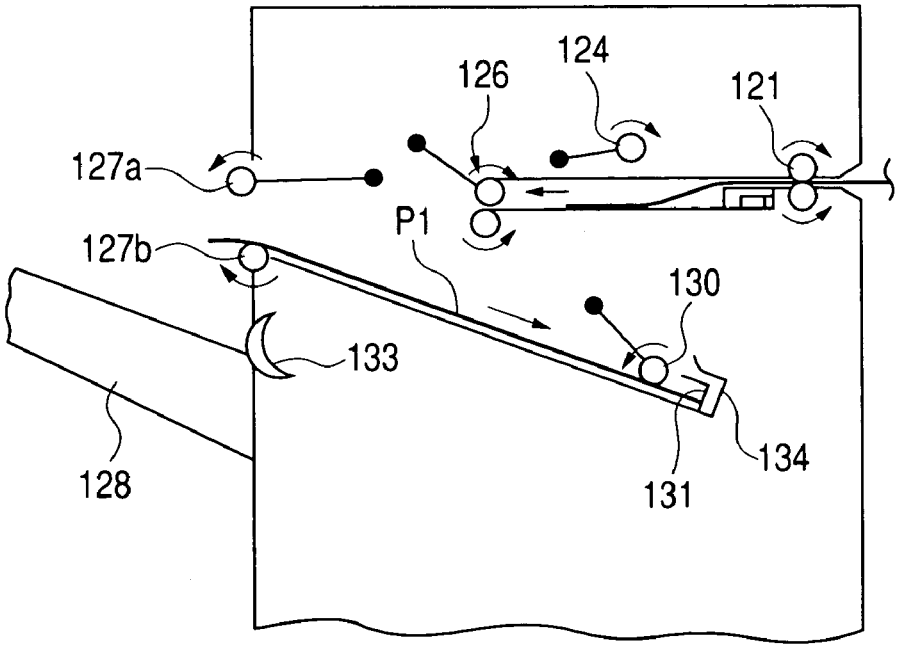

After about 150 millisecond from the activation of the bundle lower clutch CL (S103), as shown in FIG. 16A, the sheet slides down toward the direction of the arrow on the treatment tray 129 inclined to the right in accordance with the rotation of the rocking roller pair 127 and the return roller 130. At this time, the trailing edge assist 134 is on standby at a standby position. The upper roller 127*a* leaves the first sheet P1 before the first sheet P1 abuts against the stopper 131. The sheet P1 abuts against the stopper 131 by means of the return roller 130. Thereafter, the alignment of the sheet width is carried out by using a known pair of aligning plates 144 (refer to FIG. 5) (S104).

Figure 17:
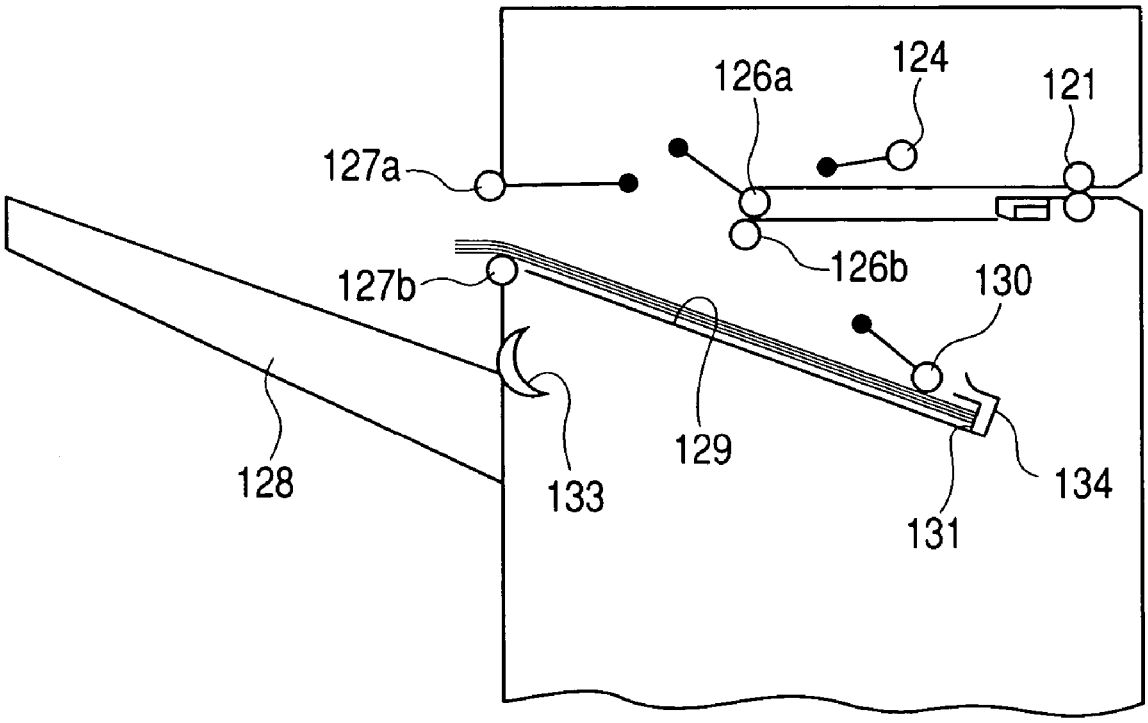
FIG. 17 shows an operation of the sheet treating apparatus.

Hereinafter, the succeeding sheets are similarly stacked on the treatment tray 129. As shown in FIG. 17, after a predetermined number of sheets are stacked on the treatment tray 129, the sheet bundle is stapled with the stapler unit 132 of FIGS. 3 and 4. Note that the sheet bundle may be punched by a punch unit (not shown) instead of staple treatment by use of the stapler unit 132.

Figure 18A:
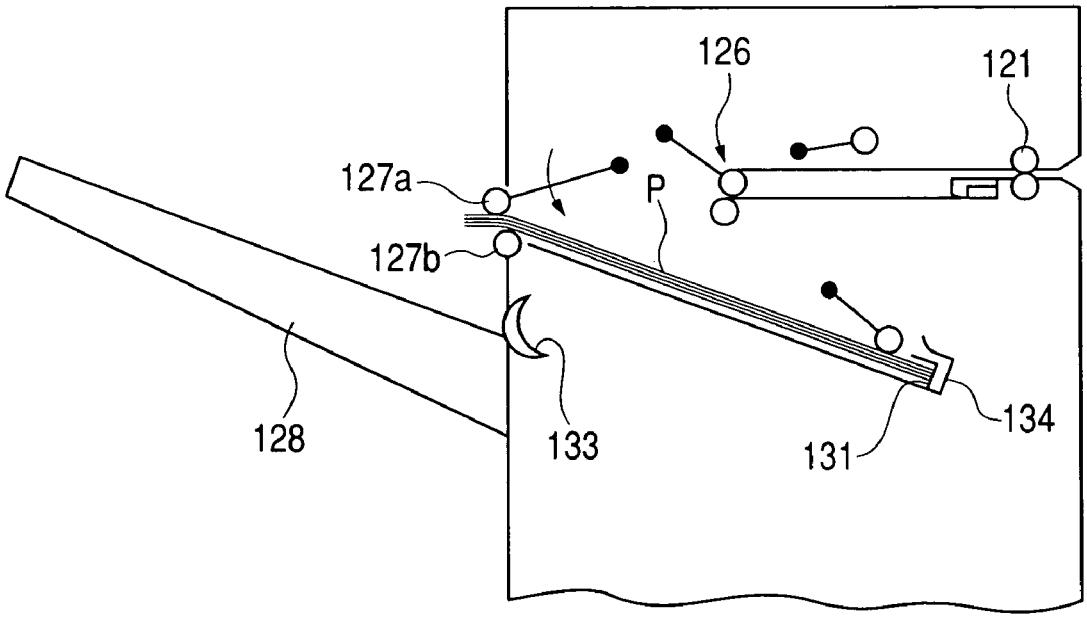
FIGS. 18A and 18B each show an operation of the sheet treating apparatus.

The sheet bundle is stapled, after which as shown in FIG. 18A, the stack tray 128 moves to a position as allows the sheet surface detecting lever 133 to detect the sheet bundle and stays at a position where the discharged sheet bundle can be easily received (S105).

Figure 5:
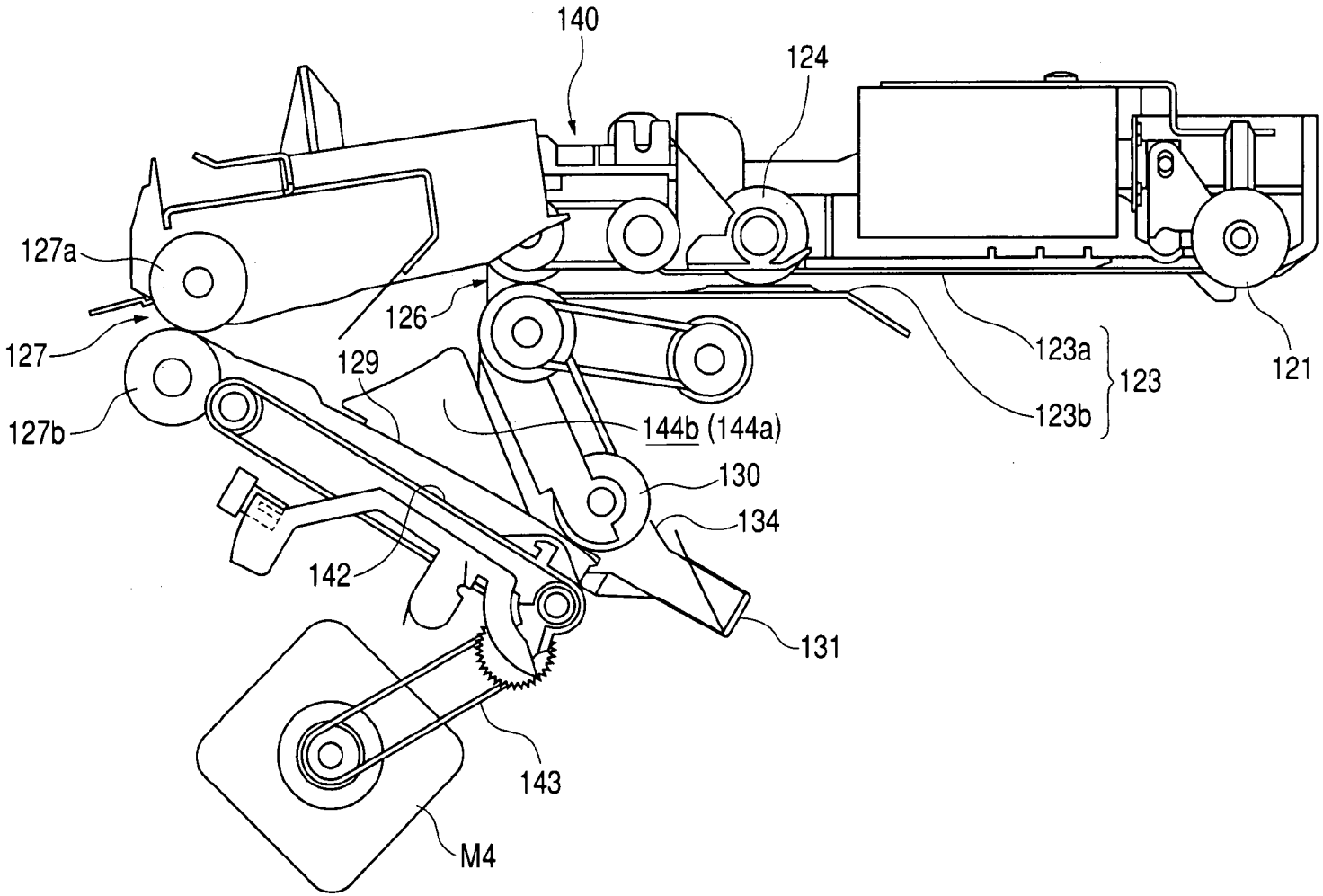
FIG. 5 is an enlarged view of a main part of the sheet treating apparatus.
Figure 6:
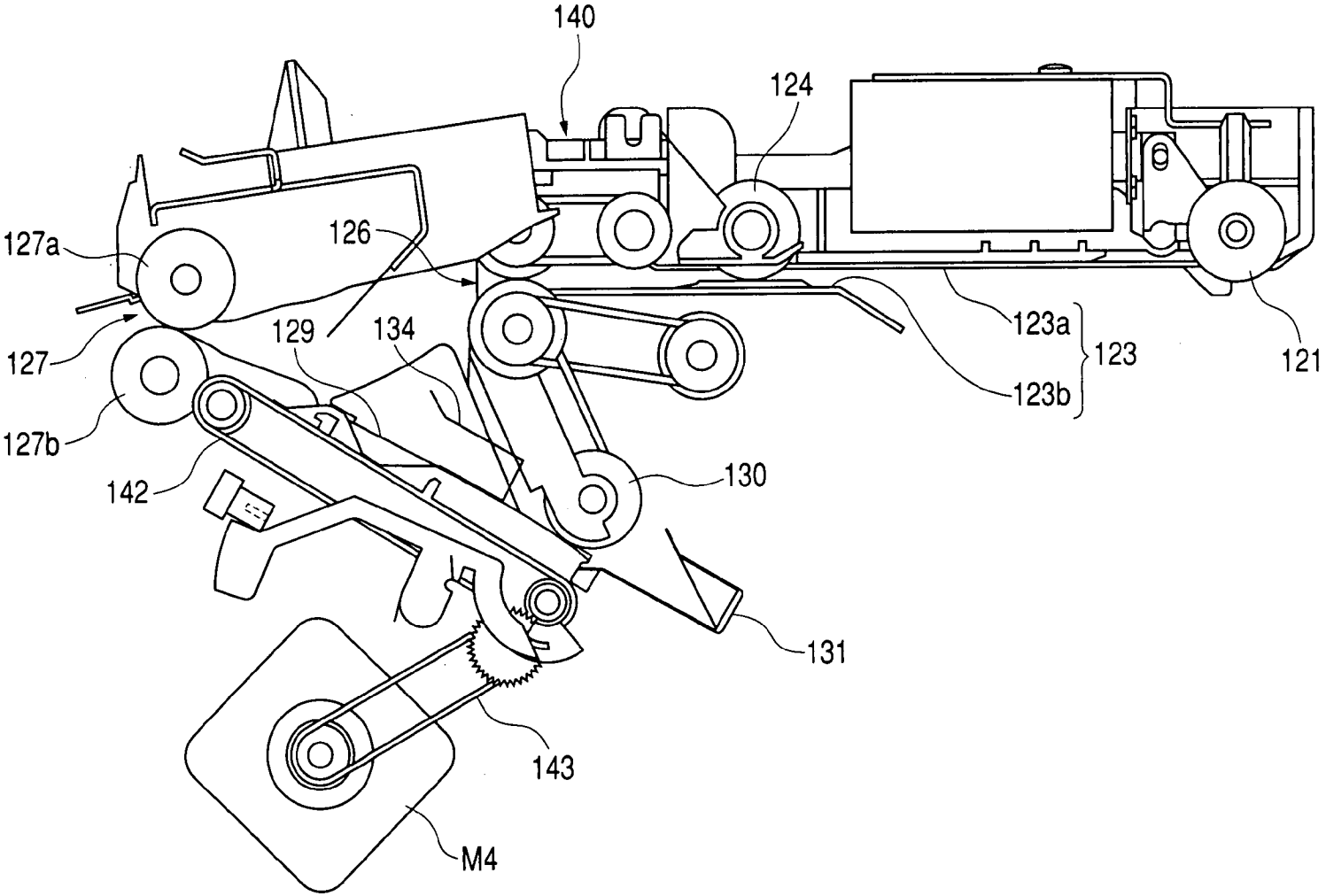
FIG. 6 is an enlarged view of the main part of the sheet treating apparatus.
Figure 18B:
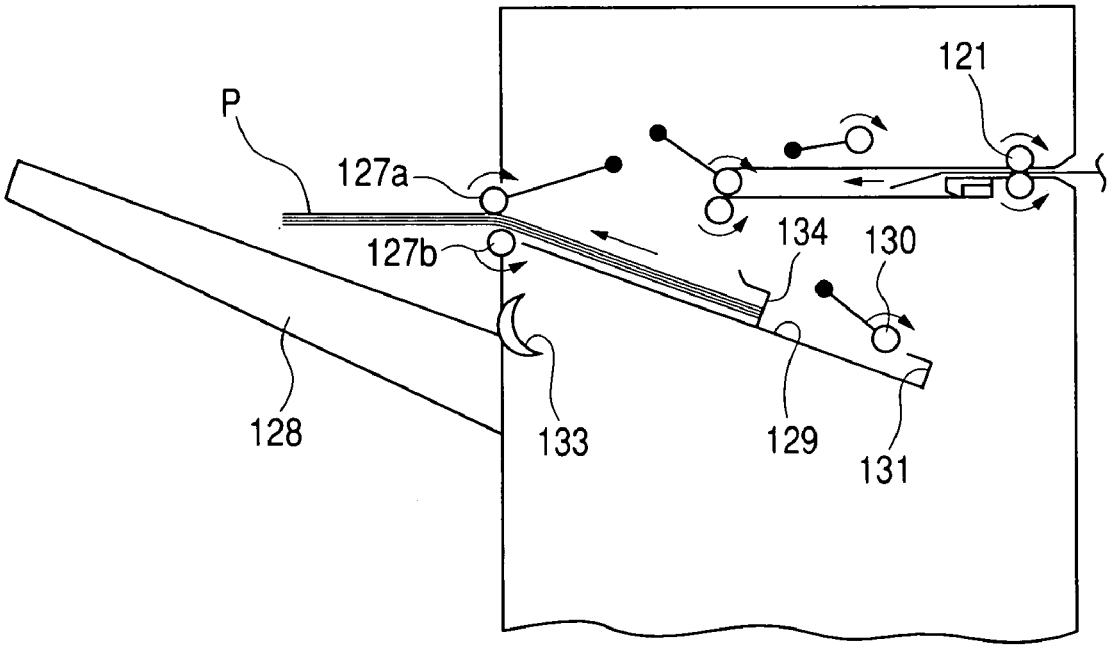

As shown in FIG. 18B, the upper roller 127*a* and the lower roller 127*b* nip a sheet bundle P while rotating in the direction of the arrow and the trailing edge assist 134 pushes the trailing edge of the sheet bundle P to discharge the sheet bundle to the stack tray 128. The trailing edge assist 134 is provided to a belt 142 rotated in a forward or reverse direction by a trailing edge assist motor M4 as shown in FIGS. 5 and 6. Note that the trailing edge assist 134 pushes both sides of the trailing edge of the sheet bundle P. The stopper 131 pushes the central portion of the trailing edge of the sheet bundle P. The trailing edge assist 134 can move forward or backward beyond the position of the stopper 131.

At this time, if as shown in FIG. 10, the rocking roller pair 127 and trailing edge assist 134 are the same in an activation time (T1 ) and an activation speed (132 mm/sec), and further their speeds reach the same acceleration end speed (500 mm/sec) at the same time (T2), the rocking roller pair 127 and the trailing edge assist 134 can discharge the sheet bundle without applying any forces of tension and compression to the sheet bundle (S106).

However, as shown in FIG. 11, the activation speed of the trailing edge assist 134 may become occasionally faster than that of the rocking roller pair 127 by means of the belts 143 and 142 transmitting a torque of the trailing edge assist motor M4 to the trailing edge assist 134 (speed is assumed to be 300 mm/sec). In such a case, the trailing edge assist 134 is stopped without starting movement until the time T3 where the sheet conveyance speed of the rocking roller pair 127 reaches 300 mm/sec. Upon matching the sheet conveyance speed of the rocking roller pair 127, the trailing edge assist 134 starts moving. More specifically, the trailing edge assist 134 starts moving after the time of (T3−T1)=ΔT from when the rocking roller pair 127 starts moving (S107). Note that if the activation speed of the rocking roller pair 127 is faster than that of the trailing edge assist 134, conversely, the activation time of the rocking roller pair 127 is given a delay of ΔT. When the activation speeds of the trailing edge assist 134 and the rocking roller pair 127 are the same, ΔT is 0.

In this way, if a time difference of ΔT is given to the start time and the rocking roller pair 127 and the trailing edge assist 134 have a difference in activation speed, the sheet bundle can be discharged without being applied with forces of tension and compression by the rocking roller pair 127 and the trailing edge assist 134.

In addition, there is no fear that the rubbing trace of the roller is left on the sheet owing to the rocking roller pair 127 to deteriorate a quality of sheet bundle or an image formed on the sheet bundle.

Figure 19:
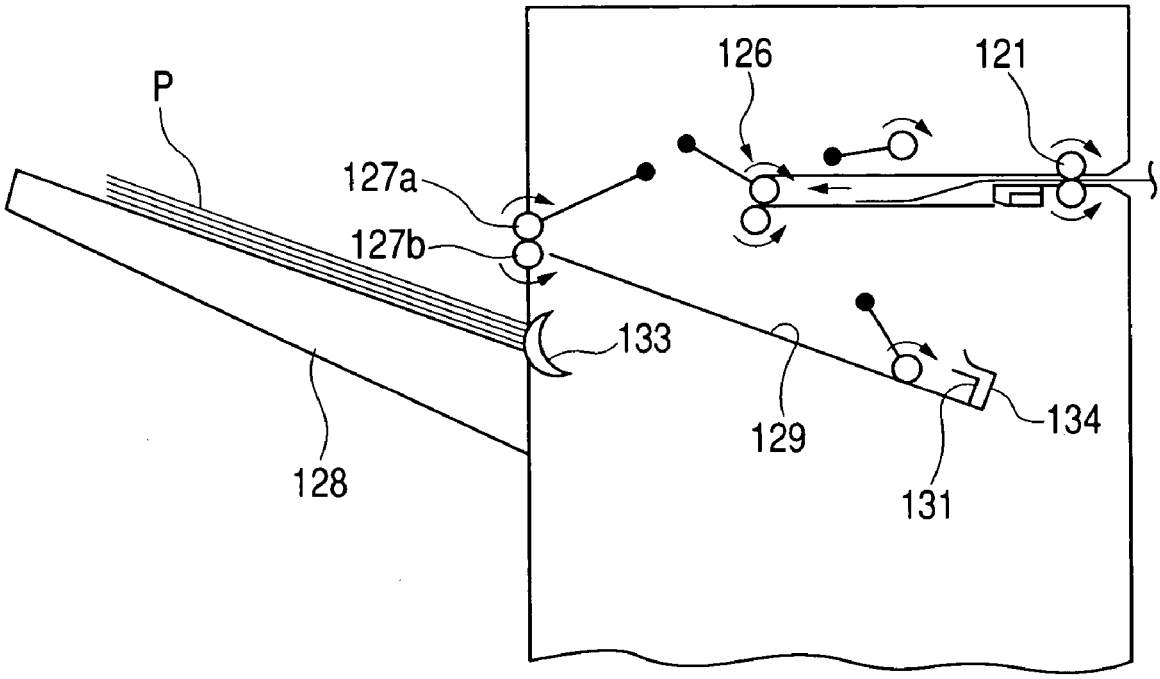
FIG. 19 shows an operation of the sheet treating apparatus.

The rocking roller pair 127, the trailing edge assist 134, and the return roller 130 start feeding the sheet bundle to the stack tray 128 side (S108). The trailing edge assist 134 returns to the original position (home position) at the point where the assist is moved by about 15 mm (S109) (S110, corresponding to an operation "HP control" of FIG. 12). The sheet bundle is discharged on the stack tray 128 by means of the rocking roller pair 127 as shown in FIG. 19. Thereafter, a series of sheet bundle discharging operations is completed at the point when the upper roller 127*a* of the rocking roller pair 127 separates from the lower roller 127*b* (S111 and S112).

In FIG. 18B, at the beginning of the discharge of the sheet bundle, the first sheet of the next sheet bundle is fed in the entrance roller pair 121.

In this embodiment, the sheet treating apparatus 119 conveys the sheet bundle while the trailing edge assist 134 pushes the trailing edge of the sheet bundle and thus can surely convey the bundle without damaging the sheet bundle surface unlike the case of discharging the sheet bundle with the roller rotating in pressure contact with the sheet bundle surface.

(Explanation of Buffer Sheet Operation)

The operation explained above is an operation in the case where a sheet conveyance interval is long and the sheet bundle can be stapled before the next sheet is fed, for instance. An operation explained below is a buffer sheet operation where the sheet conveyance interval is short and the succeeding sheets are stored (buffered) only during the staple treatment in the case where the succeeding sheet is fed during the sheet treatment.

The sheet treating apparatus 119 conducts a buffer sheet operation in response to a buffer operation instruction from the finisher controlling portion 211 when the CPU circuit portion 200 of the apparatus main body 101 judges that the sheets are fed from the apparatus main body 101 of the copying machine 100 at the conveyance interval shorter than the sheet staple treatment time. In this case, the buffer roller 124 moves downwards by the solenoid SL1 (refer to FIG. 4) to contact the lower conveyance guide plate 123*b*.

Figure 20A:
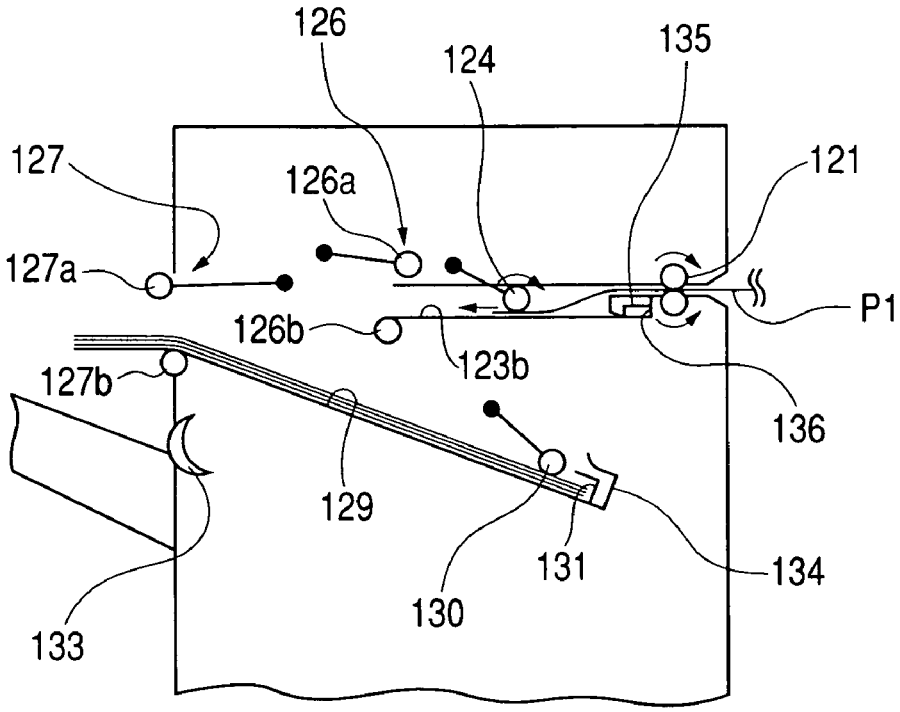
FIGS. 20A and 20B each show an operation of the sheet treating apparatus.
Figure 20B:
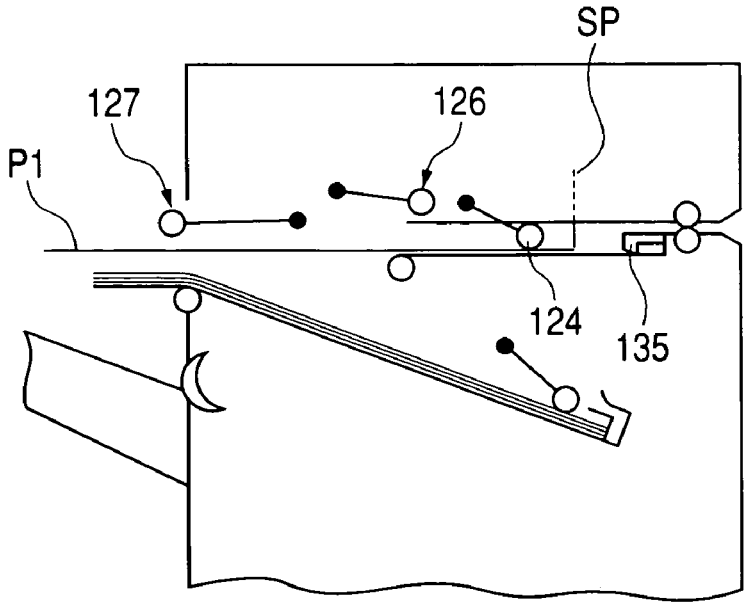

In FIGS. 20A and 20B, it is supposed that the sheet bundle is stacked on the treatment tray 129 through the aforementioned operation and the sheet bundle is stapled by the stapler unit 132 (refer to FIGS. 3 and 4).

As shown in FIG. 20A, when the first sheet P1 of the next sheet bundle is fed during the staple treatment for the sheet bundle P stacked on the treatment tray 129, the first sheet P1 is fed in the buffer roller 124 by means of the entrance roller pair 121. The buffer roller 124 is rotated by the entrance conveying motor M2 (refer to FIG. 4) to thereby convey the first sheet P1 to the downstream side. At this time, an upper first sheet discharging roller 126*a* of the first sheet discharging roller pair 126 is kept from a lower first sheet discharging roller 126*b* by the first sheet discharging roller spacing solenoid SL2 (refer to FIG. 4). Note that a first sheet discharging roller spacing solenoid SL2 overlaps with the buffer roller spacing solenoid SL1 in FIG. 4 and is not shown in FIG. 4. Also, the upper roller 127*a* of the rocking roller pair 127 is kept from the lower roller 127*b* by a plunger (not shown).

Figure 21A:
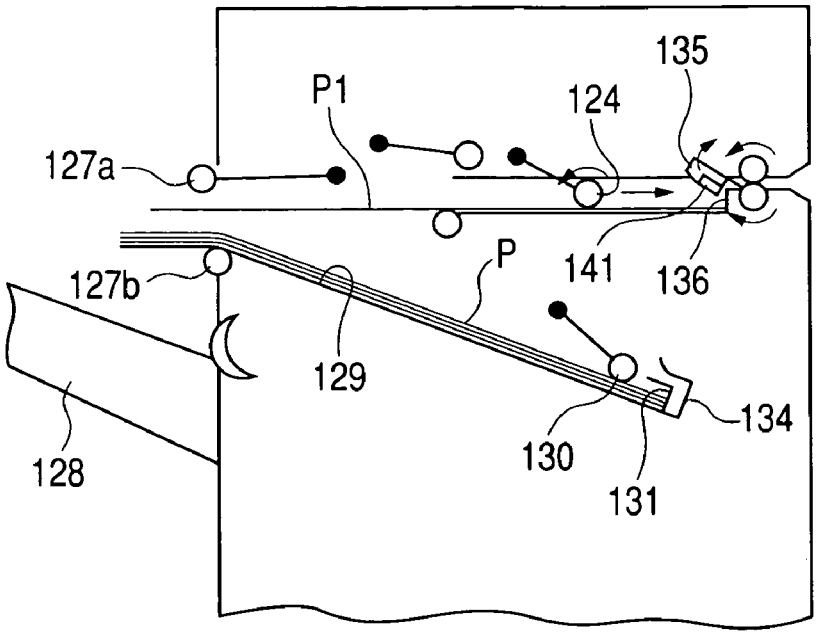
FIGS. 21A and 21B each show an operation of the sheet treating apparatus.

As shown in FIG. 20B, when the trailing edge of the first sheet P1 arrives at a switchback point SP, as shown in FIG. 21A, the sheet is pushed back to the upstream side in accordance with the reverse rotation of the buffer roller 124. At almost the same time, a trailing edge pressing 135 leaves the lower conveyance guide plate 123*b* to open a trailing edge receiving portion 136. The sheet arriving at the switchback point SP can be detected based on whether or not a predetermined period elapses from the activation of an entrance sensor S1 disposed near the downstream side of the entrance roller pair 121 of FIG. 4 due to the leading edge (downstream end) of the sheet or based on the rotational speed (rpm) of the buffer roller 124 etc.

Figure 21B:
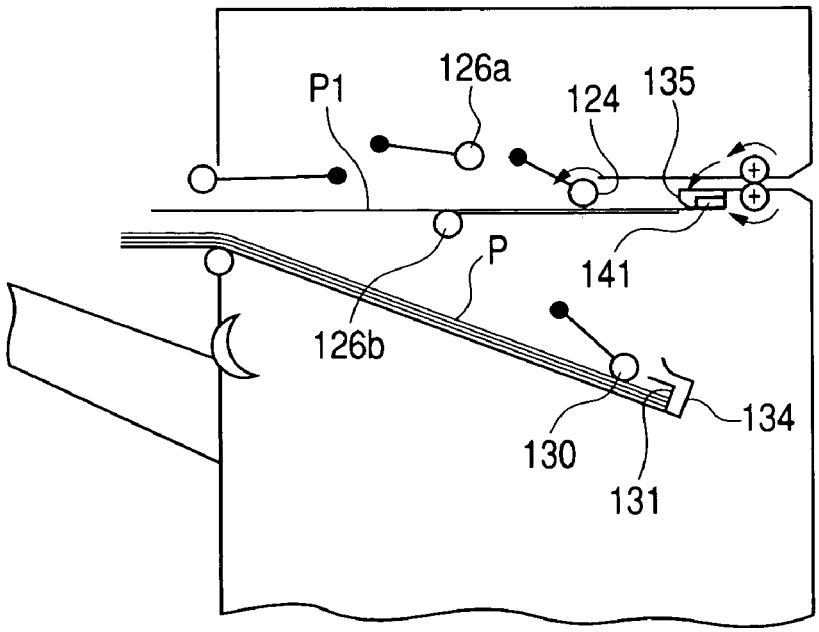

The upstream end of the first sheet P1 is received by the trailing edge receiving portion 136 after the downstream end of the sheet is detected, as shown in FIG. 21A. Thereafter, the trailing edge pressing 135 returns to the original position, as shown in FIG. 21B, to press the first sheet P1 against the lower conveyance guide plate 123*b* with a frictional member 141 provided to the trailing edge pressing 135.

Figure 22A:
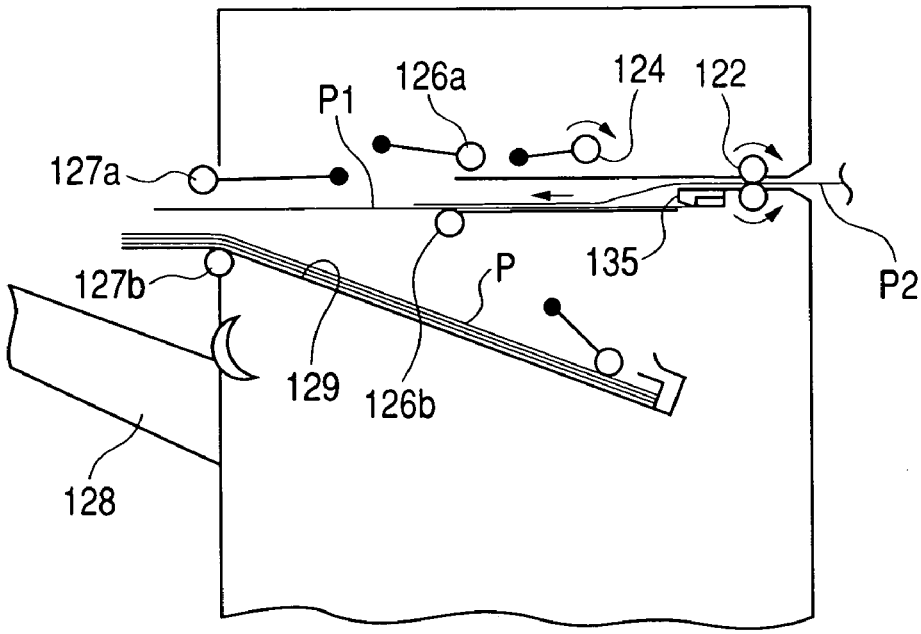
FIGS. 22A and 22B each show an operation of the sheet treating apparatus.
Figure 22B:
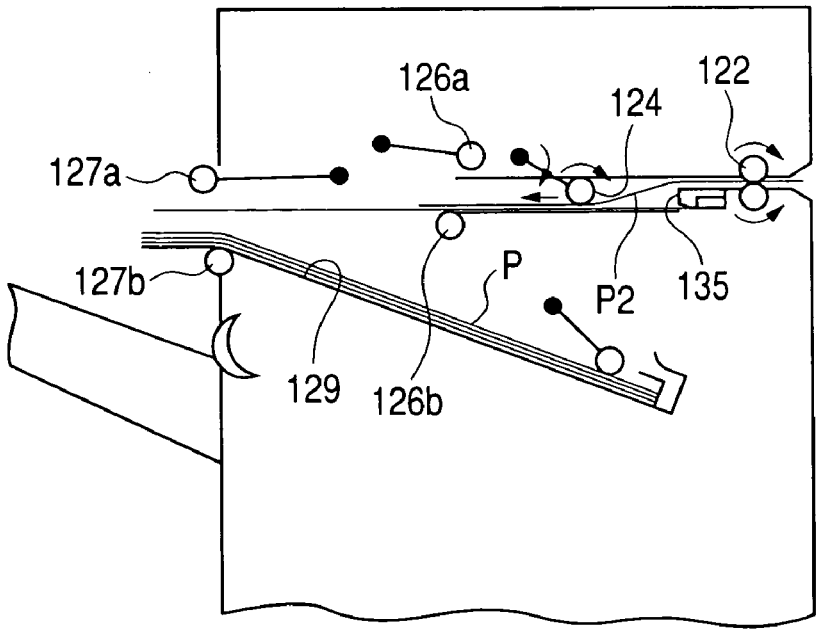

After that, as shown in FIG. 22A, a second sheet P2 is fed. The second sheet P2 is conveyed by the entrance roller pair 121. At this time, the sheet P2 passes above the trailing edge pressing 135 and then is also conveyed by the buffer roller 124 as shown in FIG. 22B.

At this point, the first sheet P1 is pressed against the lower conveyance guide plate 123*b* together with the second sheet P2 by the buffer roller 124 and may move to the downstream side following the second sheet P2 that is being conveyed. However, the first sheet P1 is pressed against the lower conveyance guide plate 123*b* by the frictional member 141 provided to the trailing edge pressing 135 and thus cannot be moved.

Figure 23A:
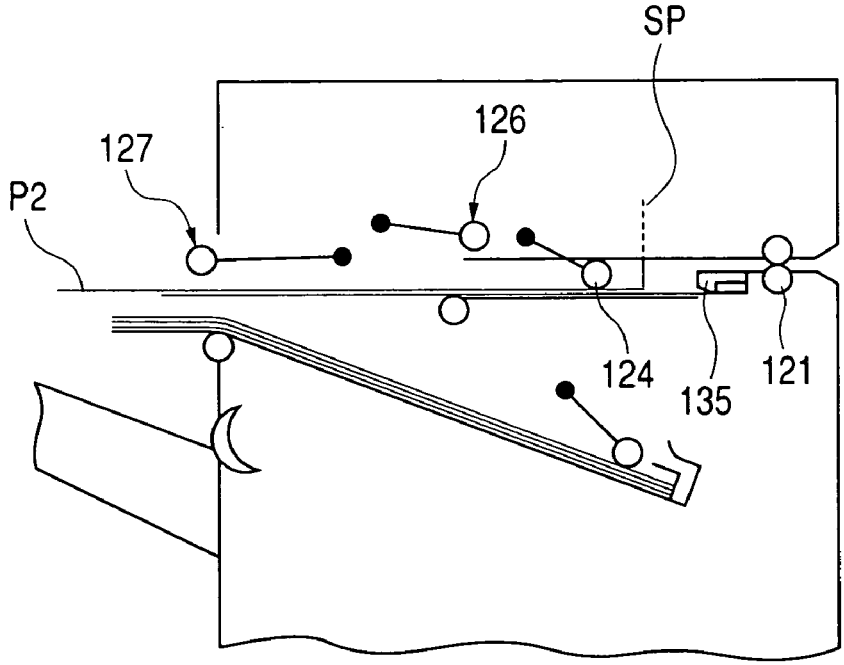
FIGS. 23A and 23B each show an operation of the sheet treating apparatus.
Figure 23B:
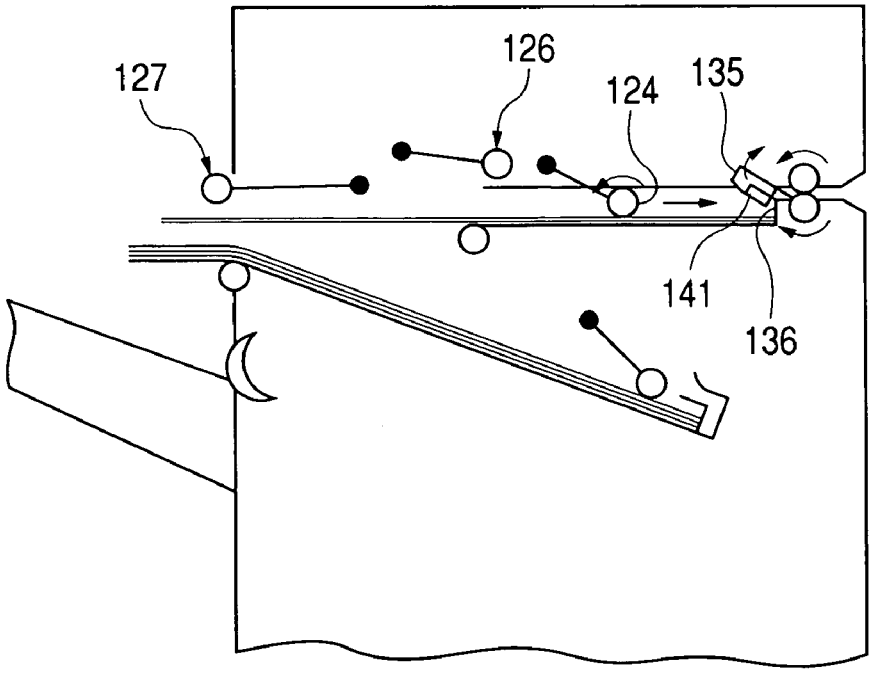
Figure 24:
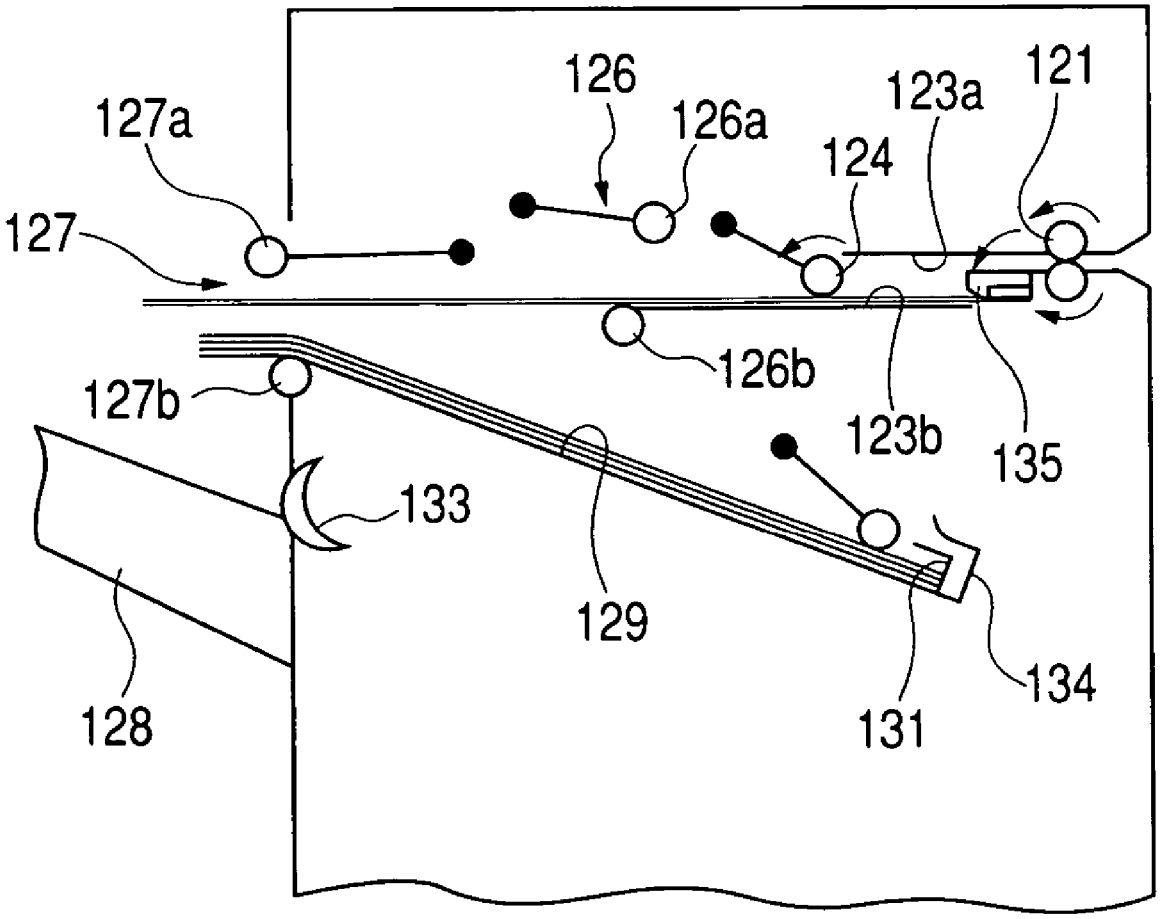
FIG. 24 shows an operation of the sheet treating apparatus.

The second sheet P2 is pushed back to the upstream side as shown in FIGS. 23A to 24 when its trailing edge arrives at the switchback point SP like the first sheet P1. The second sheet P2 overlaps with the first sheet P1 by means of the frictional member 141 of the trailing edge pressing 135 and is pressed against the lower conveyance guide plate 123*b*.

Figure 25A:
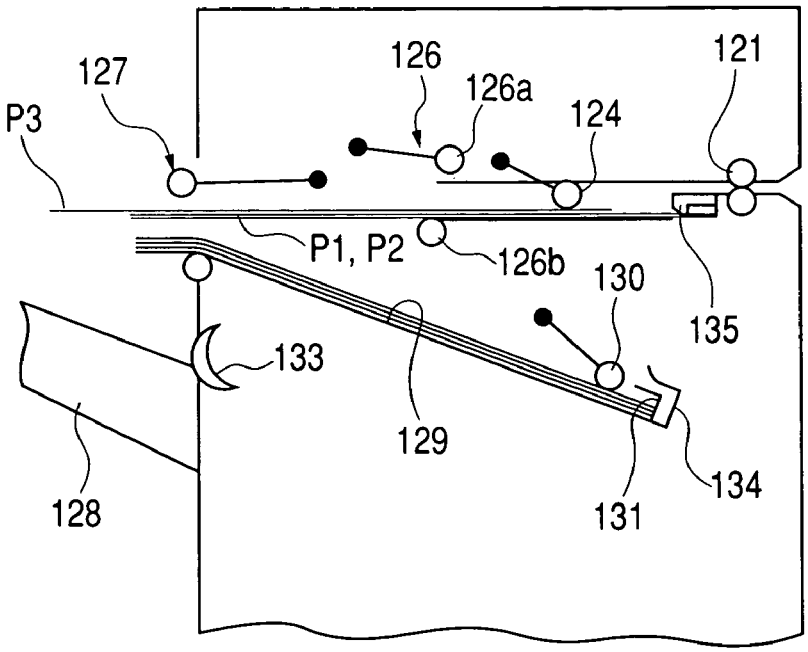
FIGS. 25A and 25B each show an operation of the sheet treating apparatus.
Figure 25B:
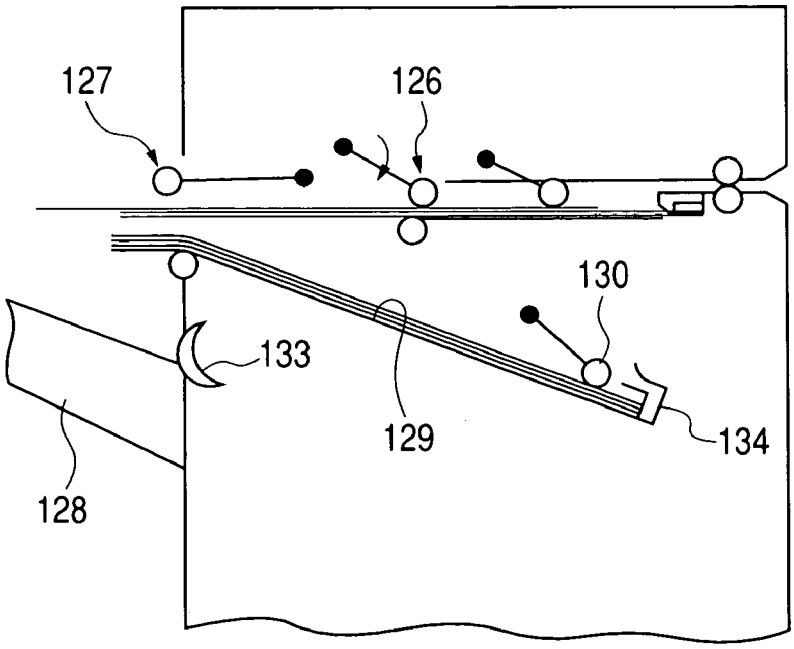
Figure 26A:
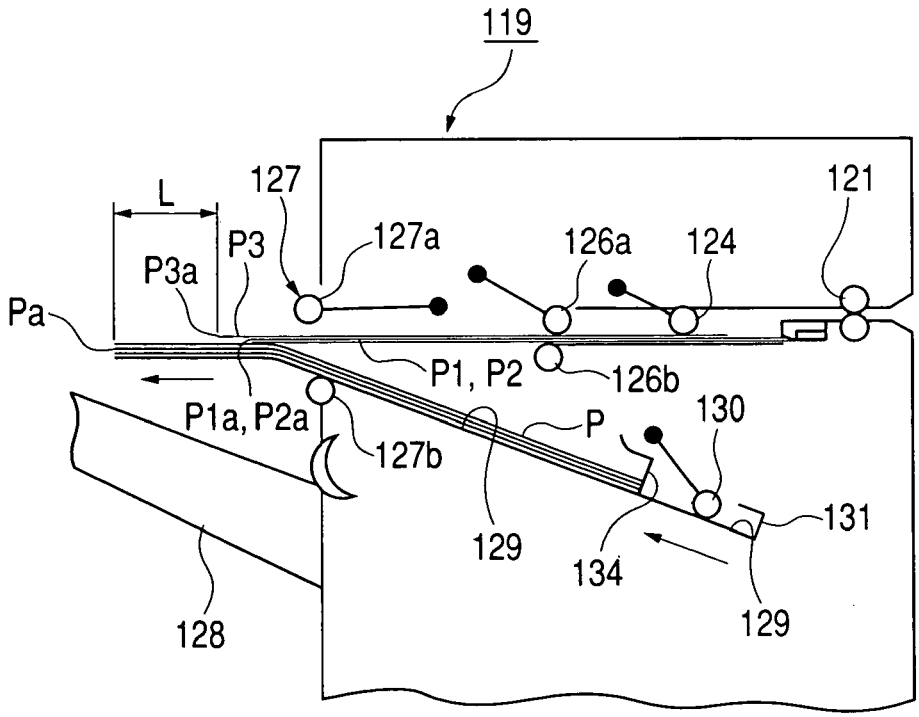
FIGS. 26A and 26B each show an operation of the sheet treating apparatus.

After that, as shown in FIG. 25A, a third sheet P3 is fed. When the trailing edge of the third sheet P3 passes through the entrance roller pair 121, as shown in FIG. 25B, the upper first sheet discharging roller 126*a* and the lower first sheet discharging roller 126*b* nip the first to third sheets. At this time, the third sheet P3 slightly protrudes to the downstream side from the first sheet P1 and the second sheet P2. Also, up until this point in time, the staple treatment for the sheet bundle on the treatment tray 129 is completed, so that as shown in FIG. 26A, the trailing edge assist 134 moves along the treatment tray 129 to push up the trailing edge of the sheet bundle. As a result, a downstream end Pa of the sheet bundle P protrudes to the downstream side by a length L from downstream ends P1*a* and P2*b* of the first sheet P1 and the second sheet P2, respectively.

Figure 26B:
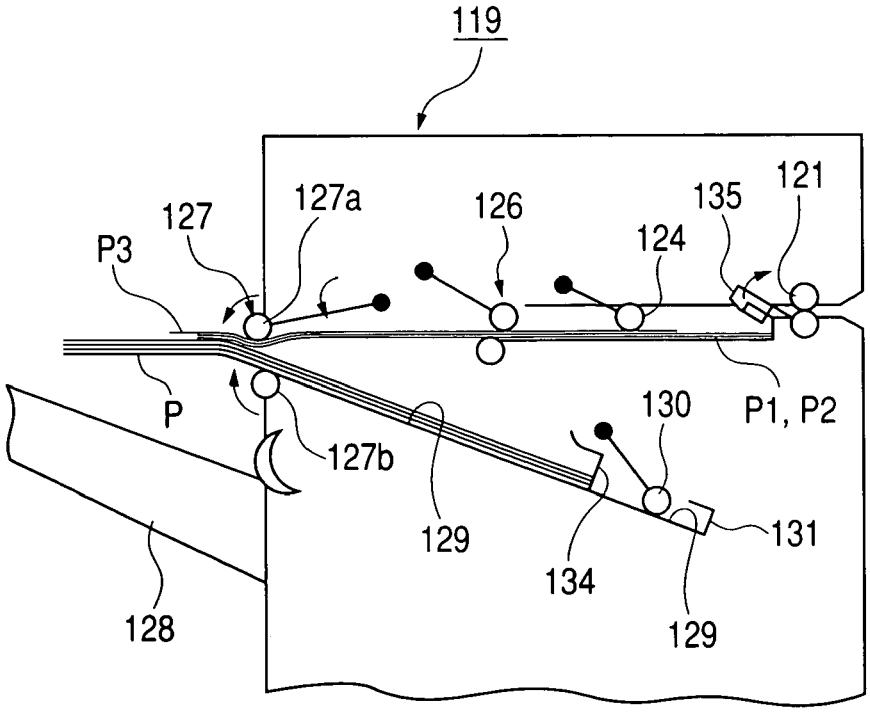

As shown in FIG. 26B, the upper roller 127*a* moves downward and nips the three sheets (P1, P2, and P3) and the sheet bundle P with the lower roller 127*b*. Along with the movement, the trailing edge pressing 135 leaves the second sheet P2 to release the first sheet P1 and the second sheet P2.

Figure 27A:
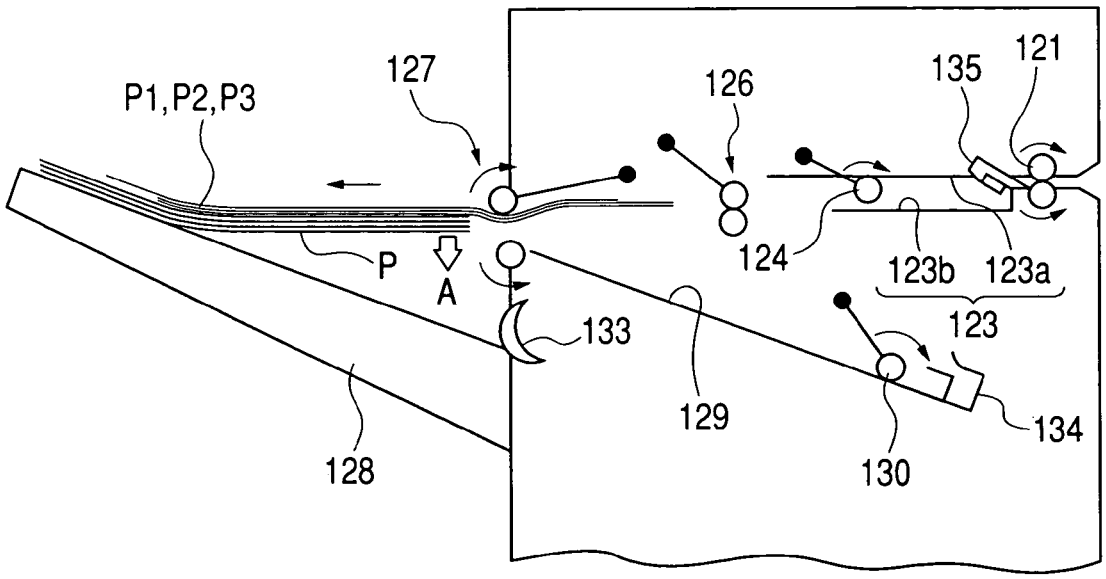
FIGS. 27A and 27B each show an operation of the sheet treating apparatus.
Figure 27B:
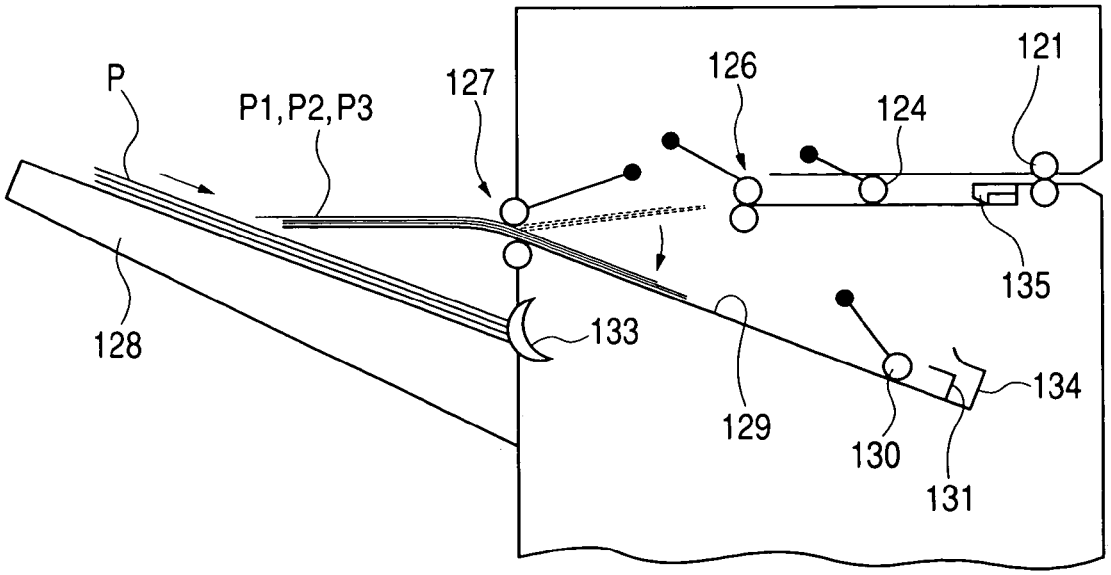

Following this, the three sheets (P1, P2, and P3) and the sheet bundle P are conveyed while being nipped by the rocking roller pair 127. As shown in FIGS. 27A and 27B, the sheet bundle P is discharged onto the stack tray 128. Then, the trailing edges of the first sheet P1 and the second sheet P2 leave the first sheet discharging roller pair 126 and the treatment tray 129 receives the upstream portions of the three sheets.

In FIG. 27B, when as shown in FIG. 12, the first sheet discharging roller pair 126, the rocking roller pair 127, and the trailing edge assist 134 are the same in activation time (T1) and activation speed (132 mm/sec), and their speeds reach the same acceleration end speed (500 mm/sec) at the same time (T2), the first sheet discharging roller pair 126, the rocking roller pair 127, and the trailing edge assist 134 can discharge the sheet bundle without applying any forces of tension and compression to the sheet bundle or the three sheets.

However, in the case where the activation speed is different between them, as in S107 of FIG. 9, a time difference of $\Delta T$ is set to activate them, making it possible to discharge the sheet bundle without applying any forces of tension and compression to the sheet bundle or the three sheets. Also, there is no fear that the rubbing trace of the roller is left on the sheet owing to the first sheet discharging roller pair 126 and the rocking roller pair 127 to deteriorate a quality of sheet bundle or an image formed on the sheet bundle.

Figure 28A:
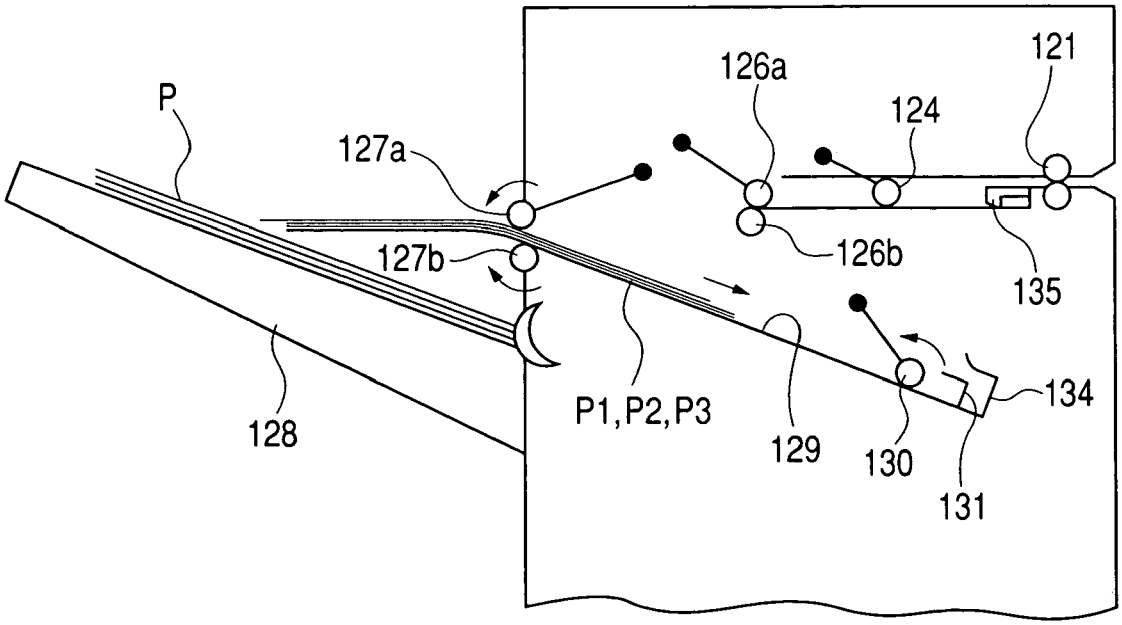
FIGS. 28A and 28B each show an operation of the sheet treating apparatus.
Figure 28B:
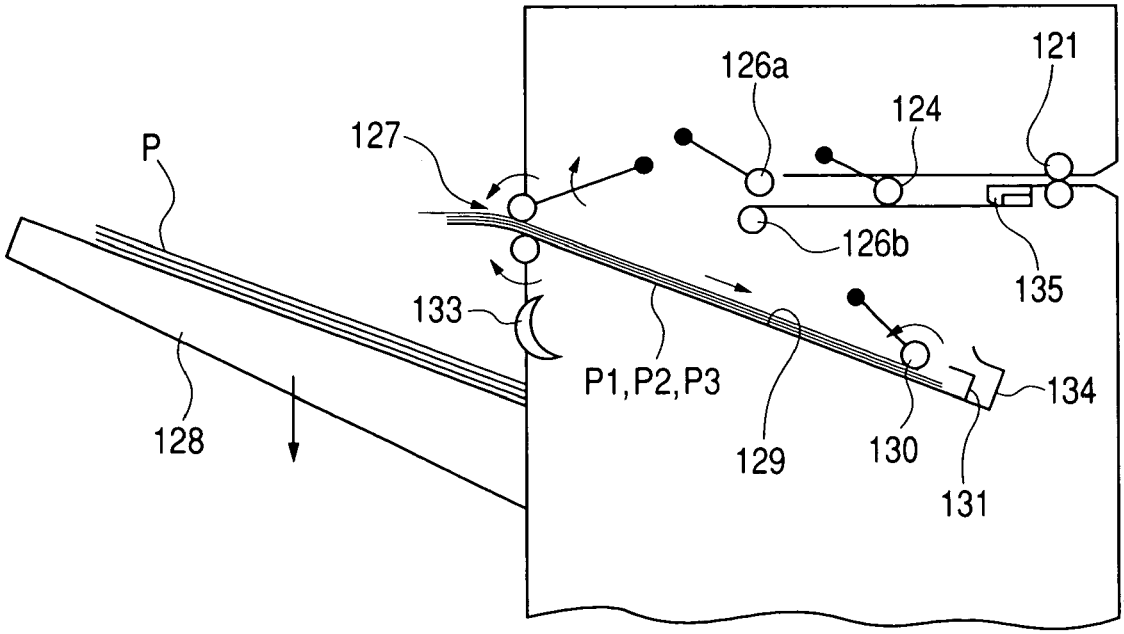

The three sheets are slidably conveyed on the treatment tray 129 by the rocking roller pair 127 and the return roller 130 as shown in FIGS. 28A and 28B and received by the stopper 131. During this operation, the stack tray 128 temporarily moves downwards to set the upper surface of the sheet bundle at the lower level than the sheet surface detecting lever 133 and moves upwards again. At this time when the sheet surface detecting lever 133 is activated according to the movement of the upper surface of the sheet bundle, the tray stops upward movement. As a result, it is possible to keep the upper surface of the sheet bundle on the stack tray 128 at a predetermined height. After that, the sheets are not stored on the lower conveyance guide plate 123*b* but are stacked in succession on the treatment tray 129. When a predetermined number of sheets are stacked, the sheets are stapled. During the stapling operation, the first three sheets of the succeeding sheet bundle are stored on the lower conveyance guide plate 123*b*.

Note that in the above description, the three sheets are stored on the lower conveyance guide plate 123*b*. However, the number of sheets to be stored (buffer sheets) varies depending on the sheet length, the stapling period, the sheet conveyance speed, etc. Therefore, the number of sheets is not limited to 3.

As described above, the sheet treating apparatus 119 in this embodiment allows the downstream end Pa of the sheet bundle P to protrude to the downstream side from the downstream ends P1*a* and P2*b* of the first sheet P1 and the second sheet P2, respectively by the length L in FIG. 26A. Reasons for this are cited below.

Figure 29:
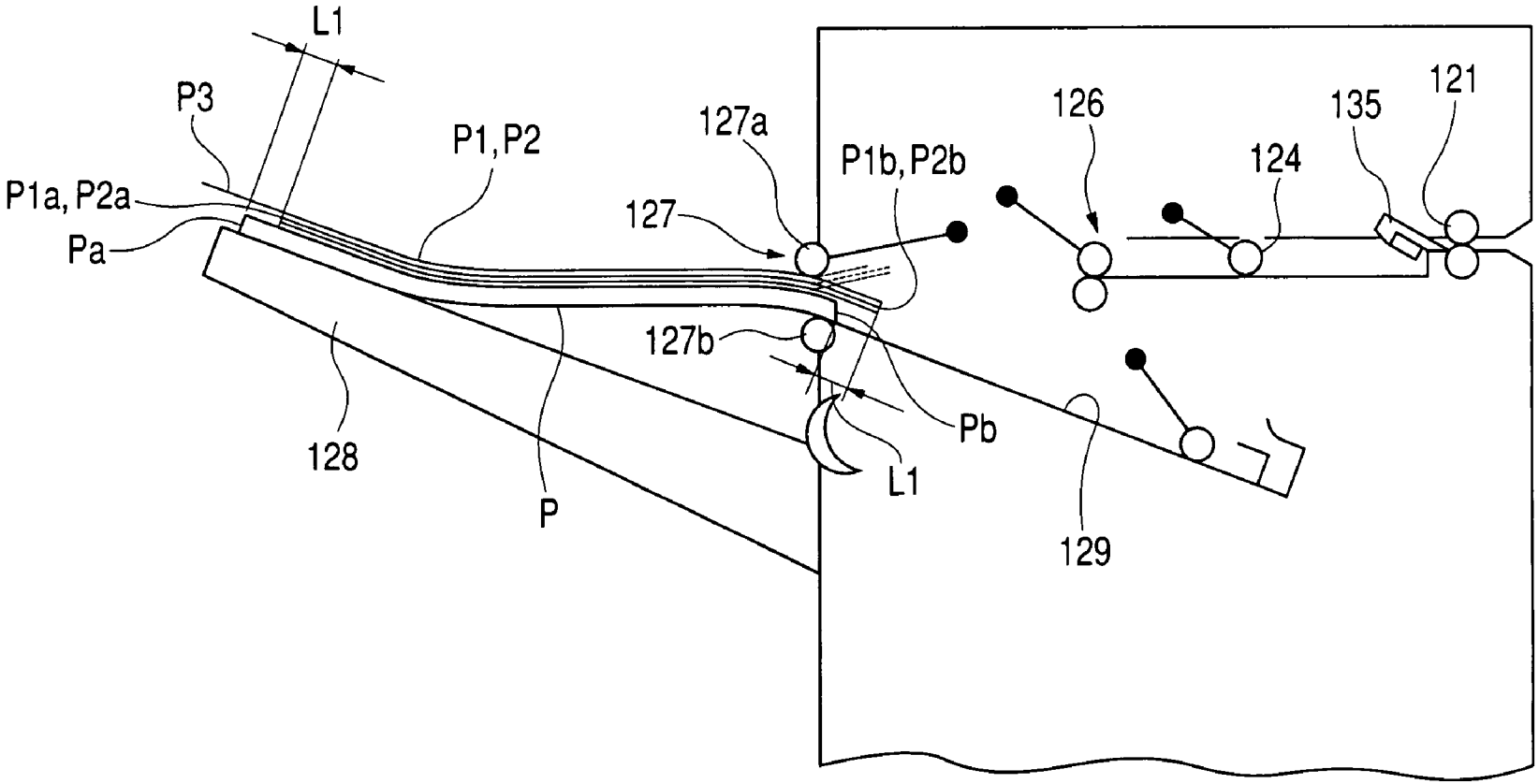
FIG. 29 is an explanatory view of an operation in the case where a length of a sheet bundle downstream end protruding from a buffer sheet downstream end is short.

Assuming that as shown in FIG. 29, the protruded downstream end length is L1 that is shorter than the length L, the protruded upstream end length is equal to L1. Therefore, after the sheet bundle P is discharged onto the stack tray 128, the length of a portion of the three buffer sheets which the rocking roller pair 127 holds is short. As a result, the rocking roller pair 127 may fail to hold the three buffer sheets and to surely feed the sheets to the treatment tray 129. Therefore, the protruded sheet bundle length is set to the length L with respect to the buffer roller 124 such that the rocking roller pair 127 can hold and feed the buffer sheets to the treatment tray 129 without fail.

Also, with the short protruded sheet length, a contact area between the buffer sheets and the sheet bundle is large, causing the sheet bundle to be in close contact with the buffer sheet. As a result, it is more likely that the sheet bundle takes much time to fall down to the stack tray 128. In such a case, when the rocking roller pair 127 rotates in a reverse direction to feed the buffer sheets to the treatment tray 129, there is a fear that the sheet bundle enters the rocking roller pair 127 in close contact with the buffer sheets to damage the sheet bundle or cause jammed sheets. Therefore, for facilitating the separation between the sheet bundle and the buffer sheets, the sheet bundle protrudes by the length L with respect to the buffer roller 124.

Besides, in the sheet treating apparatus 119 in this embodiment, the trailing edge assist 134 pushes the trailing edge of the sheet bundle. In this way, conveying the sheet bundle whose trailing edge is pushed by the trailing edge assist 134 makes it possible to surely convey the sheet bundle without damaging the sheet bundle surface unlike the case of discharging the sheet bundle with the roller rotating in pressure contact with the sheet bundle surface.

Figure 30:
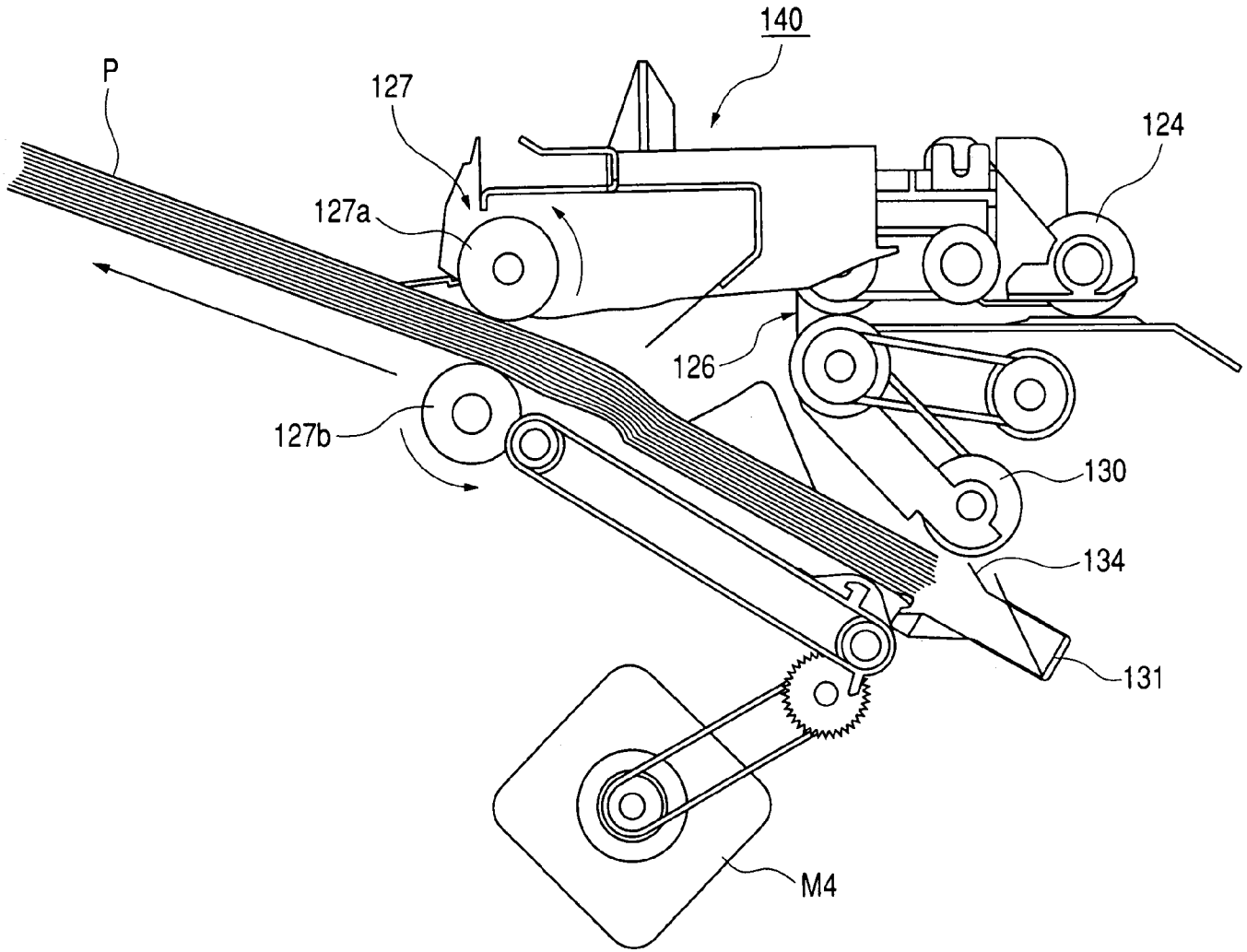
FIG. 30 is an explanatory view of a problem caused when a sheet bundle is discharged by a rocking roller (pair) alone.

That is, as shown in FIG. 30, when the rocking roller pair 127 discharges the sheet bundle alone, the sheet conveyance amount may vary according to a difference in how far the roller rubs against the sheet or in rotational speed between the upper roller 127*a* and lower roller 127*b*, with the result that the upper sheet and the lower sheet are not aligned. In such a case, the slip rotation of the rocking roller pair 127 relative to the sheet may damage the sheet. Also, the whole sheet bundle may be discharged in a twisted state, making it impossible to smoothly discharge the sheet bundle to require much treatment time. Also, there is a fear that when the whole sheet bundle is twisted, the sheet is torn at the stapled portion and cannot be used anymore.

Also, this phenomenon is more likely to occur when the nip force of the rocking roller pair 127 is increased with respect to the sheet bundle for discharging the sheet bundle without fail. In contrast, when the nip force is weakened, the sheet bundle cannot be conveyed without fail. Therefore, it is difficult to appropriately set the nip force of the rocking roller pair 127.

To that end, according to the sheet treating apparatus in this embodiment, the sheet bundle is discharged not only by the rocking roller pair 127 but also by the trailing edge assist 134, so that the sheet bundle can be discharged smoothly and quickly without causing the aforementioned slip rotation relative to the sheet, twisting the sheet bundle, and damaging the sheet or sheet bundle. Also, the sheet bundle can be discharged without precisely controlling the nip force of the rocking roller pair 127.

Figure 31:
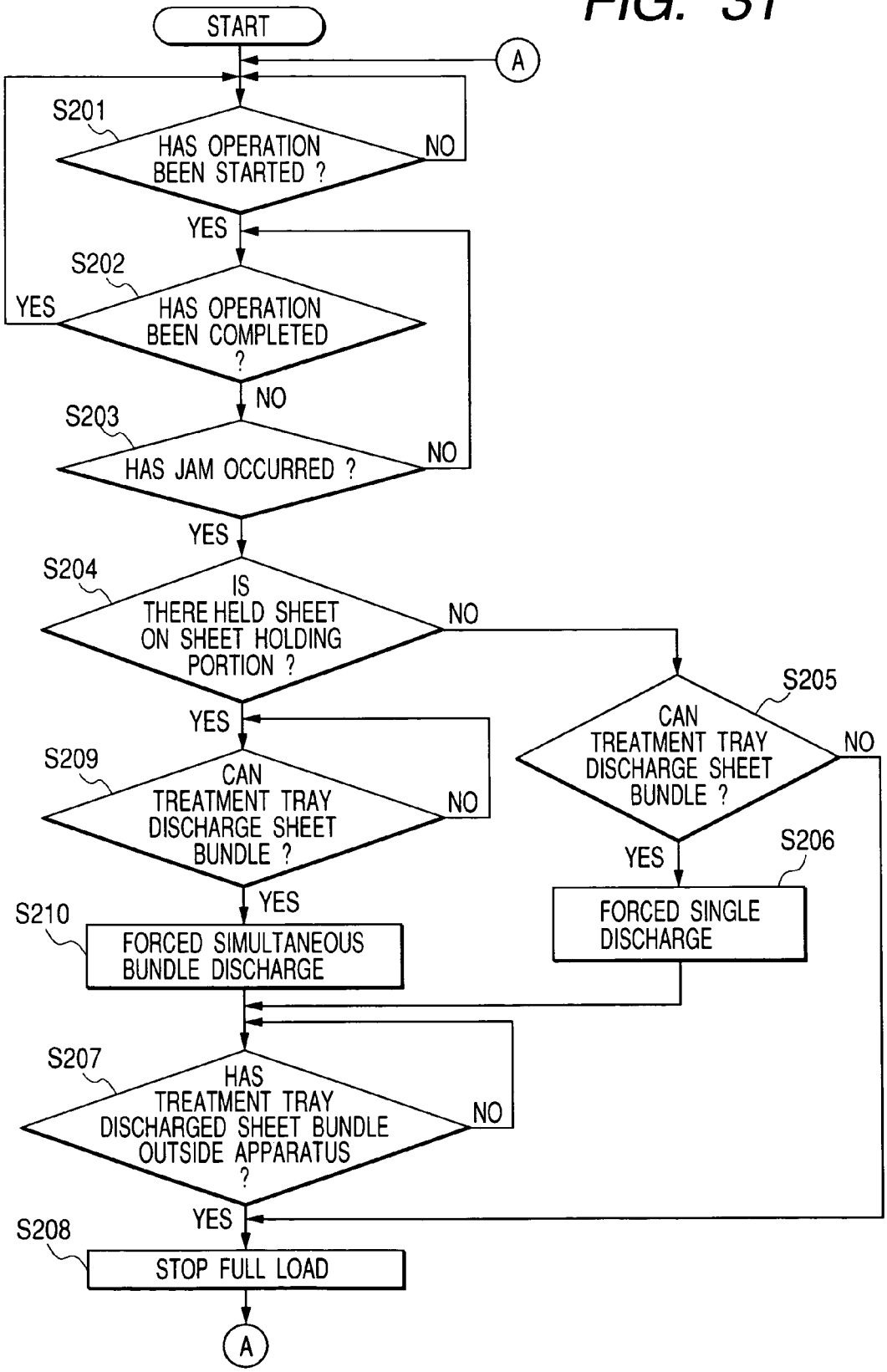
FIG. 31 is a flowchart of a processing flow in the case where a sheet is jammed upstream of the sheet treating apparatus.
Figure 32:
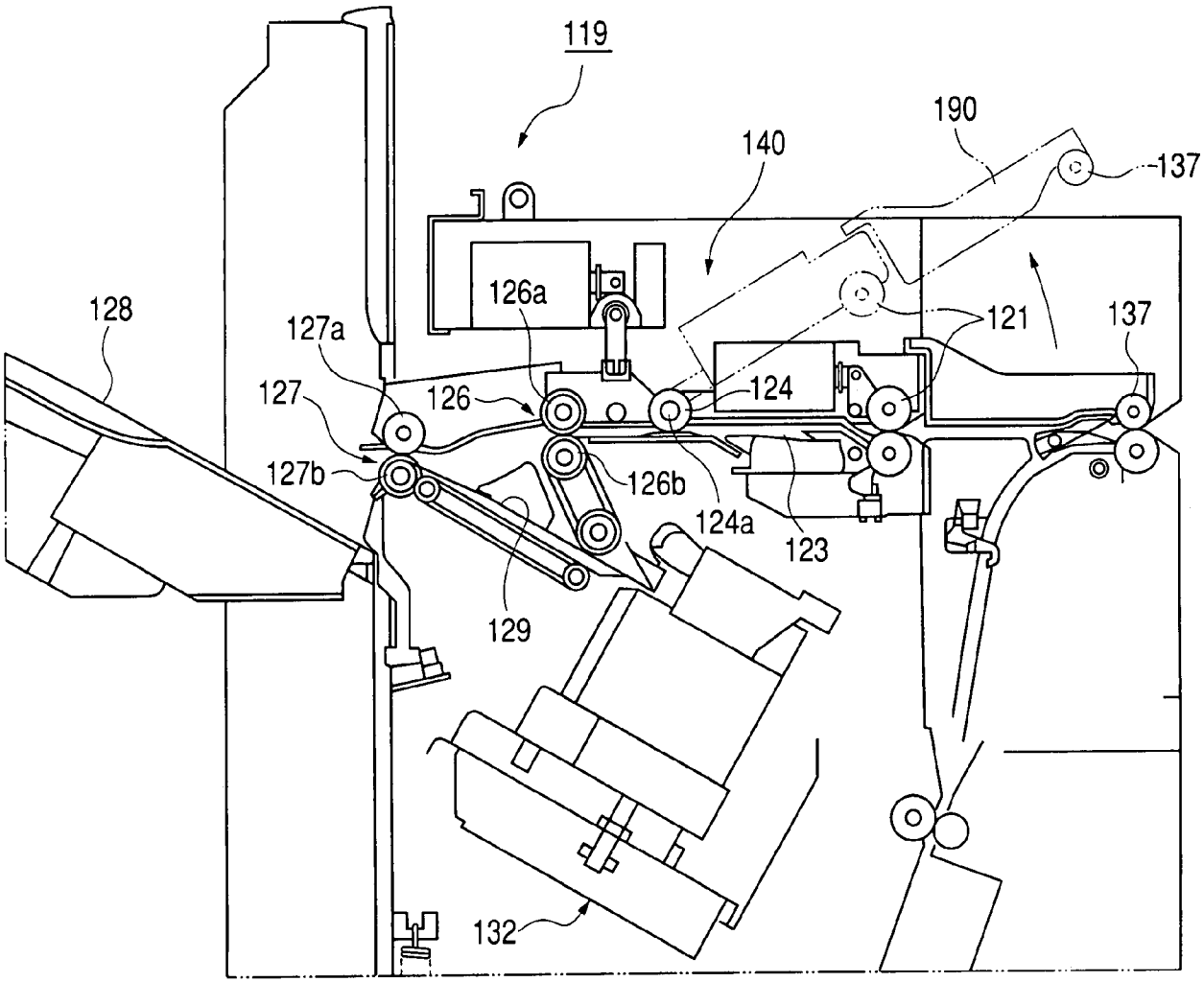
FIG. 32 shows how a receiving roller pair and an entrance roller pair are spaced from each other.

FIG. 31 is a flowchart illustrative of an operation when a sheet is jammed upstream of the sheet treating apparatus. FIG. 32 shows how the receiving roller pair 137 and the entrance roller pair 121 are spaced from each other.

Next, the sheet buffer operation of the sheets (two buffer sheets in the example) fed in the sheet treating apparatus 119 will be described with reference to flowcharts of FIGS. 33 to 40.

Figure 33:
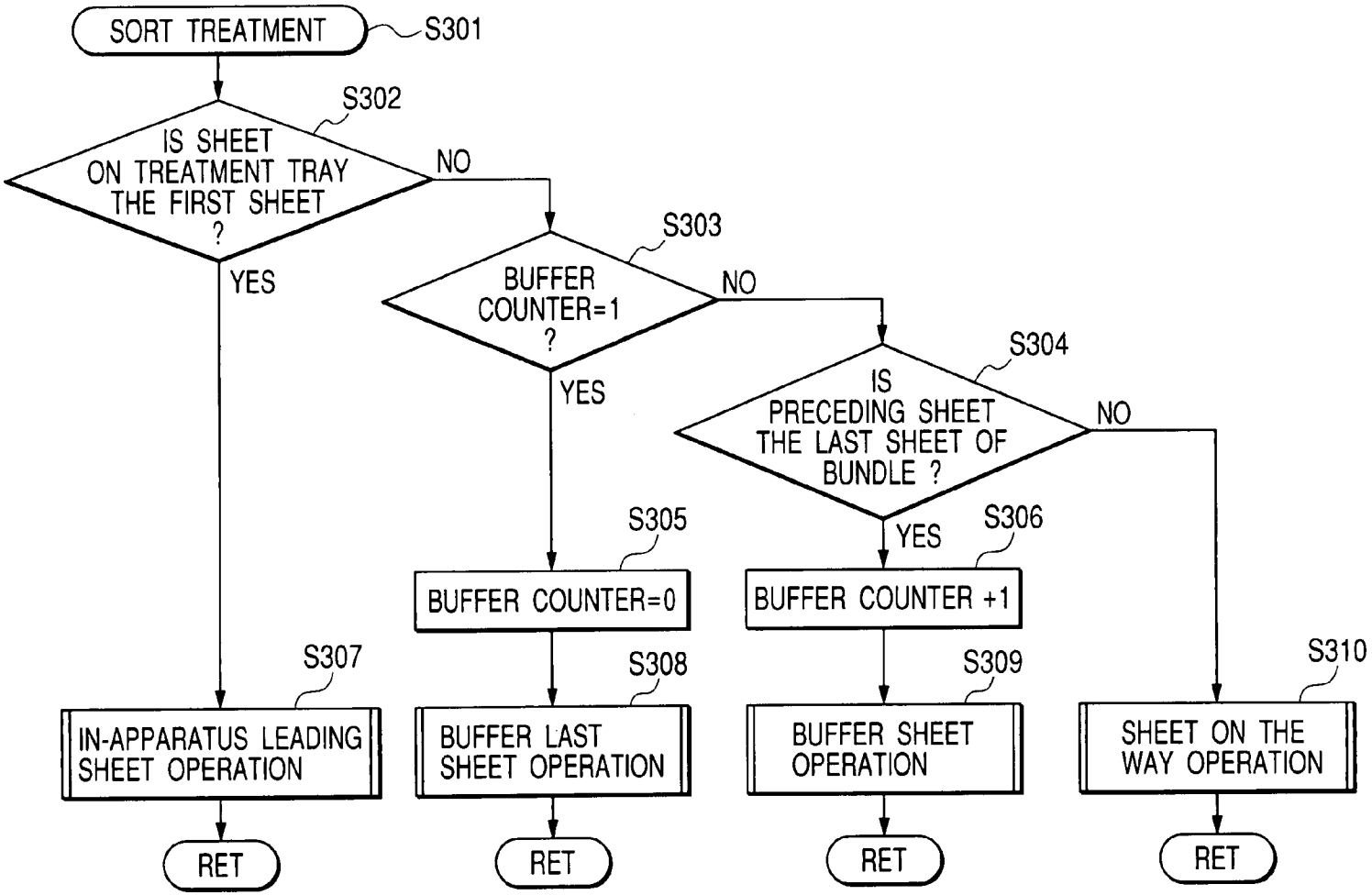
FIG. 33 is a flowchart of a sort treatment flow.

FIG. 33 is a flowchart for schematically illustrating an overall operation of the sheet treating apparatus 119 and a flowchart of sort treatment flow. The operations of each portion shown in those flowcharts are performed under control of the finisher controlling portion 211 of FIG. 8.

The sheet treating apparatus 119 carries out any of an in-apparatus leading sheet operation (S307), a buffer last sheet operation (S308), a buffer sheet operation (S309), and a sheet on the way operation (S310) based on whether or not the sheet stacked on the treatment tray 129 is the first sheet (S302), whether or not the buffer counter value is 1 (S303), and whether or not the preceding sheet is the last sheet of the sheet bundle (S304), in the sort treatment (S301).

Figure 34A:
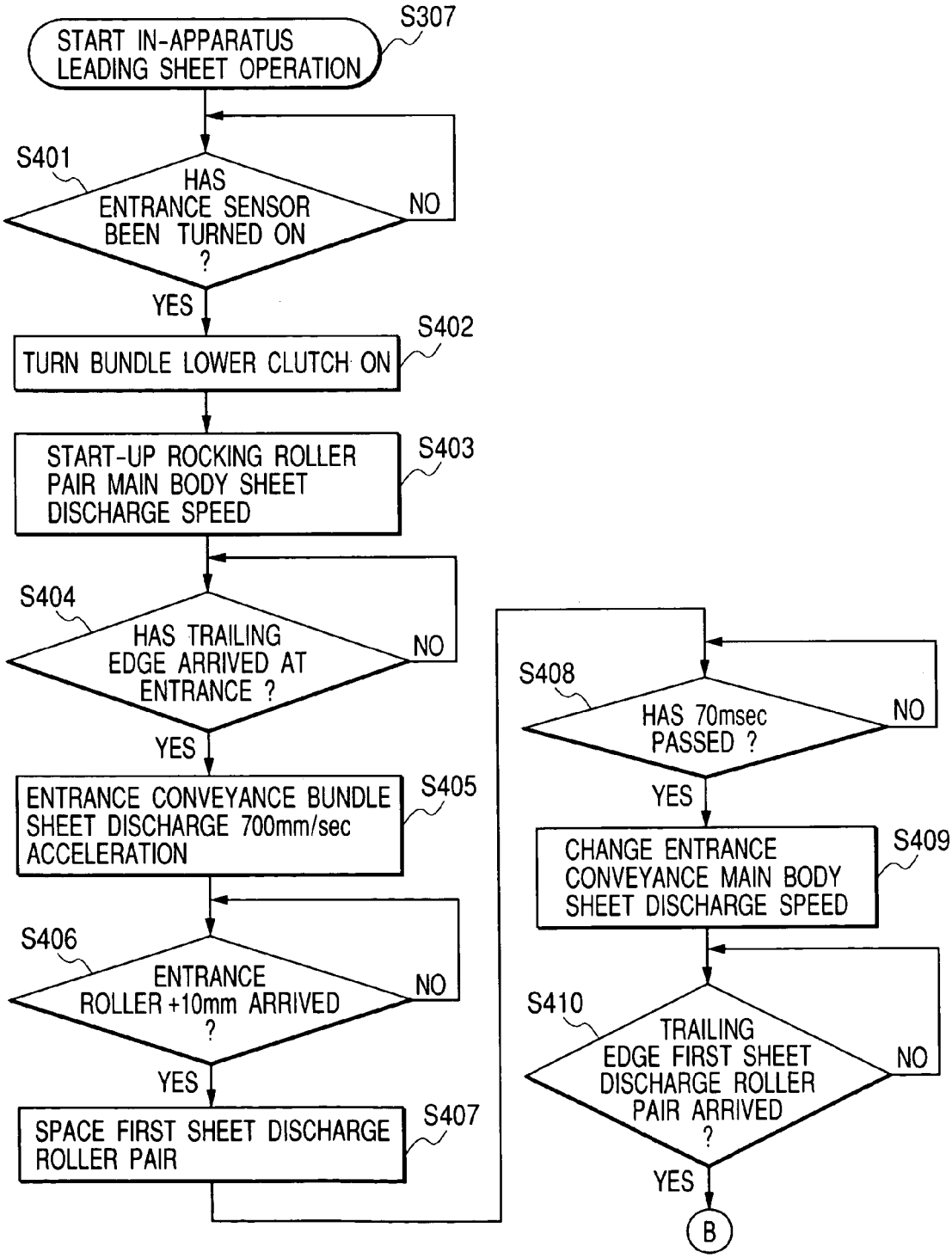
FIGS. 34A and 34B are flowcharts of a processing flow of an in-apparatus leading sheet operation.
Figure 34B:
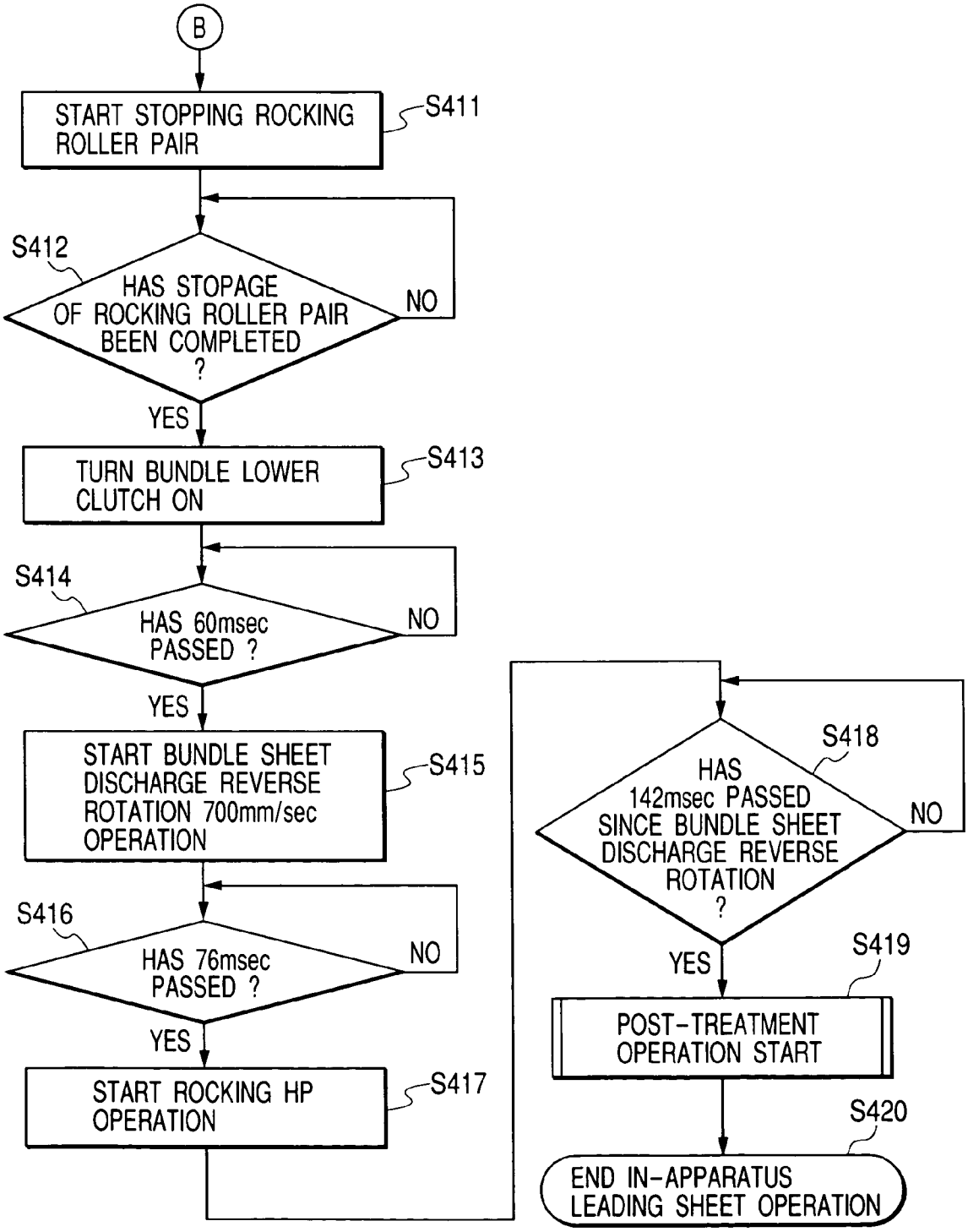

The in-apparatus leading sheet operation (S307) of FIG. 33 is an operation from stacking of the leading sheet on the treatment tray 129 to start of the sheet treatment as shown in S401 to S420 of FIGS. 34A and 34B.

Figure 35A:
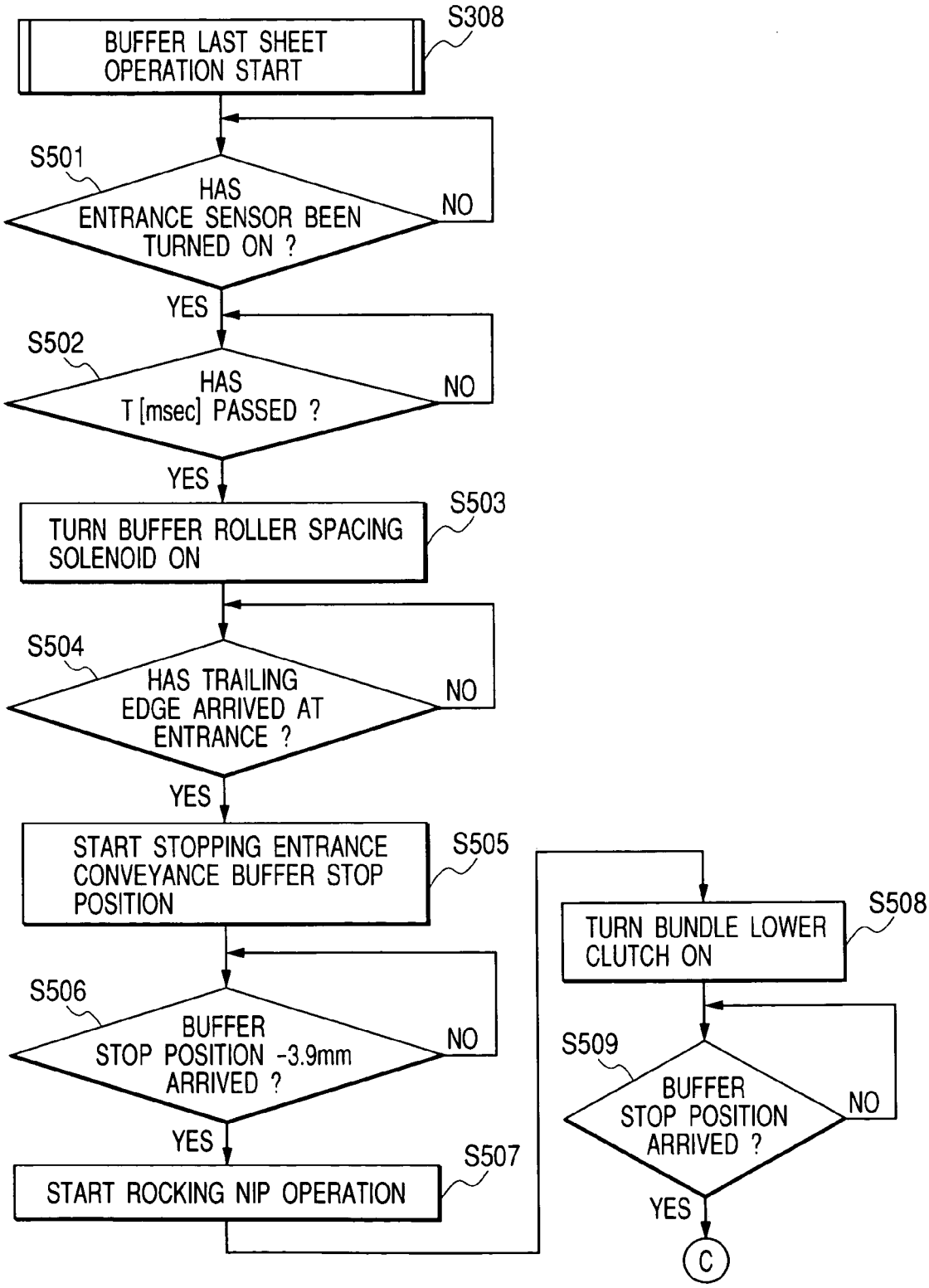
FIGS. 35A and 35B are flowcharts of a processing flow of a buffer last sheet operation.
Figure 35B:
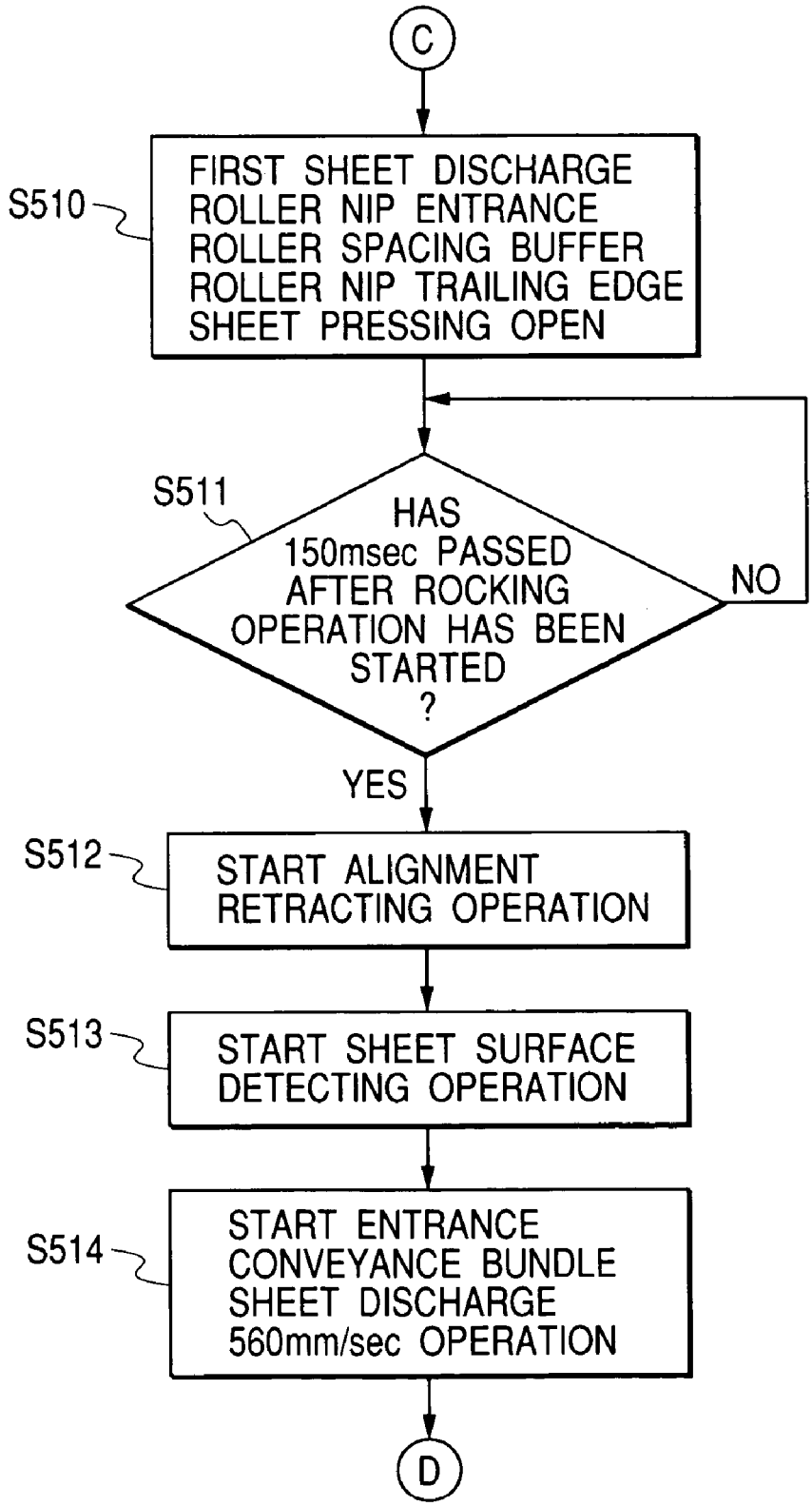
Figure 36A:
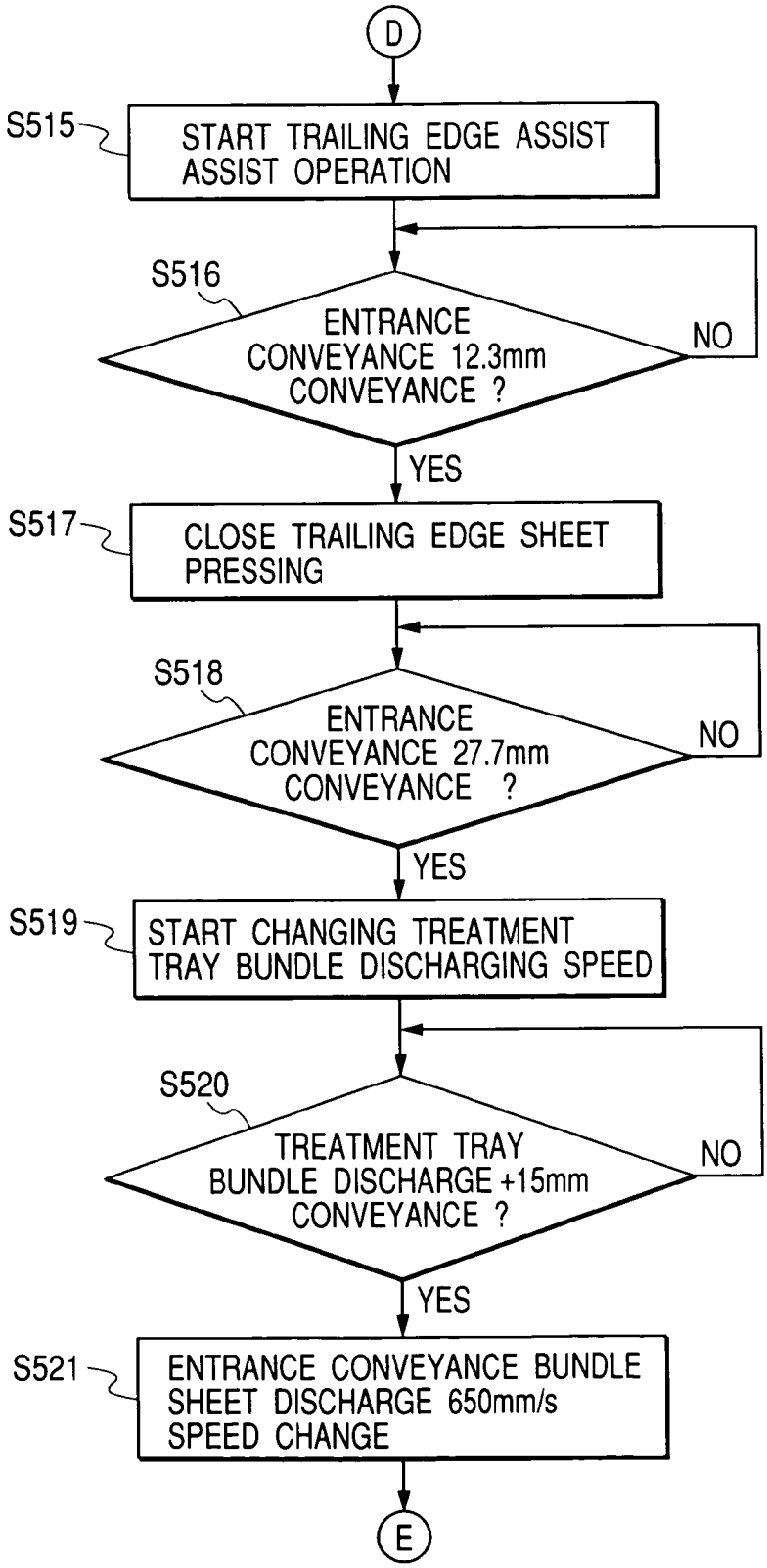
FIGS. 36A, 36B and 36C are flowcharts of a processing flow continued from FIGS. 35A and 35B.
Figure 36B:
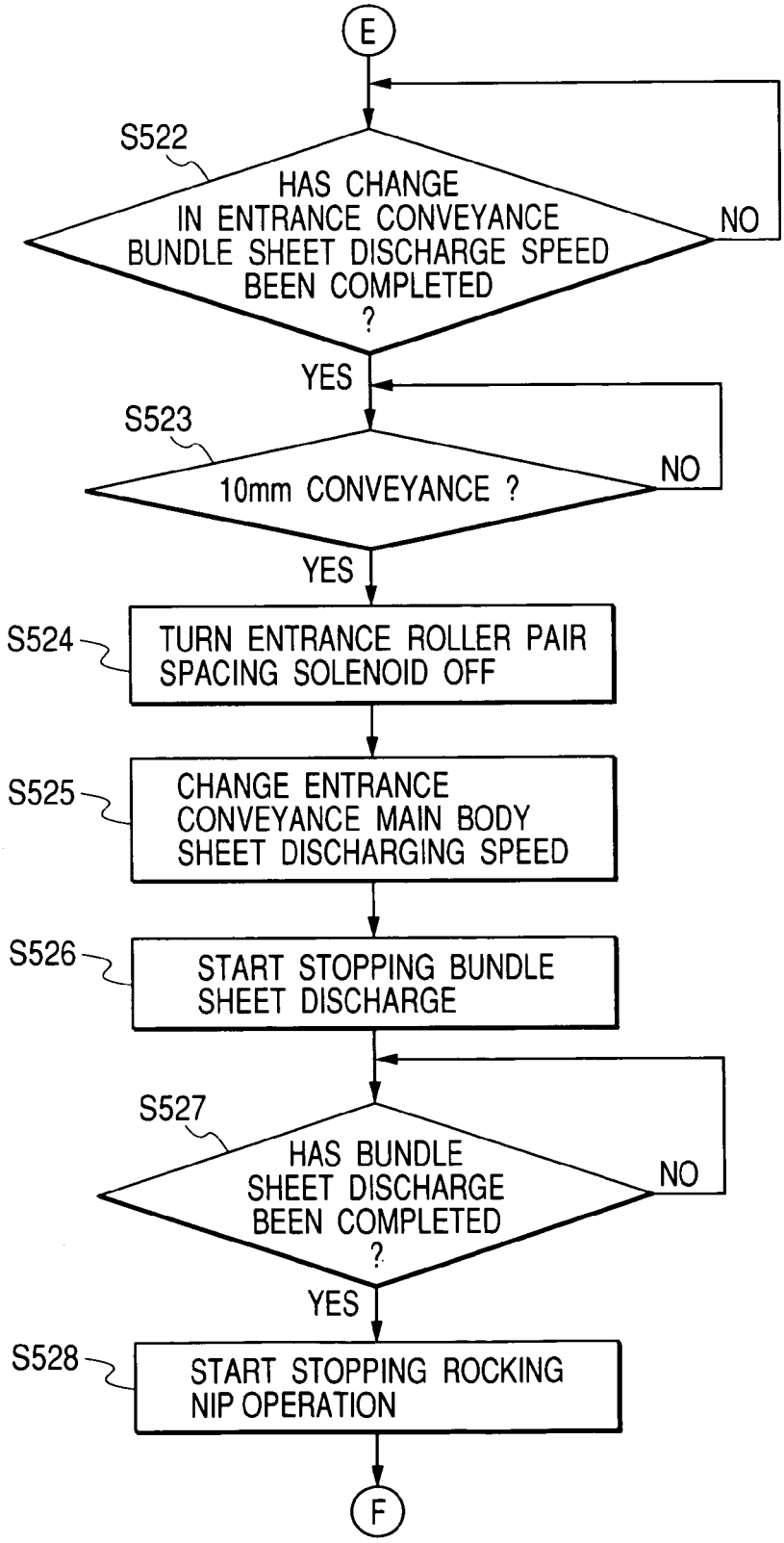
Figure 36C:
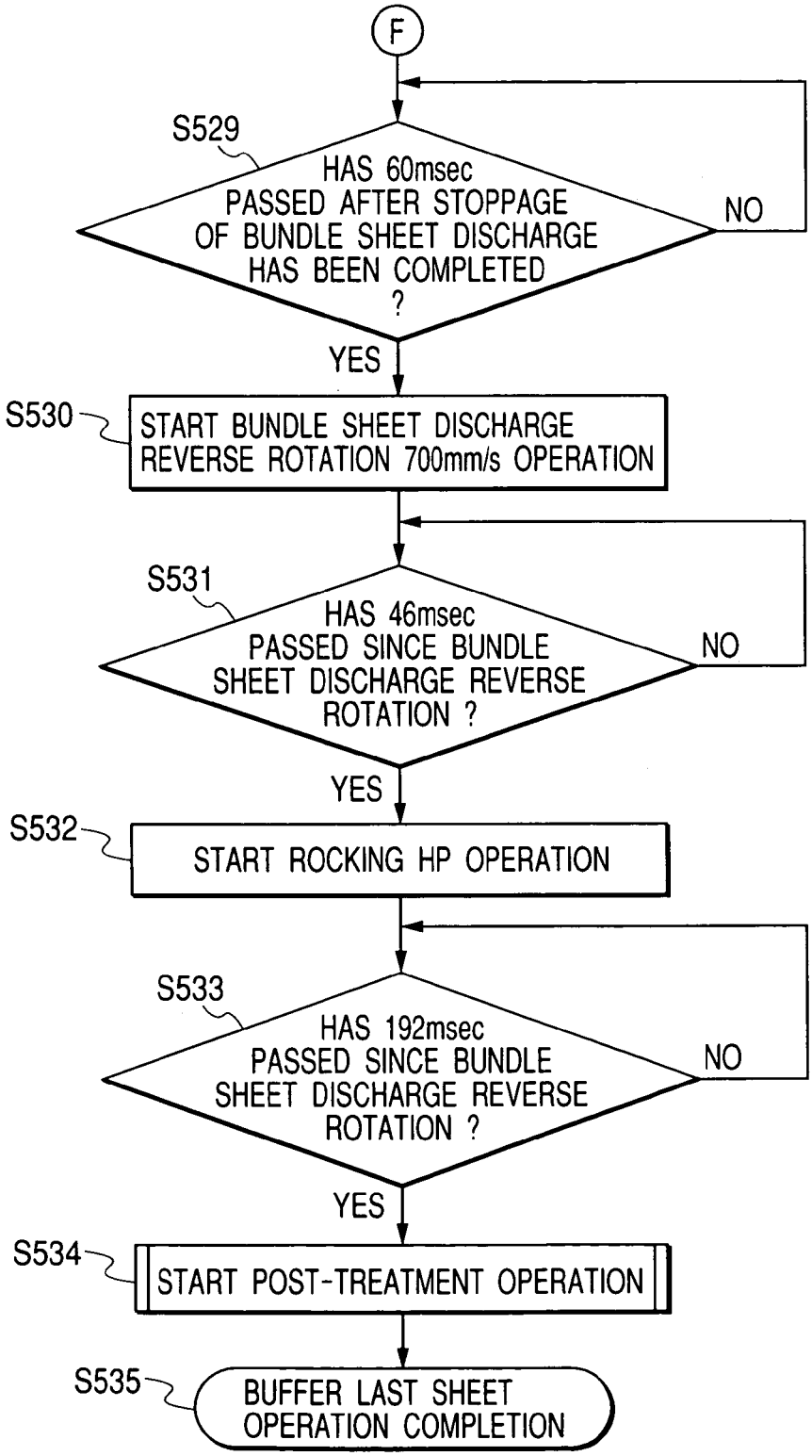

The buffer last sheet operation (S308) of FIG. 33 is an operation from stacking of the buffer sheets on the treatment tray 129 to start of the post-treatment operation as shown in S501 of FIG. 35A to S535 of FIG. 36C.

Figure 37A:
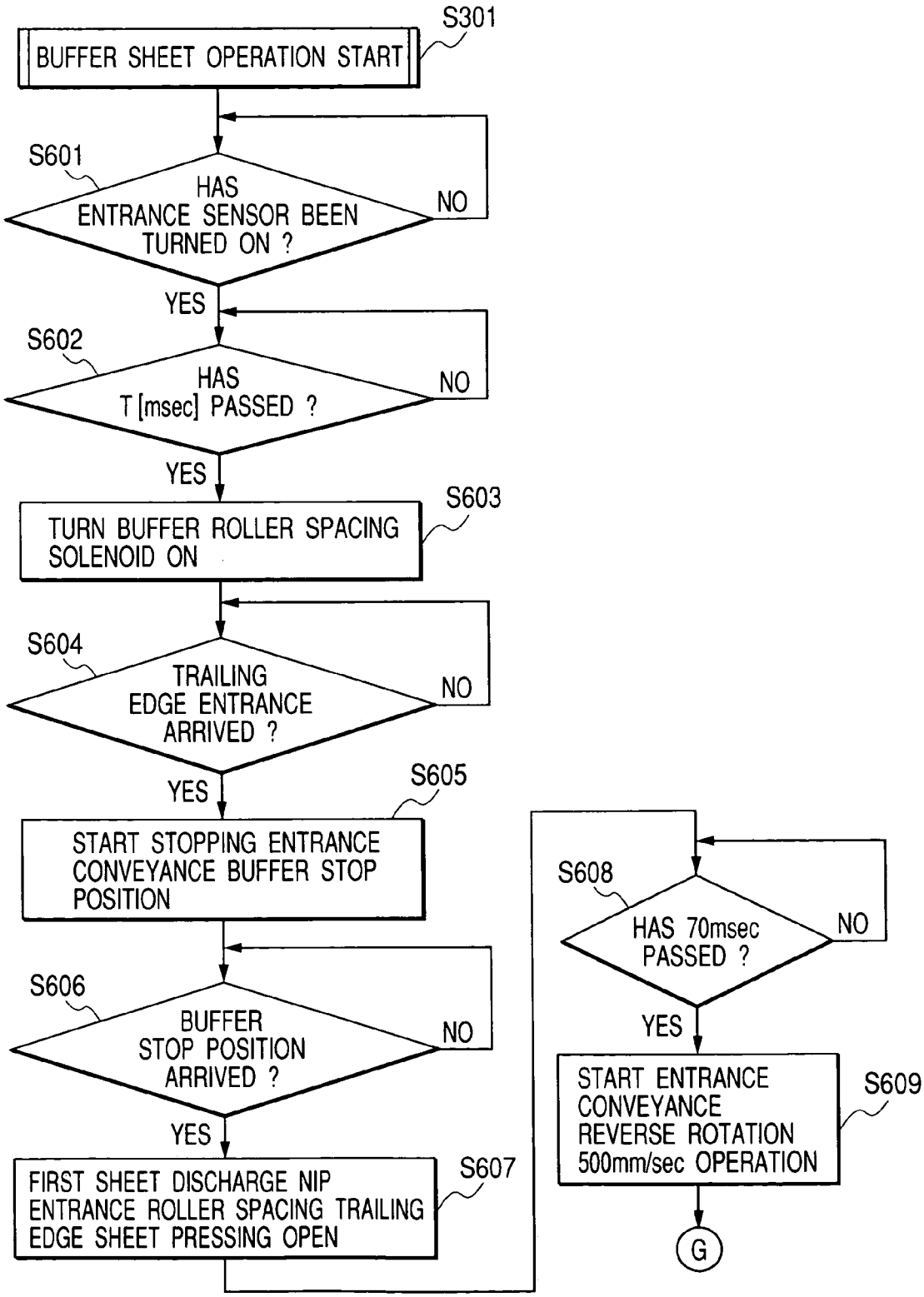
FIGS. 37A and 37B are flowcharts of a processing flow of a buffer sheet operation.
Figure 37B:
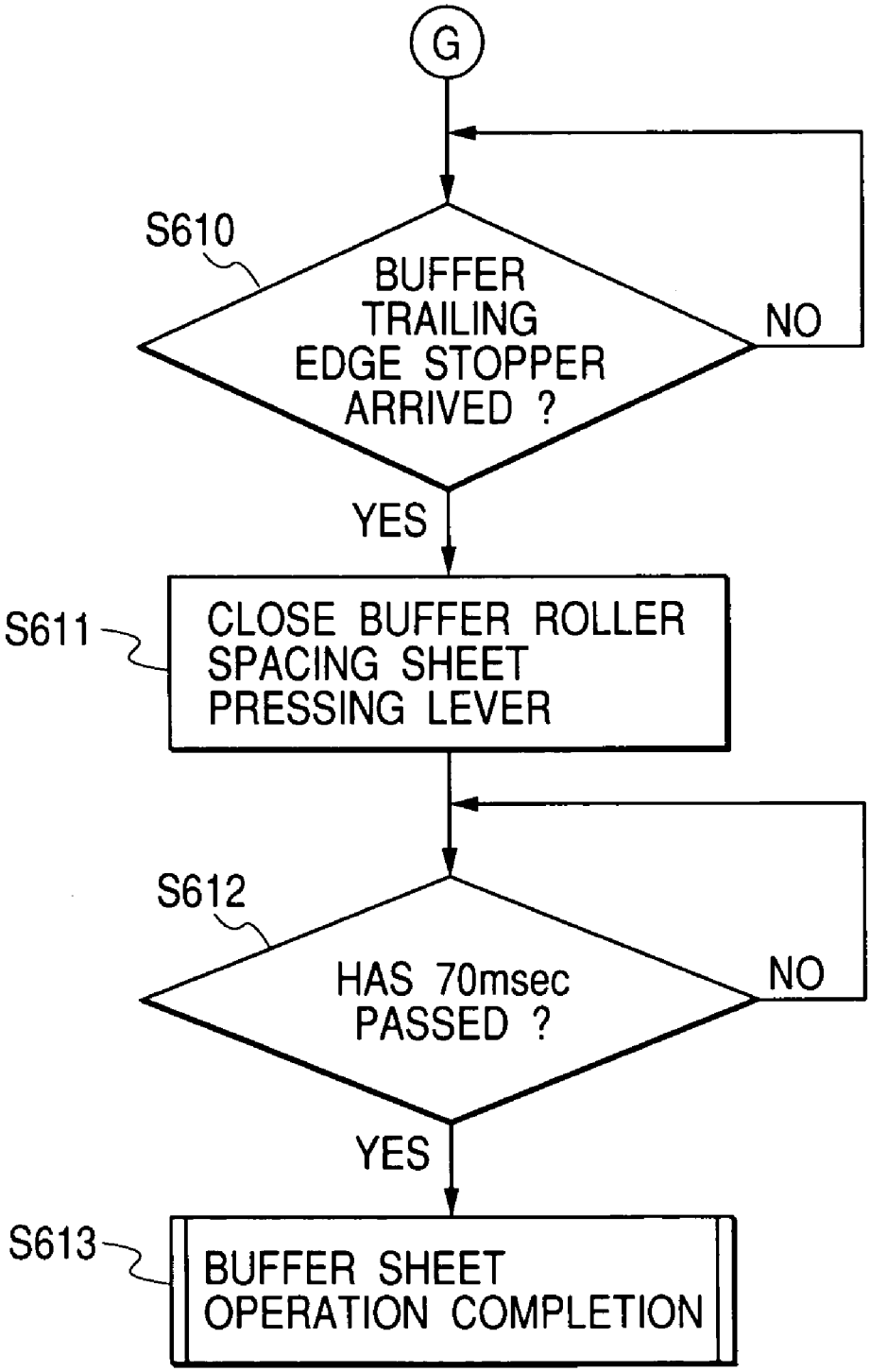

The buffer sheet operation (S309) of FIG. 33 is an operation of storing (buffering) buffer sheets in the guide 123 as shown in S601 to S613 of FIGS. 37A and 37B.

Figure 38A:
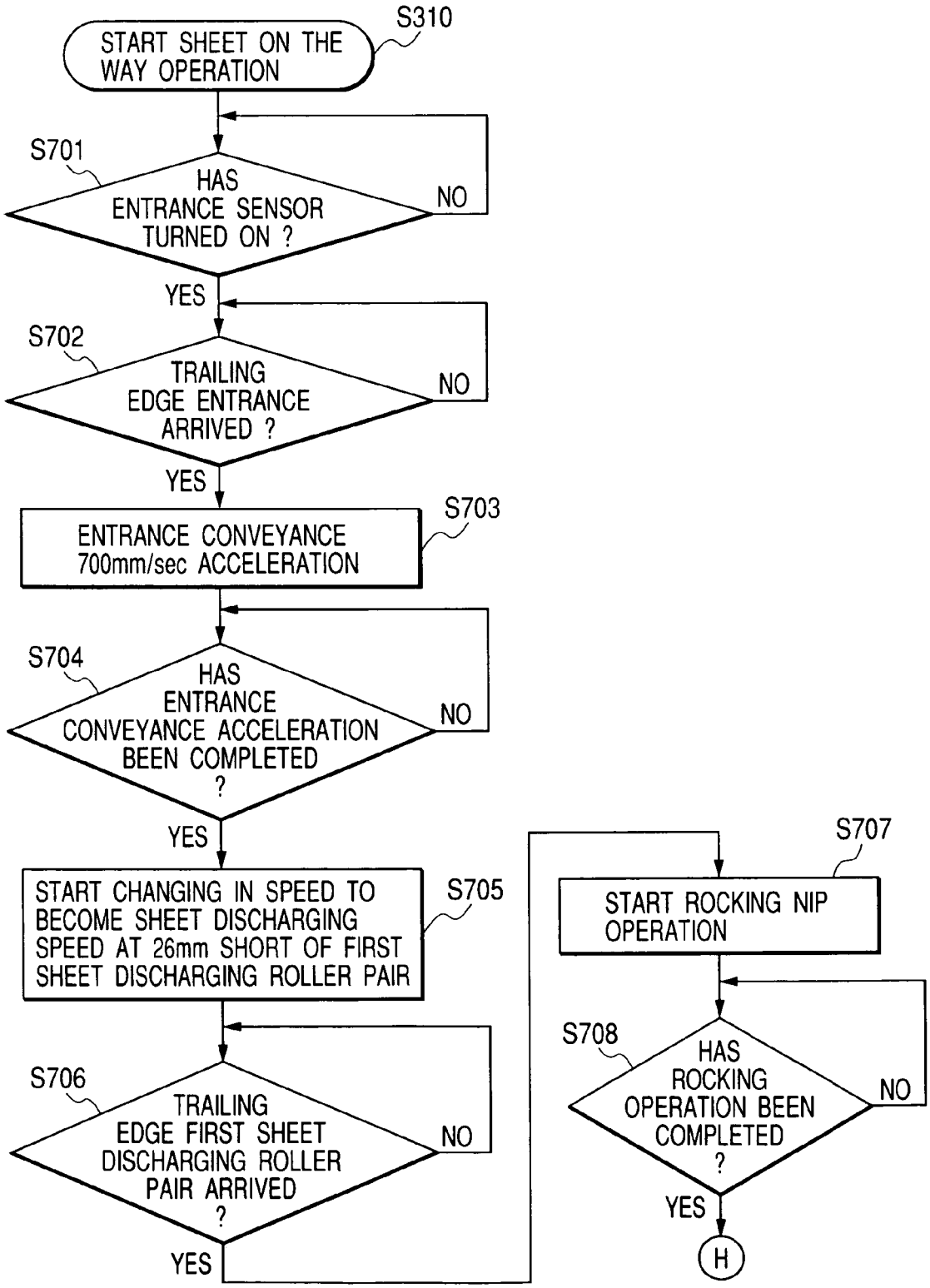
FIGS. 38A and 38B are flowcharts of a processing flow of a sheet on the way operation.
Figure 38B:
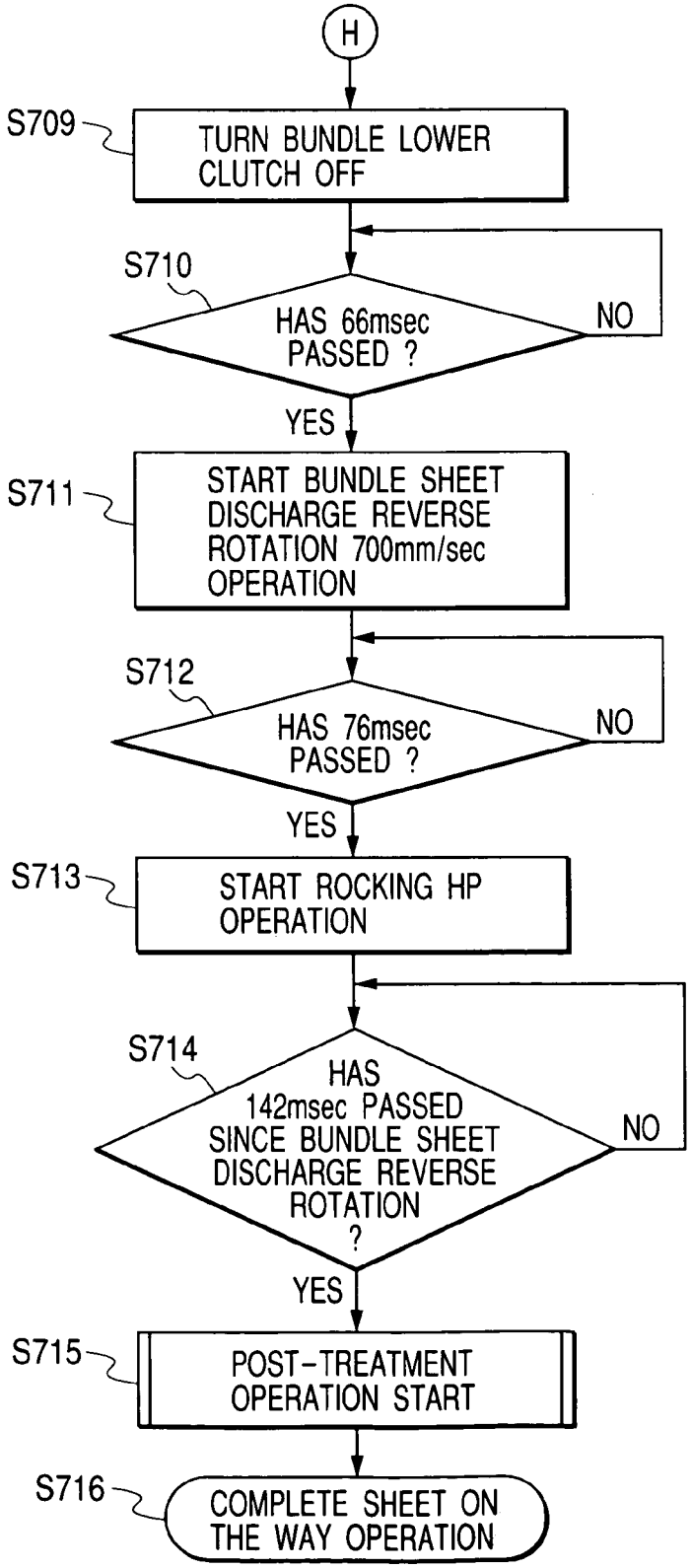

The sheet on the way operation (S310) of FIG. 33 is an operation from stacking of the second and its subsequent sheets on the treatment tray 129 to start of the sheet treatment as shown in S701 to S716 of FIGS. 38A and 38B.

Figure 39:
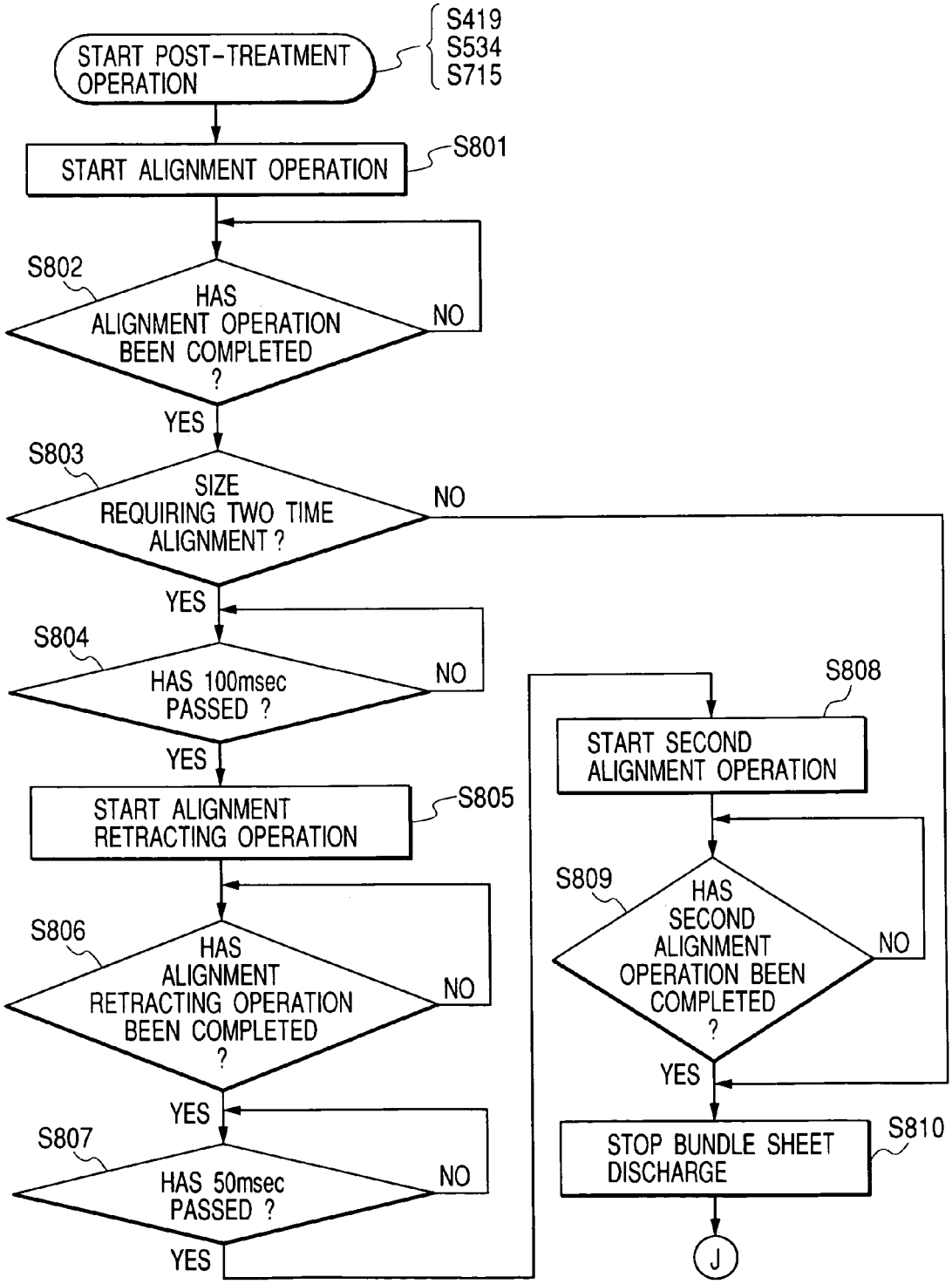
FIG. 39 is a flowchart of a processing flow of a post-treatment operation.
Figure 40:
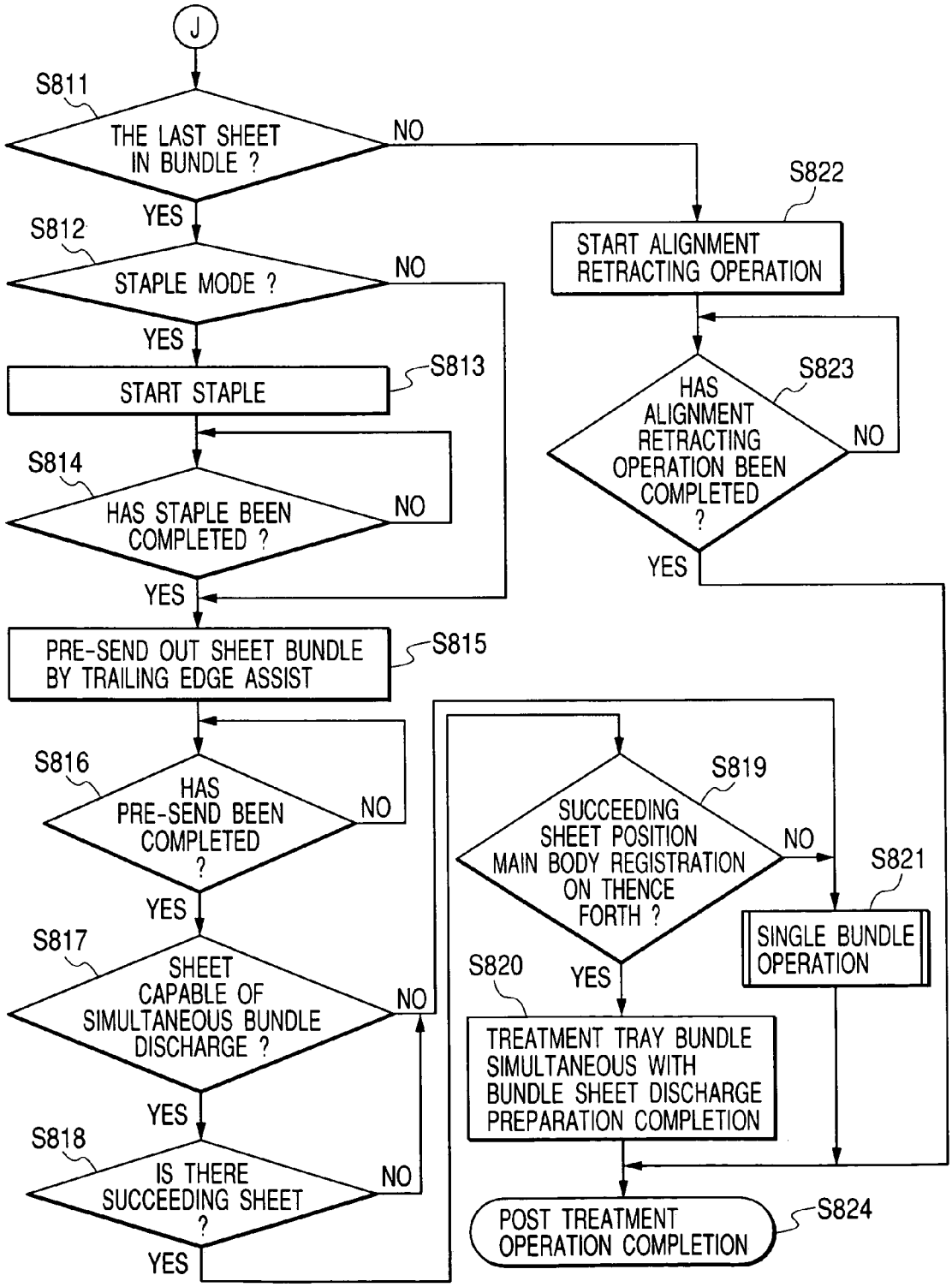
FIG. 40 is a flowchart of a processing flow continued from FIG. 39.

The "post-treatment operation start" in S419 of FIG. 34B, S534 of FIG. 36C, and S715 of FIG. 38B is an operation of, after stacking the sheets discharged from the apparatus main body 101 of the copying machine 100, carrying out the post-treatment as shown in S801 of FIG. 39 to S824 of FIG. 40.

(Buffer Sheet Operation)

The buffer sheet operation will be explained with reference to FIGS. 37A and 37B in detail. The buffer sheet operation is as follows: the sheets (paper) conveyed from the image forming apparatus main body 101 are first received at constant speed and it is confirmed that the entrance sensor S1 has been turned ON (S601). Thereafter, the process waits for the next operation by a time T (msec). The time T is derived from the following expression:

$$T=\{(B-x)\div A\}-C$$

A: discharge speed of the image forming apparatus (conveyance speed of the entrance roller pair 121)

B: length of the sheet P in the feed direction

Figure 7:
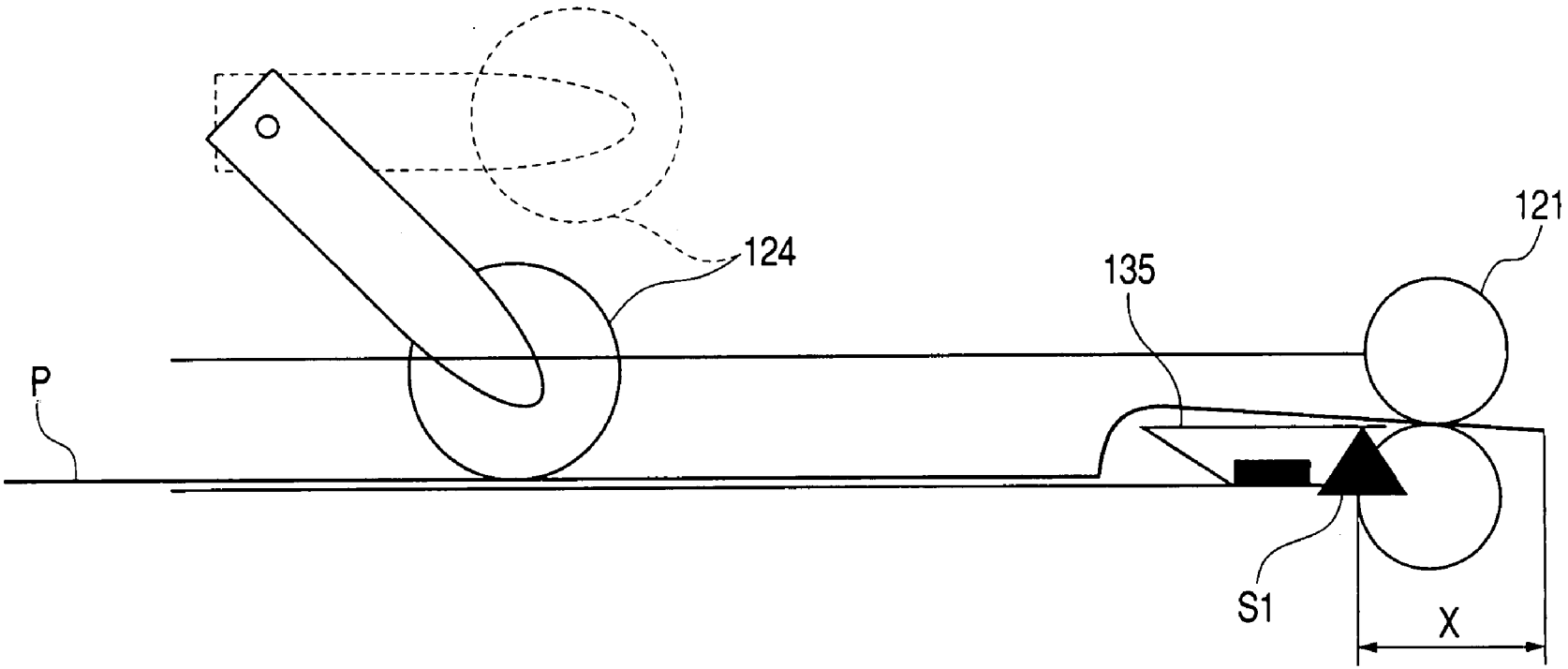
FIG. 7 is an explanatory view of a buffer sheet operation.

C: time necessary for lowering the buffer roller 124 x: distance between a position of the sensor S1 when the buffer roller 124 contacts the sheet and the sheet trailing edge (refer to FIG. 7)

Note that the interval between the entrance roller pair 121 and the buffer roller 124 is, needless to say, set smaller than the minimum length of each sheet in the feed direction.

After the elapse of T (msec) (S602), the buffer roller spacing solenoid SL1 is tuned ON (S603) to lower the buffer roller 124. As calculated from the above expression, a distance between the nip position of the entrance roller pair 121 to the sheet trailing edge is substantially equal to x at the time when the buffer roller 124 contacts the sheet. The buffer roller 124 contacts the sheet before the sheet trailing edge leaves the entrance roller pair 121. The distance x is set as a margin for ensuring that the sheet is taken over from the entrance roller pair 121 to the buffer roller 124 and thus set to the minimum distance. In other words, setting the pressure-contact conveyance time with the buffer roller 124 minimum avoids the roller trace or runner trace left on the buffer sheets that have been held (buffered) inside the buffer unit 140.

After the elapse of T (millisecond) (S602), the buffer roller spacing solenoid SL1 is tuned ON (S603) to lower the buffer roller 124. As calculated from the above expression, a distance between the nip position of the entrance roller pair 121 to the sheet trailing edge is substantially equal to x at the time when the buffer roller 124 contacts the sheet. The buffer roller 124 contacts the sheet before the sheet trailing edge leaves the entrance roller pair 121. The distance x is set as a margin for ensuring that the sheet is taken over from the entrance roller pair 121 to the buffer roller 124 and thus set to the minimum distance. In other words, setting the pressure-contact conveyance time with the buffer roller 124 minimum avoids the roller trace or runner trace left on the buffer sheets that have been held (buffered) inside the buffer unit 140.

As described above, according to this embodiment, by controlling the time from detection of the sheet with the sensor S1 to turn-ON of the buffer roller spacing solenoid SL1, the roller or runner can be kept from continuously rotating at the same position on the sheet at rest. In addition, the period during which the sheet is conveyed in pressure contact with the roller or runner can be shortened, thereby leaving no roller or runner trace.

In this embodiment, the description has been made of the horizontal buffer portion. However, needless to say, the present invention is not limited to the structure of this embodiment since the same effect of preventing the roller or runner trace can be attained without using the horizontal buffer portion under similar control when the present invention is applied to an apparatus structure where the return portion of the treatment tray or return structure on the stack tray is set horizontal.

As mentioned above, according to this embodiment, controlling the time from the detection of the sheet with the sensor to start of operation of the pressure-contact means makes it possible to avoid such a situation that the roller or runner continues rotating at the same position on the sheet at rest and to shorten the period during which the sheet is conveyed in pressure contact with the roller or runner, thereby leaving no roller or runner trace.

This application claims priority from Japanese Patent Application No. 2003-308882 filed on Sep. 1, 2003, which is hereby incorporated by reference herein.

What is claimed is:

1. A sheet treating apparatus comprising:

conveying means for conveying a sheet;

a buffer portion for stacking a plurality of sheets conveyed by the conveying means;

a sensor detecting the sheet conveyed to the buffer portion;

pressure-contact conveying means for conveying the sheet bundle stacked on the buffer portion in pressure contact with the sheet bundle;

pressure-contact means for bringing the pressure-contact conveying means into pressure-contact with the sheet bundle;

a treatment tray, which stacks the sheet bundle conveyed by the pressure-contact conveying means;

sheet treating means for providing a predetermined treatment to the sheet bundle on the treatment tray;

discharging means for discharging the sheet bundle provided with the predetermined treatment by the sheet treating means to an outside of the apparatus; and controlling means for varying a time from when the sensor detects the sheet to when the pressure-contact means starts operating according to a sheet conveyance speed of the conveying means.

2. A sheet treating apparatus according to claim 1, wherein a trailing edge of the sheet stacked on the buffer portion is held by a trailing edge presser provided in the buffer portion.

3. An image forming apparatus comprising:

image forming means for forming an image on a sheet; and a sheet treating apparatus as recited in claim 1, the sheet treating apparatus being adopted to treat the sheet on which the image forming means forms the image.

4. A sheet treating apparatus comprising:

a conveying device, which conveys a sheet;

a buffer portion, which stacks a plurality of sheets conveyed by the conveying device to form a sheet bundle;

a sensor detecting the sheet conveyed to the buffer portion;

a pressure-contact conveying device, which conveys the sheet bundle stacked on the buffer portion in pressure contact with the sheet bundle;

a pressure-contact device, which brings the pressure-contact conveying device into pressure-contact with the sheet bundle;

a treatment tray, which stacks the sheet bundle conveyed by the pressure-contact conveying device;

a sheet treating device, which provides a predetermined treatment to the sheet bundle on the treatment tray;

a discharging device, which discharges the sheet bundle provided with the predetermined treatment by the sheet treating device to an outside of the apparatus; and a controlling device, which varies a time from when the sensor detects the sheet to when the pressure-contact device starts operating according to a sheet conveyance speed of the conveying device.

* * * * *

UNITED STATES PATENT AND TRADEMARK OFFICE

CERTIFICATE OF CORRECTION

PATENT NO. : 7,185,883 B2
APPLICATION NO. : 10/928194
DATED : March 6, 2007
INVENTOR(S) : Hitoshi Kato et al.

It is certified that error appears in the above-identified patent and that said Letters Patent is hereby corrected as shown below:

IN THE DRAWINGS:
Sheet No. 9, Figure 9, “ASSIST” (second occurrence) should be deleted.
Sheet No. 35, Figure 34B, “STOPAGE” should read --STOPPAGE--.
Sheet No. 38, Figure 36A, “ASSIST” (second occurrence) should be deleted.

COLUMN 1:
Line 19, “being” should be deleted.
Line 61, “type one” should read --type sheet--.

COLUMN 2:
Line 6, “type one” should read --type sheet--.

COLUMN 4:
Line 59, “separated” should read --being separated--.

COLUMN 5:
Line 20, “data is,” should read --data is--.

COLUMN 6:
Line 62, “potion” should read --portion--.

UNITED STATES PATENT AND TRADEMARK OFFICE

CERTIFICATE OF CORRECTION

PATENT NO. : 7,185,883 B2
APPLICATION NO. : 10/928194
DATED : March 6, 2007
INVENTOR(S) : Hitoshi Kato et al.

It is certified that error appears in the above-identified patent and that said Letters Patent is hereby corrected as shown below:

COLUMN 14:
Delete lines 4 to 18.
Line 33, after "unit 140.", insert

--In S604, the sheet trailing edge arrives at the entrance sensor S1 and then an operation of stopping the entrance conveying motor M2 is started to stop the sheet at a buffer stop position (switchback point) (S605). In S606, when the sheet arrives at the buffer stop position and stops, the nip force of the first sheet discharging roller pair 126 is released to space the entrance toller pair 121 and open the trailing edge pressing 135 (S607). Then, the process waits for the termination of those operations by 70 msec (S608). After than, in S609, the entrance conveying motor M2 is rotated in a reverse direction at 500 mm/sec to convey the sheet to the (buffer) trailing edge receiving portion 136. Subsequently, the sheet is conveyed by a predetermined distance. When the sheet arrives at the trailing edge receiving portion 136 (S610), the buffer roller 124 is spaced therefrom to close the trailing edge pressing 135 (S611). The process waits for the termination of those operations by 70 msec (S612) to complete the buffer sheet operation.--.

Signed and Sealed this

Fourth Day of March, 2008

Jon W. Dudas

JON W. DUDAS
*Director of the United States Patent and Trademark Office*